US010980293B2

(12) United States Patent
Beaudry et al.

(10) Patent No.: US 10,980,293 B2
(45) Date of Patent: Apr. 20, 2021

(54) PROTECTIVE SUIT

(71) Applicant: Production Passau Inc., Chambly (CA)

(72) Inventors: Hugo Beaudry, Saint-Bruno-de-Montarville (CA); Alain Beaudry, St-Alphonse-de-Rodriguez (CA); Eric Lemieux, Saint-Sauveur-des-Monts (CA)

(73) Assignee: PRODUCTION PASSAU INC, Chambly (CA)

( * ) Notice: Subject to any disclaimer, the term of this patent is extended or adjusted under 35 U.S.C. 154(b) by 63 days.

(21) Appl. No.: 16/182,981

(22) Filed: Nov. 7, 2018

(65) Prior Publication Data

US 2020/0138125 A1 May 7, 2020

(51) Int. Cl.
*A41D 13/00* (2006.01)
*A41D 13/015* (2006.01)

(52) U.S. Cl.
CPC ..... *A41D 13/0153* (2013.01); *A41D 13/0158* (2013.01)

(58) Field of Classification Search
CPC ..... A41D 13/0153; A41D 13/0158
See application file for complete search history.

(56) References Cited

U.S. PATENT DOCUMENTS 3,076,197 A * 2/1963 Glahe ..... A63B 71/12 2/463
3,125,762 A * 3/1964 Glahe ..... A63B 71/12 2/463
4,370,754 A * 2/1983 Donzis ..... A41D 13/0153 2/16
4,453,271 A * 6/1984 Donzis ..... A41D 13/0153 2/2.5
4,525,875 A * 7/1985 Tomczak ..... A41D 13/0518 2/2.5
4,788,972 A * 12/1988 DeBusk ..... A61F 5/01 2/DIG. 1
4,884,295 A * 12/1989 Cox ..... A41D 13/0153 2/467
5,168,576 A * 12/1992 Krent ..... A41D 13/0156 2/456
5,465,423 A * 11/1995 Taylor-Varney ..... A41D 13/0153 2/44
5,465,424 A * 11/1995 Cudney ..... A41D 13/0153 2/102
5,557,802 A * 9/1996 Wickert ..... A41D 13/0153 2/462
6,182,299 B1 * 2/2001 Chen ..... A41D 13/0518 2/463

(Continued)

*Primary Examiner* — Khaled Annis
(74) *Attorney, Agent, or Firm* — Snyder, Clark, Lesch & Chung, LLP

(57) ABSTRACT

The present invention relates to a protective upper and lower body assemblies and protective suit comprising the same. The protective upper body assembly comprises a ventral and a dorsal padding panels, a left and a right shoulder fasteners, and a left and a right flank fasteners. Each of the ventral and the dorsal padding panels include at least two layers of resiliently compressible material and one layer of breathable material. The protective lower assembly comprises a left and a right upper thigh portions, a left and a right lower thigh portions, a left and a right knee shells, a left and a right lower leg portions, and a left and a right feet shells.

17 Claims, 27 Drawing Sheets

(56) References Cited

U.S. PATENT DOCUMENTS 6,295,654 B1 * 10/2001 Farrell ..... A41D 13/0153 2/456
6,775,851 B1 * 8/2004 Chen ..... A41D 13/0156 2/463
7,093,301 B1 * 8/2006 Moore, Jr. ..... A41D 13/0518 2/2.5
7,665,156 B1 * 2/2010 Hewitt ..... A41D 13/0518 2/455
10,582,731 B2 * 3/2020 Williams ..... B32B 5/245
2003/0056792 A1 * 3/2003 Bard ..... A61F 5/01 128/845
2004/0003456 A1 * 1/2004 Nishimoto ..... A63B 71/12 2/463
2005/0086728 A1 * 4/2005 Tobergte ..... A63B 71/12 2/459
2006/0096000 A1 * 5/2006 Romero ..... A41D 13/065 2/22
2010/0306908 A1 * 12/2010 Fiegener ..... A63B 71/12 2/463
2011/0307998 A1 * 12/2011 Turner ..... A41D 13/05 2/455
2012/0084896 A1 * 4/2012 Wyner ..... B32B 27/30 2/16
2015/0082523 A1 * 3/2015 Wyner ..... B32B 27/32 2/455
2015/0113717 A1 * 4/2015 Giron ..... A41D 13/0158 2/461
2016/0088882 A1 * 3/2016 Behrend ..... A41D 13/0153 2/2.5
2017/0196277 A1 * 7/2017 Henry ..... A41D 1/08
2017/0340029 A1 * 11/2017 Huang ..... A41D 13/0158
2018/0153233 A1 * 6/2018 Paquette ..... A41D 13/0568
2018/0343937 A1 * 12/2018 Pilon ..... A41D 13/0512
2019/0281905 A1 * 9/2019 Michelle ..... A41D 13/0153
2020/0138125 A1 * 5/2020 Beaudry ..... B32B 5/18

* cited by examiner

PROTECTIVE SUIT

TECHNICAL FIELD

The invention relates to personal protective equipment, and more particularly to a protective suit comprising upper and lower body assemblies for protecting a wearer.

BACKGROUND

Individuals involved in potentially hazardous situations like one found during riots, public disturbances, manifestations, demonstrations, or protests are at risk of confrontation and attack from multiple sources and may therefore require body protection to prevent or mitigate injury-causing or life-threatening encounters or aggression. For example, direct force impact may be received through physical attack from hostile individuals (e.g. kicks, punches, and other bodily impacts) and objects wielded by such individuals (e.g. baseball bats, knives, and the like) or ballistic impacts may derive from various thrown objects, bullets, explosion fragments, and other projectiles.

Most of the protective suits and other similar garments, gears, and equipment worn for body protection generally offer adequate protection to the wearer, but at the expense of freedom of movement. In most instances, the design and construction of the protective suits are such that successive layers of protective material are placed at sensitive areas of the body, for example adjacent to body joints and articulations, which all together result in impeding wearer's movement. Further, rigid material used in hardened inserts and shells that may be loosely attached on the outer layers of protective suits may also have a tendency to move or slide from their respective positioning to further hamper wearer's movement. Moreover, these protective suits are not generally designed and built around the idea of body temperature control and consequently do not implement such features to facilitate breathability and air circulation through the various material layers. This may prove challenging for the wearer in regions where the weather is hot.

On the other hand, not all the protective suits known in the art are readily configurable to adapt to the demanding environment and changing conditions that may be present on the field. As such, the adaptability of modular protective suits may not only be useful to the wearer for evident reasons, but may also help organizations to reduce the cost associated with acquiring such equipment at a large scale since a single protective suit may be adapted to respond to most demands. The modularity of protective suits may also prove useful in case of emergency by providing to first responders quick access to the vital organs of the wearer's torso, for example.

There is therefore a need for a protective suit which would overcome at least one of the above-identified drawbacks. For example, a modular protective suit offering adequate body protection to the wearer while including features enabling freedom of movement, body temperature control, and a quick access to the wearer's torso.

BRIEF SUMMARY

According to a first broad aspect, there is provided a padding panel for protecting a wearer, the padding panel comprising at least one layer of a resiliently compressible material having a distal face and a proximal face relative to the wearer when the padding panel is worn, the at least one layer including:

at least one movement-facilitating groove defined on at least one of the distal face and the proximal face of the layer, the at least one movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute to regulate body temperature of the wearer when the padding panel is worn.

According to a second broad aspect, there is provided a padding panel for protecting a wearer, the padding panel comprising:

a distal layer of a resiliently compressible material that is distal relative to the wearer when the padding panel is worn, the distal layer having a distal face and a proximal face, the distal layer being provided with a first plurality of ventilation holes extending between the distal face and the proximal face of the distal layer, the distal layer further being provided on at least one of the distal face and proximal face thereof with at least one movement-facilitating groove configured for facilitating freedom of movement to the wearer when the padding panel is worn; and a proximal layer of a resiliently compressible material that is proximal relative to the wearer when the padding panel is worn, the proximal layer having both a distal face and a proximal face relative to the wearer, the proximal layer being provided with a second plurality of ventilation holes extending between the distal face and the proximal face of the proximal layer, the proximal layer further being provided on the proximal face thereof with at least one ventilation groove, whereby the first plurality of ventilation holes, the second plurality of ventilation holes, and the at least one ventilation groove contribute to regulate body temperature of the wearer when the padding panel is worn.

According to a third broad aspect, there is provided a protective torso assembly for protecting a wearer, the protective torso assembly comprising:

a ventral padding panel adapted for at least partially covering a ventral face of an upper-body portion of the wearer, the ventral padding panel having left and right top ends, a bottom end, a left end, and a right end, the ventral padding panel including:

at least one layer of a resiliently compressible material having a distal face and a proximal face relative to the wearer when the padding panel is worn, the at least one layer including:

at least one movement-facilitating groove defined on at least one of the distal face and the proximal face of the layer, the movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute to regulate body temperature of the wearer when the padding panel is worn;

a dorsal padding panel adapted for at least partially covering a dorsal face of an upper-body portion of the wearer, the dorsal padding panel having left and right top ends, a bottom end, a left end, and a right end, the dorsal padding panel including:

at least one layer of a resiliently compressible material having a distal face and a proximal face relative to the wearer when the padding panel is worn, the at least one layer including:

at least one movement-facilitating groove defined on at least one of the distal face and the proximal face of the layer, the movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute to regulate body temperature of the wearer when the padding panel is worn, left and right shoulder elements, the left and right shoulder elements each comprising a ventral shoulder element portion and dorsal shoulder element portion, the left and right shoulder elements detachably attaching the left and right top ends of the ventral padding panel to the corresponding left and right top ends of the dorsal padding panel, the left and right shoulder elements defining with the ventral padding panel and the dorsal padding panel a neck opening for receiving a neck of the wearer therein; and left and right flank elements, the left and right flank elements each comprising a ventral flank element portion and a dorsal flank element portion, the left and right flank elements detachably attaching the left and right ends of the ventral padding panel to the corresponding left and right ends of the dorsal padding panel, the left and right flank elements and the left and right shoulder elements defining with the ventral padding panel and the dorsal padding panel a pair of left and right arm openings for receiving left and right arms of the wearer therein.

In one aspect, at least one layer of the ventral padding panel comprises a distal layer and a proximal layer relative to the wearer when the protective torso assembly is worn, the distal layer and the proximal layer each comprising a proximal face and a distal face, at least one of the distal layer and the proximal layer including:

at least one movement-facilitating groove defined on at least one of the distal face and the proximal face of the at least one of the distal layer and the proximal layer;

a plurality of ventilation holes extending between the distal face and the proximal face of at least one of the distal layer and the proximal layer; and at least one ventilation groove defined on the proximal face of at least one of the distal layer and the proximal layer.

In one aspect, at least one layer of the dorsal padding panel comprises a distal layer and a proximal layer relative to the wearer when the protective torso assembly is worn, the distal layer and the proximal layer of the dorsal padding panel each comprising a proximal face and a distal face, at least one of the distal layer and the proximal layer including:

at least one movement-facilitating groove defined on at least one of the distal face and the proximal face of at least one of the distal layer and the proximal layer;

a plurality of ventilation holes extending between the distal face and the proximal face of at least one the distal layer and the proximal layer; and at least one ventilation groove defined on the proximal face of at least one of the distal layer and the proximal layer.

In one aspect, at least one movement-facilitating groove is defined on the distal face of the distal layer of any one of the ventral padding panel and the dorsal padding panel.

In one aspect, the plurality of ventilation holes extends between the distal face and the proximal face of each of the distal layer and the proximal layer of any one of the ventral padding panel and the dorsal padding panel.

In one aspect, at least one ventilation groove is defined on the proximal face of the proximal layer of any one of the ventral padding panel and the dorsal padding panel.

In one aspect, at least one movement-facilitating groove of the ventral padding panel comprises a first plurality of horizontal movement-facilitating grooves and a first plurality of vertical movement-facilitating grooves.

In one aspect, the first plurality of horizontal movement-facilitating grooves defines V-shaped grooves extending generally horizontally between the left end and the right end of the ventral padding panel.

In one aspect, the first plurality of vertical movement-facilitating grooves extends generally vertically between the bottom end and at least one horizontal movement-facilitating groove of the plurality of horizontal movement-facilitating grooves of the ventral padding panel.

In one aspect, the first plurality of horizontal movement-facilitating grooves and the first plurality of vertical movement-facilitating grooves define with the left and right top ends, the bottom end, the left end, and the right end of the ventral padding panel a first plurality of protective sections adapted for protecting the wearer.

In one aspect, the first plurality of protective sections comprises at least one ventral protective section adapted for receiving at least one hardened inserts.

In one aspect, the first plurality of protective sections comprises at least one ventral protective section adapted for receiving at least one ventral cut configured for facilitating freedom of movement to the wearer.

In one aspect, at least one movement-facilitating groove of the dorsal padding panel comprises a second plurality of horizontal movement-facilitating grooves and a second plurality of vertical movement-facilitating grooves.

In one aspect, the second plurality of horizontal movement-facilitating grooves defines V-shaped grooves extending generally horizontally between the left end and the right end of the dorsal padding panel.

In one aspect, the second plurality of vertical movement-facilitating grooves extends generally vertically between the bottom end and the left and right top ends of the dorsal padding panel.

In one aspect, the second plurality of horizontal movement-facilitating grooves and the second plurality of vertical movement-facilitating grooves define with the left and right top ends, the bottom end, the left end, and the right end of the dorsal padding panel a second plurality of protective sections adapted for protecting the wearer.

In one aspect, the second plurality of protective sections comprises at least one dorsal protective section adapted for receiving at least one dorsal cut adapted for facilitating freedom of movement to the wearer.

In one aspect, at least one ventilation groove of any one of the ventral padding panel and the dorsal padding panel each define a honeycomb-like configuration including a plurality of honeycomb-like motifs.

In one aspect, at least one ventilation hole of the plurality of ventilation holes of the ventral padding panel is defined in at least one of the honeycomb-like motifs of the ventral padding panel.

In one aspect, at least one ventilation hole of the plurality of ventilation holes of the dorsal padding panel is defined in at least one of the honeycomb-like motifs of the dorsal padding panel.

In one aspect, at least one ventilation hole of the plurality of ventilation holes of the proximal layer of the ventral padding panel is defined in at least one of the honeycomb-like motifs of the proximal layer of the ventral padding panel.

In one aspect, at least one ventilation hole of the plurality of ventilation holes of the proximal layer of the dorsal padding panel is defined in at least one of the honeycomb-like motifs of the proximal layer of the dorsal padding panel.

In one aspect, at least one layer of a protective material is layered to any one of the distal face and the proximal face of any one of the at least one layer of a resiliently compressible material, the distal layer, and the proximal layer.

In one aspect, the ventral padding panel comprises a first layer of a protective material, a second layer of a protective material, a third layer of a protective material, and a fourth layer of a protective material, the first layer of a protective material being layered to the distal face of the distal layer of the ventral padding, the second layer of a protective material being layered to the proximal face of the distal layer of the ventral padding panel, the third layer of a protective material being layered to the distal face of the proximal of the ventral padding panel, and the fourth layer of a protective material being layered to the proximal face of the proximal layer of the ventral padding panel.

In one aspect, the dorsal padding panel comprises a first layer of a protective material, a second layer of a protective material, a third layer of a protective material, and a fourth layer of a protective material, the first layer of a protective material being layered to the distal face of the distal layer of the dorsal padding, the second layer of a protective material being layered to the proximal face of the distal layer of the dorsal padding panel, the third layer of a protective material being layered to the distal face of the proximal of the dorsal padding panel, and the fourth layer of a protective material being layered to the proximal face of the proximal layer of the dorsal padding panel.

In one aspect, a pocket is defined between the second layer of a protective material and the third layer of a protective material of the ventral padding, the pocket being adapted for receiving a ballistic shield therein.

In one aspect, a pocket is defined between the second layer of a protective material and the third layer of a protective material of the dorsal padding, the pocket being adapted for receiving a ballistic shield therein.

In one aspect, each of the ventral shoulder element portions comprises a first section and a second section sandwiching a corresponding dorsal shoulder element portion therebetween.

In one aspect, each of the ventral flank element portions comprises a resiliently elastic element adapted for fittingly adjusting the protective torso assembly to a torso of the wearer.

In one aspect, each of the left and right shoulder elements comprises a velcro for detachably attaching the left and right top ends of the ventral padding panel to the corresponding left and right top ends of the dorsal padding panel, further wherein each of the left and right flank elements each comprise a velcro for detachably attaching the left and right ends of the ventral padding panel to the corresponding left and right ends of the dorsal padding panel.

In one aspect, any one of the left and right shoulder elements and the left and right flank elements comprise a pull tab indicating a pulling location for detaching any one of the left and right shoulder elements and the left and right flank elements.

According to a fourth broad aspect, there is provided a protective upper limb assembly for protecting a wearer, the protective upper limb assembly comprising at least one protective sleeve, the least one protective sleeve including:

a shoulder shell having a cavity adapted for receiving at least partially a shoulder of the wearer therein;

an upper arm portion adapted for surrounding at least partially an upper arm of the wearer, the upper arm portion having top and bottom ends and a proximal face relative to the wearer, the upper arm portion being connected, at the top end thereof, to at least one of the shoulder shell and a corresponding left and right arm openings of a protective torso assembly;

an elbow shell having a cavity adapted for receiving at least partially an elbow of the wearer therein, the elbow shell having top and bottom ends, the elbow shell being pivotally connected, at the top end thereof, to the upper arm portion, at the bottom end thereof;

a forearm portion adapted for surrounding at least partially a forearm of the wearer, the forearm portion including top and bottom ends and a proximal face relative to the wearer, the forearm portion being pivotally connected, at the top end thereof, to the elbow shell, at the bottom end thereof; and a means for detachably attaching the protective sleeve to a corresponding upper limb of the wearer, wherein the upper arm portion and the forearm portion each include a layer of a resiliently compressible material having a distal face and a proximal face relative to the wearer when the protective sleeve is worn, the layer of a resiliently compressible material being provided with a plurality of ventilation holes extending between the distal face and the proximal face, the layer of a resiliently compressible material further being provided on the proximal face thereof with at least one ventilation groove, the plurality of ventilation holes and the ventilation groove contributing to regulate body temperature of the wearer when the protective upper limb assembly is worn.

In one aspect, at least one of the shoulder shell and the elbow shell comprises a rigid material.

In one aspect, the upper arm portion is connected any one of the corresponding left and right arm openings of a protective torso assembly by a resiliently elastic element configured for facilitating freedom of movement to the wearer.

In one aspect, any one the upper arm portion and the forearm portion comprise at least one hardened insert located on the distal face of the layer of a resiliently compressible material.

In one aspect, at least one ventilation groove defines a honeycomb-like configuration including a plurality of honeycomb-like motifs.

In one aspect, at least one ventilation hole of the plurality of ventilation holes is defined in at least one of the honeycomb-like motifs.

In one aspect, at least one layer of a protective material is layered to any one of the distal face and the proximal face of the layer of a resiliently compressible material.

According to a fifth broad aspect, there is provided a protective lower body assembly for protecting a wearer, the protective lower body assembly comprising at least one leg protector, the at least one leg protector including:

an upper thigh portion adapted for surrounding at least partially an upper thigh of the wearer, the upper thigh portion having top and bottom ends and a proximal face relative to the wearer;

a lower thigh portion having top and bottom ends, the lower thigh portion being pivotally connected, at the top end thereof, to the upper thigh portion, at the bottom end thereof;

a knee shell having a cavity adapted for receiving at least partially a knee of the wearer therein, the knee shell including top and bottom ends, the knee shell being pivotally connected, at the top end thereof, to the upper thigh portion, at the bottom end thereof;

a lower leg portion adapted for surrounding at least partially a lower leg of the wearer, the lower leg portion having top and bottom ends and a proximal face relative to the wearer, the lower leg portion being pivotally connected, at the top end thereof, to the knee shell, at the bottom end thereof;

a foot shell having a cavity adapted for covering at least partially a foot of the wearer, the foot shell being pivotally connected to the lower leg portion, at the bottom end thereof; and a means for detachably attaching the leg protector to a corresponding leg of the wearer, wherein the upper thigh portion, the lower thigh portion, and the lower leg portion each include a layer of a resiliently compressible material having a distal face and a proximal face relative to the wearer when the leg protector is worn, the layer of a resiliently compressible material of the upper thigh portion and the lower leg portion being provided with a plurality of ventilation holes extending between the distal face and the proximal face, the layer of a resiliently compressible material of the upper thigh portion and the lower leg portion further being provided on the proximal face thereof with at least one ventilation groove, the plurality of ventilation holes and the ventilation groove contributing to regulate body temperature of the wearer when the protective upper limb assembly is worn.

In one aspect, the knee shell and the foot shell comprise a rigid material.

In one aspect, the knee shell is connected to the upper thigh assembly by a resiliently elastic element configured for facilitating freedom of movement to the wearer.

In one aspect, any one the upper thigh portion and the lower leg portion comprise at least one hardened insert located on the distal face of the layer of a resiliently compressible material.

In one aspect, at least one ventilation groove defines a honeycomb-like configuration including a plurality of honeycomb-like motifs.

In one aspect, at least one ventilation hole of the plurality of ventilation holes is defined in at least one of the honeycomb-like motifs.

In one aspect, at least one layer of a protective material is layered to any one of the distal face and the proximal face of the layer of a resiliently compressible material.

In one aspect, the lower body assembly further comprises a means for detachably attaching the lower body assembly to a protective torso assembly.

According to a sixth broad aspect, there is provided a kit comprising at least one of:

a protective torso assembly for protecting a wearer, the protective torso assembly comprising:

a ventral padding panel adapted for at least partially covering the ventral face of an upper-body portion of the wearer, the ventral padding panel having left and right top ends, a bottom end, a left end, and a right end, the ventral padding panel including:

at least one layer of a resiliently compressible material having a distal face and a proximal face relative to the wearer when the padding panel is worn, the at least one layer including:

at least one movement-facilitating groove defined on at least one of the distal face and the proximal face of the layer, the movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute to regulate body temperature of the wearer when the padding panel is worn;

a dorsal padding panel adapted for at least partially covering the dorsal face of an upper-body portion of the wearer, the dorsal padding panel having left and right top ends, a bottom end, a left end, and a right end, the dorsal padding panel including:

at least one layer of a resiliently compressible material having a distal face and a proximal face relative to the wearer when the padding panel is worn, the at least one layer including:

at least one movement-facilitating groove defined on at least one of the distal face and the proximal face of the layer, the movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute to regulate body temperature of the wearer when the padding panel is worn;

left and right shoulder elements, the left and right shoulder elements each comprising a ventral shoulder element portion and dorsal shoulder element portion, the left and right shoulder elements detachably attaching the left and right top ends of the ventral padding panel to the corresponding left and right top ends of the dorsal padding panel, the left and right shoulder elements defining with the ventral padding panel and the dorsal padding panel a neck opening for receiving a neck of the wearer therein; and left and right flank elements, the left and right flank elements each comprising a ventral flank element portion and a dorsal flank element portion, the left and right flank elements detachably attaching the left and right ends of the ventral padding panel to the corresponding left and right ends of the dorsal padding panel, the left and right flank elements and the left and right shoulder elements defining with the ventral padding panel and the dorsal padding panel a pair of left and right arm openings for receiving left and right arms of the wearer therein;

a protective upper limb assembly for protecting a wearer, the protective upper limb assembly comprising at least one protective sleeve, the least one protective sleeve including:

a shoulder shell having a cavity adapted for receiving at least partially a shoulder of the wearer therein;

an upper arm portion adapted for surrounding at least partially an upper arm of the wearer, the upper arm portion having top and bottom ends and a proximal face relative to the wearer, the upper arm portion being connected, at the top end thereof, to at least one of the shoulder shell and a corresponding left and right arm openings of a protective torso assembly;

an elbow shell having a cavity adapted for receiving at least partially an elbow of the wearer therein, the elbow shell having top and bottom ends, the elbow shell being pivotally connected, at the top end thereof, to the upper arm portion, at the bottom end thereof;

a forearm portion adapted for surrounding at least partially a forearm of the wearer, the forearm portion including top and bottom ends and a proximal face relative to the wearer, the forearm portion being pivotally connected, at the top end thereof, to the elbow shell, at the bottom end thereof; and a means for detachably attaching the protective sleeve to a corresponding upper limb of the wearer, wherein the upper arm portion and the forearm portion each include a layer of a resiliently compressible material having a distal face and a proximal face relative to the wearer when the protective sleeve is worn, the layer of a resiliently compressible material being provided with a plurality of ventilation holes extending between the distal face and the proximal face, the layer of a resiliently compressible material further being provided on the proximal face thereof with at least one ventilation groove, the plurality of ventilation holes and the ventilation groove contributing to regulate body temperature of the wearer when the protective upper limb assembly is worn; and a protective lower body assembly for protecting a wearer, the protective lower body assembly comprising at least one leg protector, the at least one leg protector including:

an upper thigh portion adapted for surrounding at least partially an upper thigh of the wearer, the upper thigh portion having top and bottom ends and a proximal face relative to the wearer;

a lower thigh portion having top and bottom ends, the lower thigh portion being pivotally connected, at the top end thereof, to the upper thigh portion, at the bottom end thereof;

a knee shell having a cavity adapted for receiving at least partially a knee of the wearer therein, the knee shell including top and bottom ends, the knee shell being pivotally connected, at the top end thereof, to the upper thigh portion, at the bottom end thereof;

a lower leg portion adapted for surrounding at least partially a lower leg of the wearer, the lower leg portion having top and bottom ends and a proximal face relative to the wearer, the lower leg portion being pivotally connected, at the top end thereof, to the knee shell, at the bottom end thereof;

a foot shell having a cavity adapted for covering at least partially a foot of the wearer, the foot shell being pivotally connected to the lower leg portion, at the bottom end thereof; and a means for detachably attaching the leg protector to a corresponding leg of the wearer, wherein the upper thigh portion, the lower thigh portion, and the lower leg portion each include a layer of a resiliently compressible material having a distal face and a proximal face relative to the wearer when the leg protector is worn, the layer of a resiliently compressible material of the upper thigh portion and the lower leg portion being provided with a plurality of ventilation holes extending between the distal face and the proximal face, the layer of a resiliently compressible material of the upper thigh portion and the lower leg portion further being provided on the proximal face thereof with at least one ventilation groove, the plurality of ventilation holes and the ventilation groove contributing to regulate body temperature of the wearer when the protective upper limb assembly is worn.

According to a seventh broad aspect, there is provided a protective neck collar for protecting a wearer, the protective neck collar comprising:

a liquid-proof material at least partially covering an upper body portion of the wearer; and a neck opening defined within the liquid-proof material, the neck opening sealingly adapted for receiving a neck of the wearer therein, whereby the neck collar prevents a liquid of contacting the wearer.

In one aspect, the protective neck collar further comprises a means for detachably attaching the protective neck collar to a neck opening of a protective torso assembly.

According to an eighth broad aspect, there is provided a groin protector for protecting a wearer, the groin protector comprising:

a protective groin panel adapted for protecting at least partially a pelvic region of the wearer;

a groin wrap having a pocket adapted for receiving the protective groin panel therein, the pocket maintaining the protective groin panel in vicinity of the pelvic region of the wearer, on the ventral face thereof; and at least one attaching means pivotally attaching the groin wrap to the wearer, the groin wrap pivoting relative to a waist region of the wearer, wherein the protective groin panel and the groin wrap are configured in size and shape to conform to the pelvic region of the wearer.

In one aspect, the groin protector further comprises a means for detachably attaching the groin protector to a protective torso assembly.

Further details of the invention and its advantages will be apparent from the detailed description included below.

DETAILED DESCRIPTION

In the following description of the embodiments, references to the accompanying drawings are by way of illustration of an example by which the invention may be practiced. It will be understood that other embodiments may be made without departing from the scope of the invention disclosed.

Figure 1:
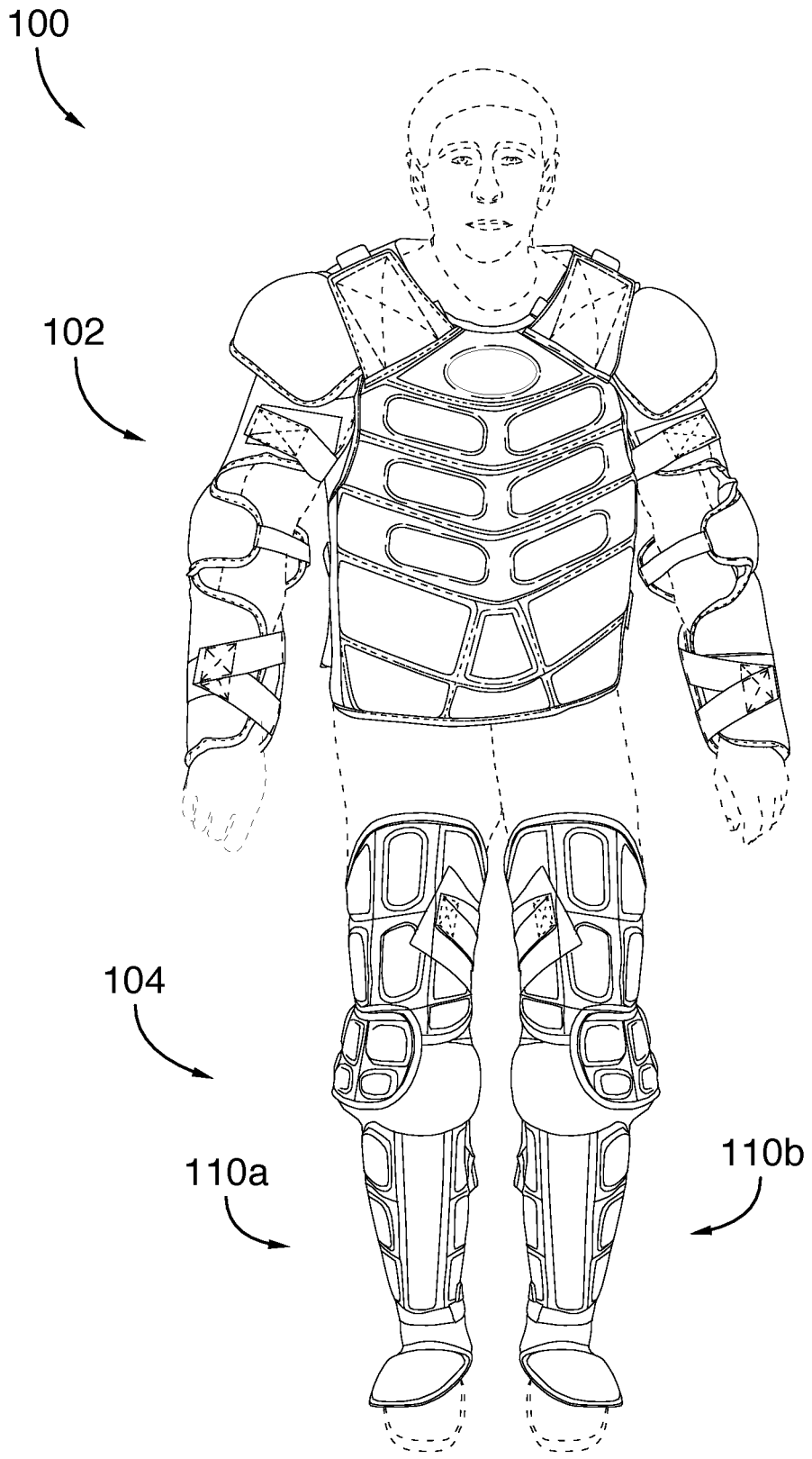
FIG. 1 is a front perspective view of a protective suit comprising a protective upper body assembly and a protective lower body assembly, in accordance with an embodiment.
Figure 2:
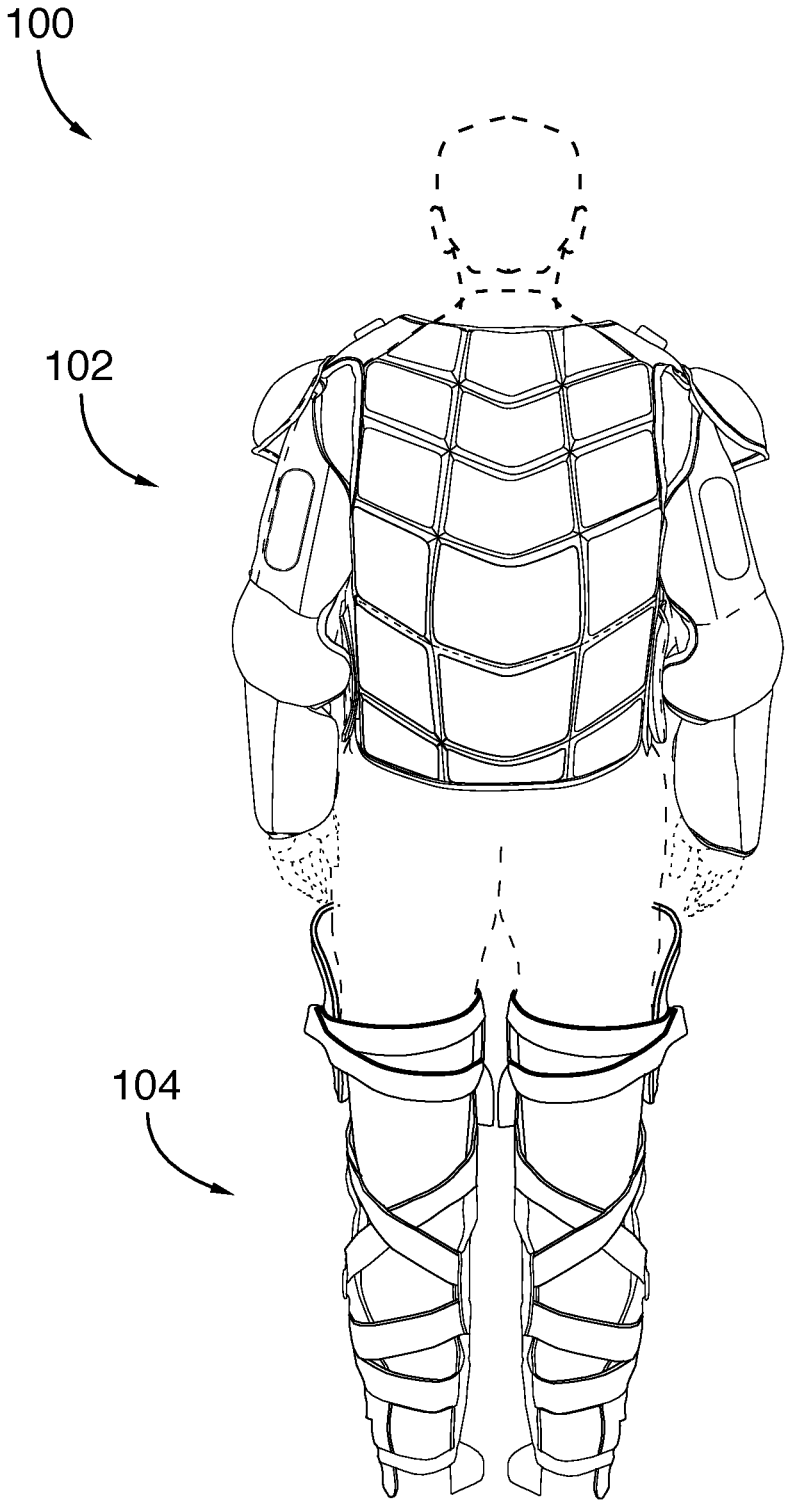
FIG. 2 is a rear perspective view of the protective suit illustrated in FIG. 1.

Referring to FIGS. 1 and 2, there is disclosed a protective suit 100 fitting various wearer's sizes and adapted for providing protection and freedom of movement. Accordingly, the protective suit 100 may be adjusted to conform to different wearer's anatomies and varying configuration preferences. The protective suit 100 may also include features like easy access to the wearer's torso (or trunk) (e.g. in case of emergency or to facilitate clothing), body temperature control, and modular anti-ballistic or bulletproof capabilities, for instance. In one embodiment, the protective suit 100 comprises an upper body assembly 102 and a lower body assembly 104. As it will be appreciated herein, the protective suit 100 is modular such that any one of its components, including the upper body assembly 102 and the lower body assembly 104, may be used conjointly or independently from one another.

The term "protective suit" as intended herein is to be interpreted broadly as meaning any suit, garment, gear, or equipment used by police forces, prison guards, security guards, bodyguards, military forces and the like in the course of their activities, for instance to control or circumscribe crowd or groups of individuals during various forms of violent or potentially violent forms of riot, public disturbance, manifestation, demonstrations, or protest. It should be kept in mind that the presently disclosed protective suit 100 is particularly although not exclusively applicable to the personnel and types of activities listed hereinabove but may also be used under any other circumstances requiring protection of individuals, as it will become apparent hereinbelow.

Upper Body Assembly

With reference to FIGS. 3 to 15, the upper body assembly 102 will now be described. In one embodiment, referring more particularly to FIG. 3, the upper body assembly 102 generally defines a jacket-like garment and comprises a vest 300 and a pair of left and right sleeves 302*a*, 302*b* attached thereto. The vest 300 is aimed at providing protection to the upper part of the body of a wearer, including the torso (e.g. chest or thorax, abdomen, back, shoulders, and base of the neck), while the sleeves 302*a*, 302*b* are aimed at providing protection to the upper limbs of the wearer (e.g. shoulders, upper arms, elbows, forearms, and wrists).

Vest

Figure 3:
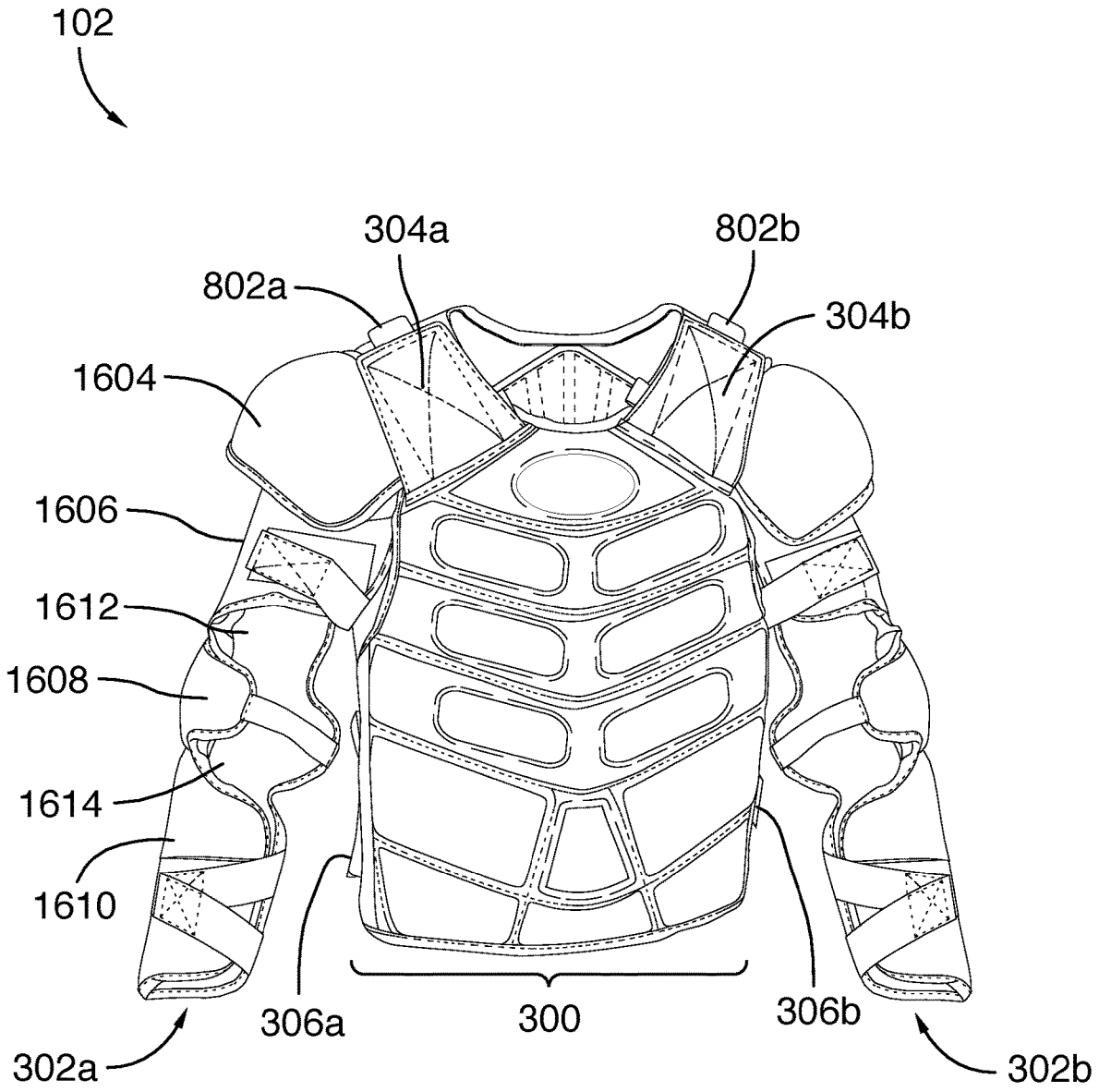
FIG. 3 is a front perspective view of the protective upper body assembly illustrated in FIG. 1.

In one embodiment, as shown in FIGS. 3 to 5, and 12, the vest 300 of the upper body assembly 102 comprises a ventral padding panel 500 (shown in FIG. 5) and a dorsal padding panel 1200 (shown in FIG. 12) connected to the pair of left and right protective sleeves 302*a*, 302*b* (shown in FIGS. 3 and 4), as well as a pair of left and right shoulder fasteners 304*a*, 304*b* (shown in FIG. 3) and a pair of left and right flank fasteners 306*a*, 306*b* (shown in FIG. 3). The ventral padding panel 500 is adapted for protecting, e.g., the chest or thorax, the abdomen, and the left and right shoulders of the wearer, while the dorsal padding panel 1200 is adapted for protecting, e.g., the back, the spine, and left and right shoulders of the wearer. In another embodiment, the left and right shoulder fasteners 304*a*, 304*b* are configured for attaching the ventral padding panel 500 and the dorsal padding panel 1200 generally around the wearer's corresponding left and right shoulders, whereas the pair of left and right flank fasteners 306*a*, 306*b* are configured for attaching the ventral padding panel 500 and the dorsal padding panel 1200 generally around the wearer's corresponding left and right flanks. Taken together, the left and right shoulder fasteners 304*a*, 304*b* and the left and right flank fasteners 306*a*, 306*b* enable the ventral padding panel 500 and the dorsal padding panel 1200 to generally surround the upper part of the wearer's body for protecting same. In other words, the ventral padding panel 500 and the dorsal padding panel 1200 are generally configured with the shoulder fasteners 304*a*, 304*b* and the left and right flank fasteners 306*a*, 306*b* as a protective torso assembly adapted for protecting at least partially the wearer's torso.

Ventral Padding Panel

Figure 4:
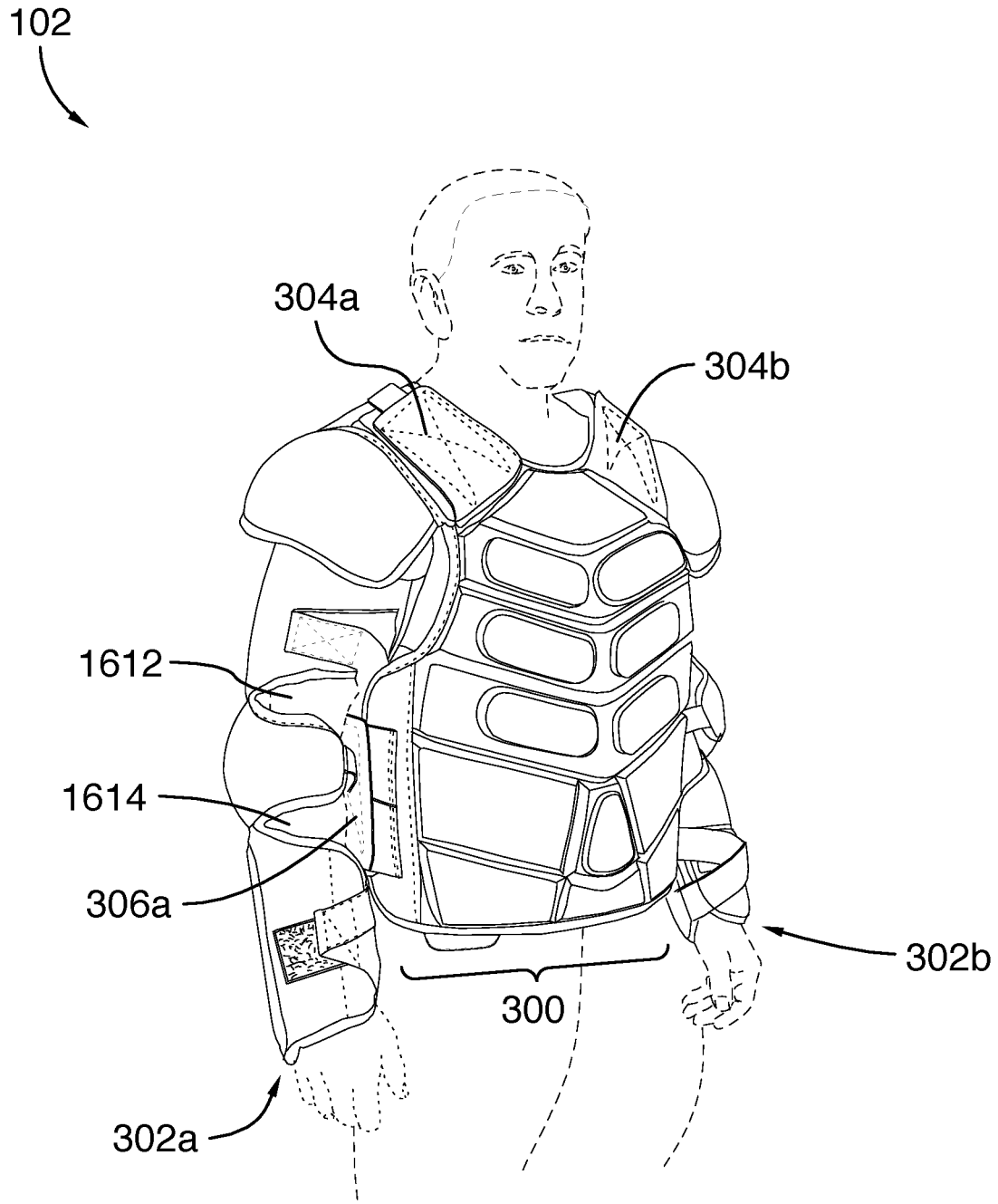
FIG. 4 is a front, right side perspective view of the protective upper body assembly illustrated in FIG. 3, with a ventral padding panel attached thereto.
Figure 5:
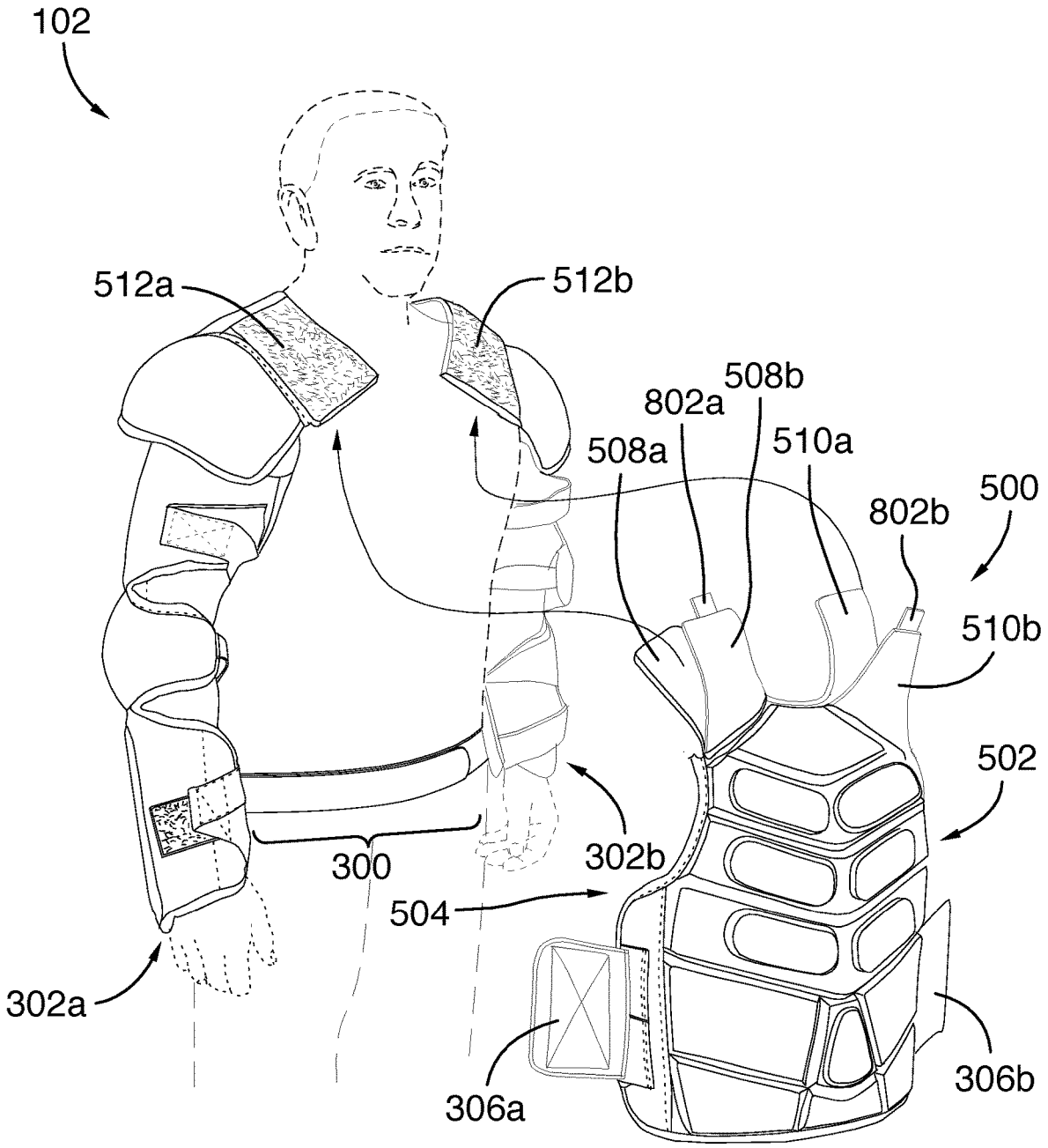
FIG. 5 is a front, right side perspective view of the protective upper body assembly illustrated in FIG. 3, with the ventral padding panel detached therefrom.
Figure 6:
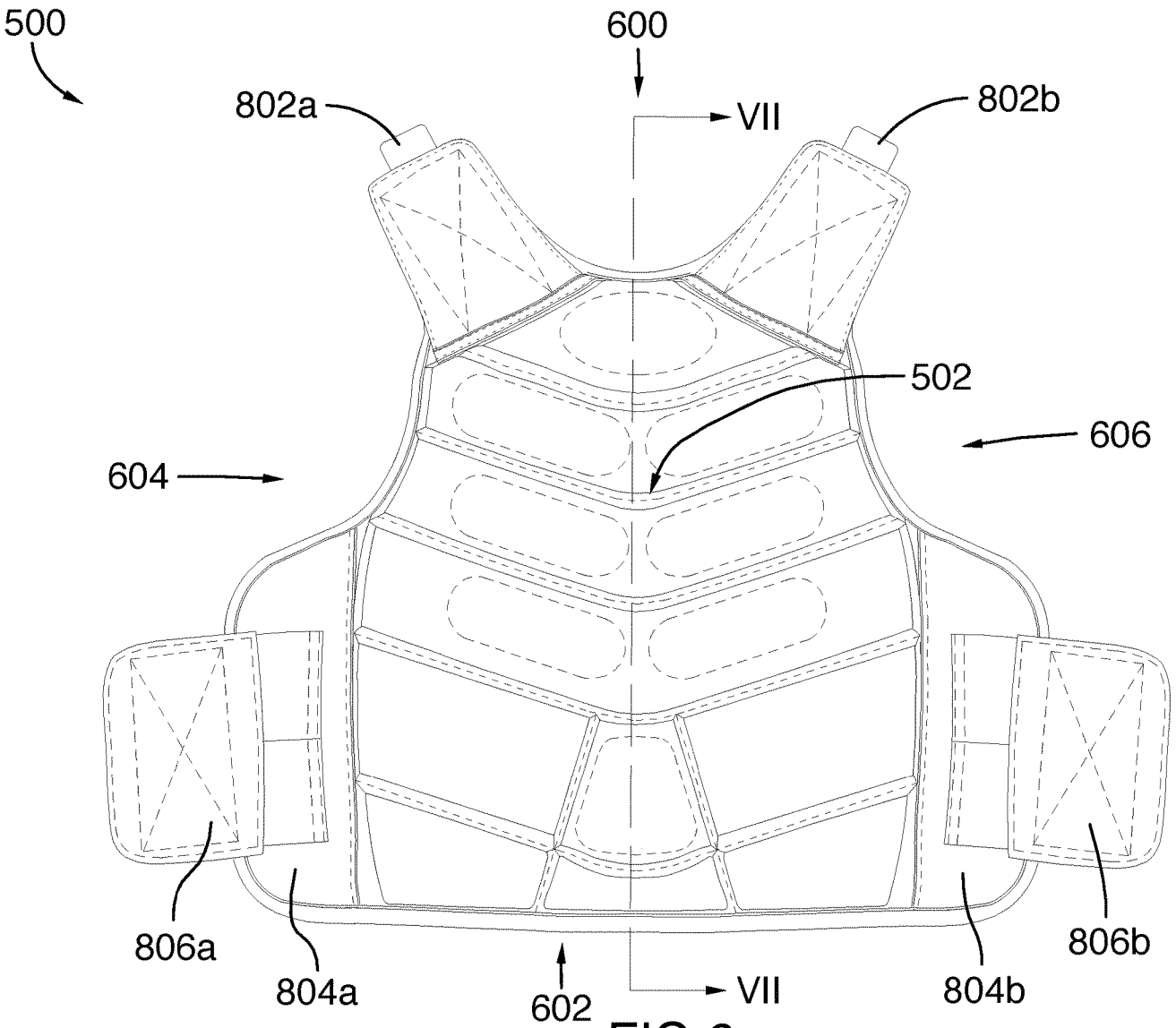
FIG. 6 is a front elevation view of the ventral padding panel illustrated in FIG. 5.

In the embodiment shown in FIG. 5, the ventral padding panel 500 generally defines a detachable breastplate that is shown separately from the vest 300 (for comparison FIG. 4 shows the ventral padding panel 500 attached to the vest 300). As also shown in FIGS. 5 and 6, the ventral padding panel 500 comprises an outer face 502 facing away from the wearer when the vest 300 is worn and an inner face 504 facing towards and contacting the wearer when the vest 300 is worn, as well as a top end 600, a bottom end 602, a left end 604, and a right end 606.

Figure 7:
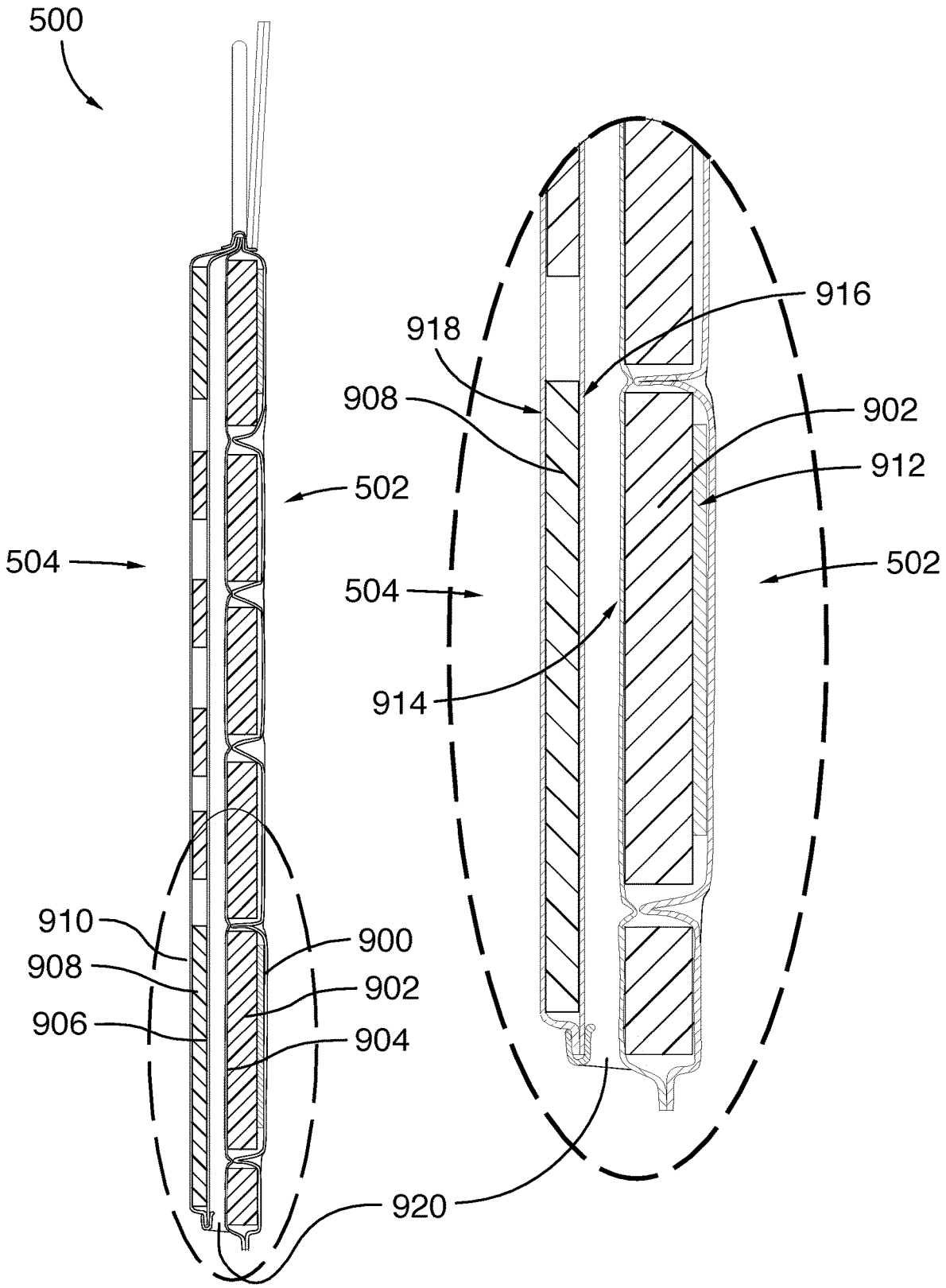
FIG. 7 is a cross-section view of the ventral padding panel illustrated in FIG. 6, taken along the plane VII-VII for better showing the layers construction of the ventral padding panel.

From the outer face 502 to the inner face 504, as shown in the embodiment of FIG. 7, the ventral padding panel 500 comprises a first fabric layer 900 (corresponding to the outer face 502 of ventral padding panel 500), a first foam layer 902, a second fabric layer 904, a third fabric layer 906, a second foam layer 908, and a fourth fabric layer 910 (corresponding to the inner face 504 of the ventral padding panel 500). The first foam layer 902 has an outer face 912 and an inner face 914, as well as a top end 700, a bottom end 702, a left end 704, and a right end 706 (best shown in FIG. 9). Likewise, the second foam layer 908 has an outer face 916 and an inner face 918 (shown in FIG. 7), as well as a top end 1004, a bottom end 1006, a left end 1008, and a right end 1010 (shown in FIG. 10).

Referring to FIG. 7, the first foam layer 902 is sandwiched between the first and second fabric layers 900, 904, whereas the second foam layer 908 is sandwiched between the third and fourth fabric layers 906, 910. In this configuration, the outer face 912 of the first foam layer 902 contacts the first fabric layer 900 and the inner face 914 of the first foam layer 902 contacts the second fabric layer 904, while the outer face 916 of the second foam layer 908 contacts the third fabric layer 906 and the inner face 918 of the second foam layer 908 contacts the fourth fabric layer 910. In one embodiment, the inner face 914 of the first foam layer 902 and the outer face 916 of the second foam layer 908 are substantially flat.

Figure 8:
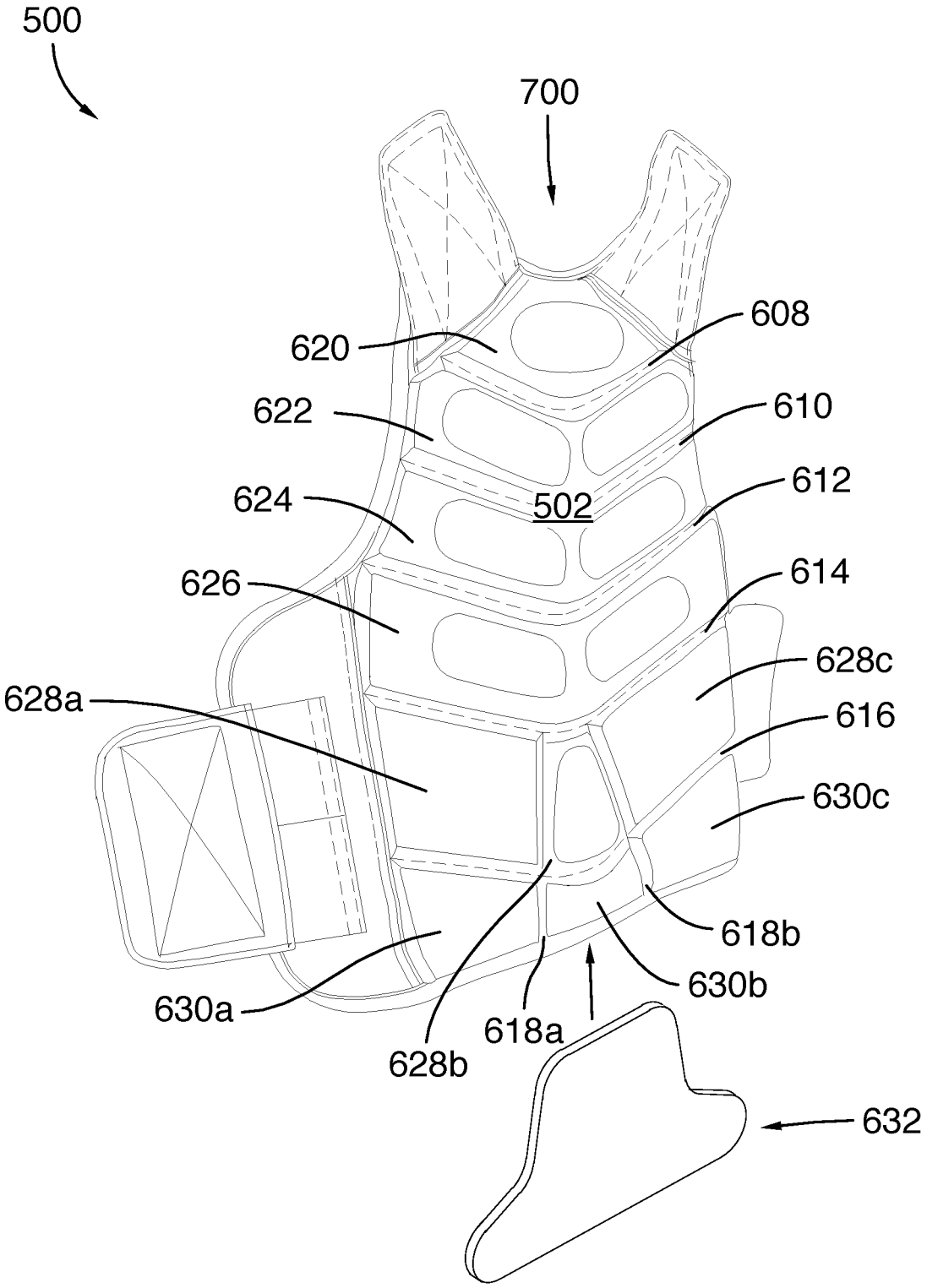
FIG. 8 is a right side perspective view of the ventral padding panel illustrated in FIG. 5, showing the insertion of a ballistic shield inside a pocket the ventral padding panel.
Figure 10:
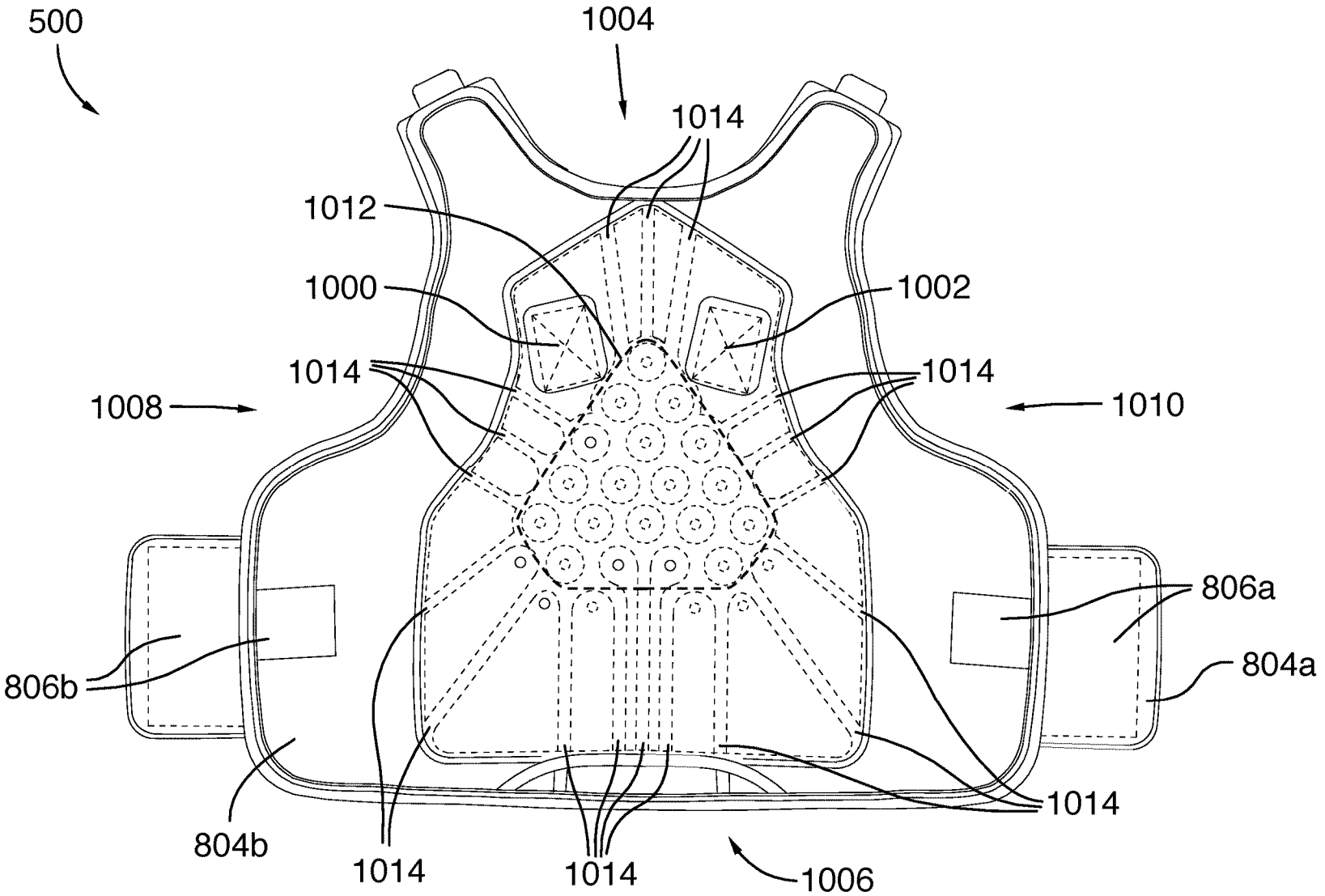
FIG. 10 is a rear elevation view of the ventral padding panel illustrated in FIG. 5.

In one embodiment, and still referring to FIG. 7, the ventral padding panel 500 also comprises a pocket 920, defined between the second and third fabric layers 904, 906 that is adapted to hold one or more ballistic shield(s) or bulletproof plate or trauma plate More particularly, the insertion of a ballistic shield 632 within the pocket 920 of the ventral padding panel 500 is depicted in FIG. 8. The ballistic shield may be made of ballistic-rated fabric comprising strong synthetic fibers, like aromatic polyamide fibers (e.g. like Kevlar™ or Twaron™), ultra-high molecular weight polyolefin (UHMWPO) fibers, ultra-high molecular weight polyethylene (UHMWPE) fibers (e.g. Dyneema™, Spectra™), ultra-high molecular weight polypropylene (UHMWPP) fibers (e.g. Pure™), or any other material offering protection against high kinetic energy projectiles. As depicted in FIG. 10, to hold the ballistic shield within the pocket 920, a pair of fasteners 1000, 1002 is provided on the fabric layer 906 inside the pocket 920. The fasteners 1000, 1002 may be made of hook and loop components, such as Velcro®, or push-button(s) and the like that are configured to engage corresponding fasteners (not shown) of the ballistic shield for fastening and therefore holding the ballistic shield inside the pocket 920. While in the present embodiment the ballistic shield is detachable from the pocket 920. The ballistic shield may alternatively be permanently attached inside the pocket 920.

Figure 9:
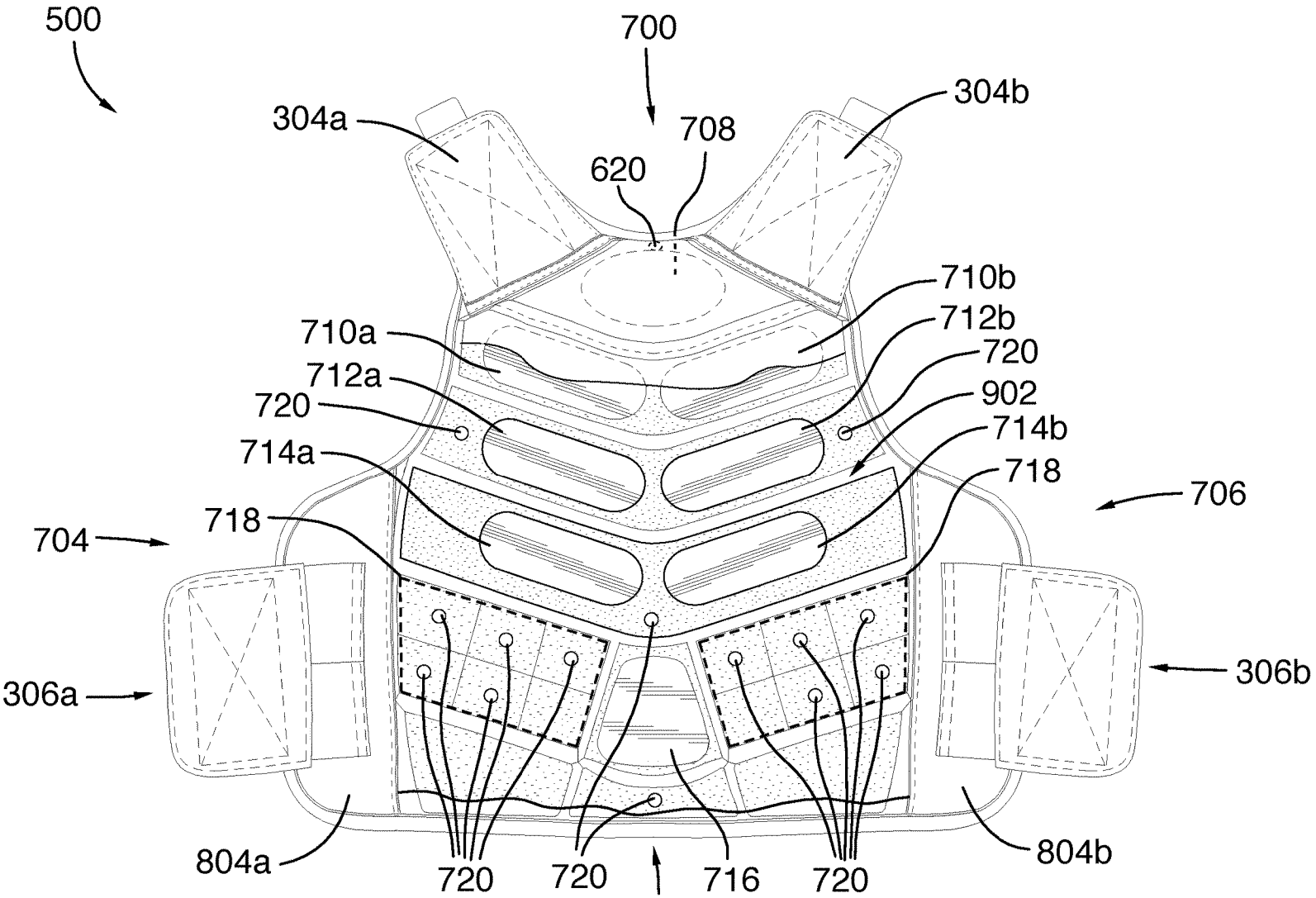
FIG. 9 is a front elevation and cross-section view of the ventral padding panel illustrated in FIG. 5, showing a first foam layer.

As illustrated in FIG. 8, the outer face 502 of the ventral padding panel 500 (which correspond to the outer face 912 of the first foam layer 902) defines a first, second, third, fourth, and fifth generally horizontal V-shaped grooves 608, 610, 612, 614, 616 having their sharp, common segments directed downwardly and extending generally horizontally between the left and right ends 604, 606 of the ventral padding panel 500. As it will be appreciated, the horizontal V-shaped grooves 608, 610, 612, 614, 616 work alone or together as movement-facilitating groove(s) for facilitating movement of the wearer (e.g. to facilitate freedom of movement of the upper body portion of the wearer, including the torso). The outer face 502 of the ventral padding panel 500 also defines a pair of vertical grooves 618*a*, 618*b* extending between the fourth groove 614 and the bottom end 602 of the ventral padding panel, passing through the fifth groove 616. In addition to the grooves 608, 610, 612, 614, 616, 618*a*, 618*b*, the outer face 912 of the first foam layer 902 further includes a plurality of cuts 718, as illustrated in FIG. 9. In one embodiment, the plurality of cuts 718 extends horizontally between the left and right ends 704, 706 of the first foam layer 902 and vertically between the groove 614 and the bottom end 702 of the first foam layer 902, on the corresponding protective sub-sections 628*a*, 628*b*, 628*c* and 630*a*, 630*b*, 630*c*.

With such a configuration, the V-shaped grooves 608, 610, 612, 614, 616, the vertical grooves 618*a*, 618*b*, and the plurality of cuts 718 facilitate freedom of movement to the wearer by working like flex points or flex channels on the outer face 502 for the ventral padding panel 500 to bend as the wearer torso moves or bends itself (e.g. the V-shaped grooves 608, 610, 612, 614, 616 enabling the ventral padding panel 500 to bend vertically, while the vertical grooves 618*a*, 618*b* enabling the bottom end 702 of the ventral padding panel 500 to bend horizontally).

In the embodiment depicted in FIG. 8, the V-shaped grooves 608, 610, 612, 614, 616 and the vertical grooves 618*a*, 618*b* defines together a first diamond-shaped protective section 620 generally defined by the top end 700 of the first foam layer 902 and the first groove 608, a second V-shaped protective section 622 generally defined by the first and second grooves 608, 610, a third V-shaped protective section 624 generally defined by the second and third grooves 610, 612, a fourth V-shaped protective section 626 generally defined by the third and fourth grooves 612, 614, as well as three protective sub-sections 628*a*, 628*b*, 628*c* generally defined by the fourth and fifth grooves 614, 616 and the vertical grooves 618*a*, 618*b*, and three protective sub-sections 630*a*, 630*b*, 630*c* generally defined by the fifth groove 616, the bottom end 702 of the first foam layer 902, and the vertical grooves 618*a*, 618*b*.

Also present between the first fabric layer 900 and the first foam layer 902 of the ventral padding panel 500, as illustrated in FIG. 9, is a first hardened insert 708 located on the first diamond-shaped protective section 620, second and third hardened inserts 710*a*, 710*b* located in the second V-shaped protective section 622, fourth and fifth hardened inserts 712*a*, 712*b* located in the third V-shaped protective section 624, sixth and seventh hardened inserts 714*a*, 714*b* located in the four V-shaped protective section 626, and finally an eighth hardened insert 716 located in the protective sub-section 628*b*. The first hardened insert 708 and the eighth hardened insert 716 are generally centred on the first diamond-shaped protective section 620 and the protective sub-section 628*b*, respectively. The second, fourth and sixth hardened inserts 710*a*, 712*a*, 714*a* are generally located adjacent to the left end 704 of the first foam layer 902, while the third, fifth, and seventh hardened inserts 710*b*, 712*b*, 714*b* are generally located adjacent to the right end 706 of the first foam layer 902. While in the present embodiment the hardened inserts 708, 710*a*, 710*b*, 712*a*, 712*b*, 714*a*, 714*b*, 716 are located on the outer face 912 of the first foam layer 902, it will be appreciated that the hardened inserts 708, 710*a*, 710*b*, 712*a*, 712*b*, 714*a*, 714*b*, 716 may be located anywhere within the construction of the ventral padding panel 500. It will further be appreciated that the hardened inserts 708, 710*a*, 710*b*, 712*a*, 712*b*, 714*a*, 714*b*, 716 are strategically located for providing additional protection to the ventral padding panel 500 by redistributing and reducing the pressure to the wearer's torso caused by an impact (e.g. when the wearer receives a blow).

In the embodiment of FIG. 9, the first foam layer 902 of the ventral padding panel 500 further includes a plurality of ventilation holes 720 where most of the holes are located on the protective sub-sections 628*a*, 628*c*, 630*a*, 630*c* and some other holes are located on the remaining surface of the outer face 912. As it will be appreciated hereinbelow, the plurality of ventilation holes 720 may be configured with the second foam layer 908 of the ventral padding panel 500 for enabling optimum airflow, body temperature control, sweat evacuation, for instance.

As described hereinbefore, the ventral padding panel 500 comprises, in addition to the first foam layer 902, the second foam layer 908 that is sandwiched between the third and fourth fabric layers 906, 910. In one embodiment, the first and second foam layers 902, 908 are generally sized and shaped to superpose or juxtapose each other within the construction of the ventral padding panel 500 when considering the fabric layers 900, 904, 906, 910.

Turning to FIG. 10, the inner face 918 of the second foam layer 908 comprises a plurality of primary grooves defining somewhat of a honeycomb-like configuration 1012, along with a plurality of secondary grooves 1014 projecting therefrom towards the top, bottom, left, and right ends 1004, 1006, 1008, 1010 of the second foam layer 908. As it will be appreciated, the plurality of primary grooves work alone or together as ventilation groove(s) for regulating body temperature of the wearer when the upper body assembly 102 is worn. As further depicted on FIG. 11, the second foam layer 908 may also comprise a plurality of ventilation holes 1100 strategically located to maximize body temperature control. In one embodiment, most of the individual ventilation holes are located at the center of a honeycomb motif of the honeycomb-like configuration 1012, while some other ventilation holes may be located on the remaining area of the inner face 918, for example in the periphery of the area covered by the honeycomb-like configuration 1012 on the second foam layer 908.

In this configuration, the honeycomb-like configuration 1012, the plurality of secondary grooves 1014, and the plurality of ventilation holes 1100 of the second foam layer 908, along with the plurality of ventilation holes 720 of the first foam layer 902, may operate together to enable optimum airflow, body temperature control, sweat evacuation in the presence or absence of the ballistic shield. To this end, the first, second, third, and fourth fabric layers 900, 904, 906, 910 sandwiching the first and second foam layers 902, 908 may be breathable to enable operation of the ventilation holes, as it will become apparent below. Alternatively, any other suitable ventilation means (e.g. air vents) may be present at the aperture of the ventilation holes and the remaining of the fabric could be non-breathable. It will be appreciated that the location of the hardened inserts 708, 710*a*, 712*a*, 714*a*, 710*b*, 712*b*, 714*b*, 716 may also be configured in size, shape, and position for enabling operation of the ventilation holes.

Within the ventral padding panel 500 construction, the foam layers 902, 908 are sized and shaped to conform to the contour of the ventral padding panel 500 and are configured to provide most of the energy or shock-absorbing characteristics of the ventral padding panel 500. The foam layers 902, 908 may also each be made of a single piece extending between any one of the top, bottom, left, and right ends 600, 602, 604, 606 so that to cover partially or totally the outer and inner face 502, 504 ventral padding panel 500. Accordingly, the foam layers 902, 908 may each have different sizes, shapes, and configurations to provide protection to the ventral padding panel 500.

Figure 11:
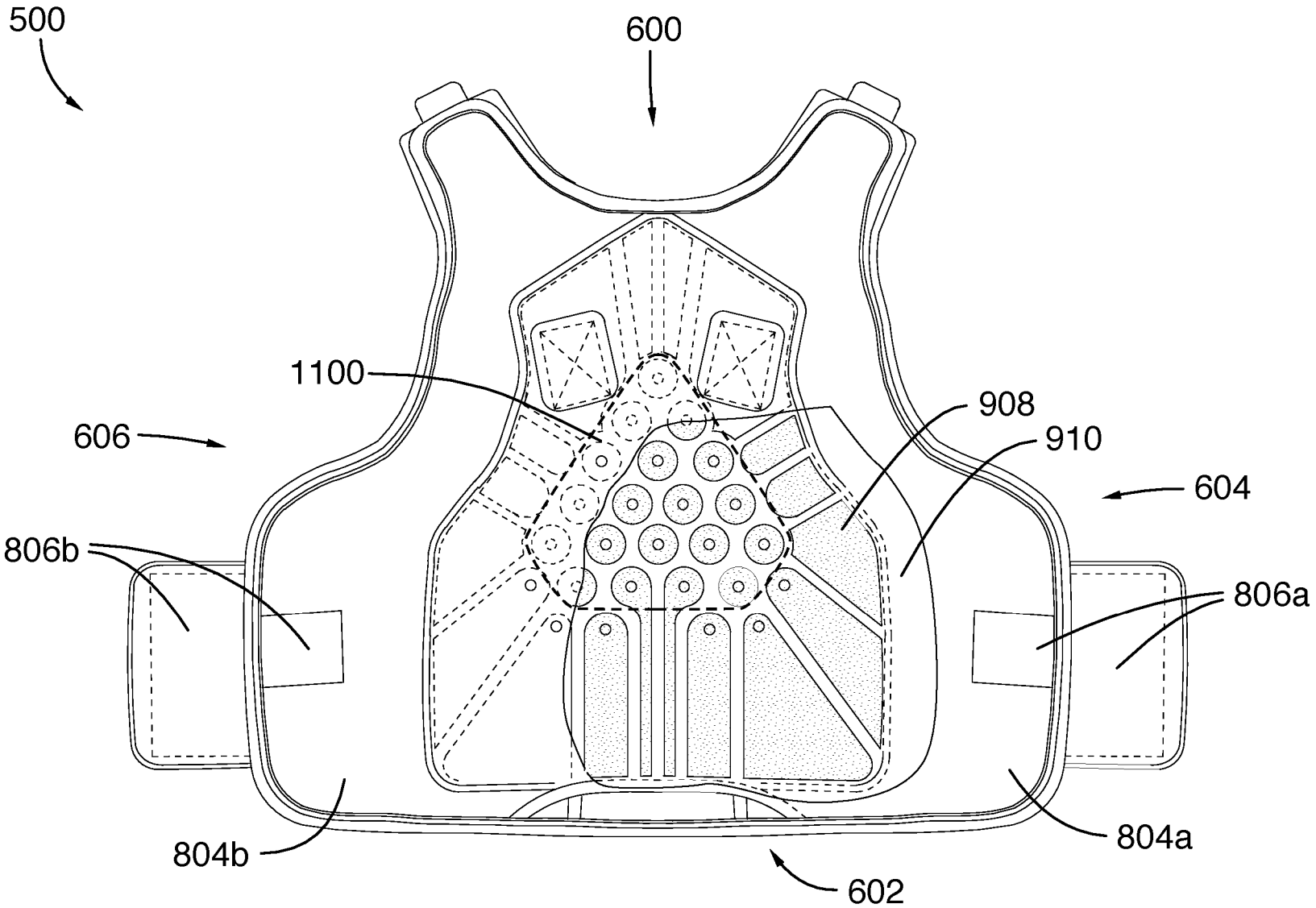
FIG. 11 is a rear elevation and cross-section view of the ventral padding panel illustrated in FIG. 5, showing a second foam layer.

As shown in FIGS. 9 to 11, for example, the ventral padding panel 500 further comprises left and right flaps 804*a*, 804*b*, located on corresponding left and right ends 604, 606 of the ventral padding panel 500, that are adapted for protecting corresponding left and right flanks and under arms area of the wearer. In one embodiment, the left and right flaps 804*a*, 804*b* of the ventral padding panel 500 comprise the superimposed second, third, and fourth fabric layers 904, 906, 910 glued and/or sewed together with the second foam layer 908 sandwiched between the third and fourth layers of fabric 906, 910, providing the left and right flaps 804*a*, 804*b* with a thin foam layer to protect the under arm region generally less susceptible to receive impacts during interventions. Alternatively, the left and right flaps 804*a*, 804*b* comprise the superimposed first, second, third, and fourth fabric layers 900, 904, 906, 910 glued and/or sewed together with the first and/or second foam layers 902, 908 to provide maximum protection to the left and right flaps 804*a*, 804*b* and under arm areas. As it will be appreciated hereinbelow, the left and right flaps 804*a*, 804*b* are further adapted for receiving a corresponding portion of the left and right flank fasteners 306*a*, 306*b*.

Dorsal Padding Panel

Figure 12:
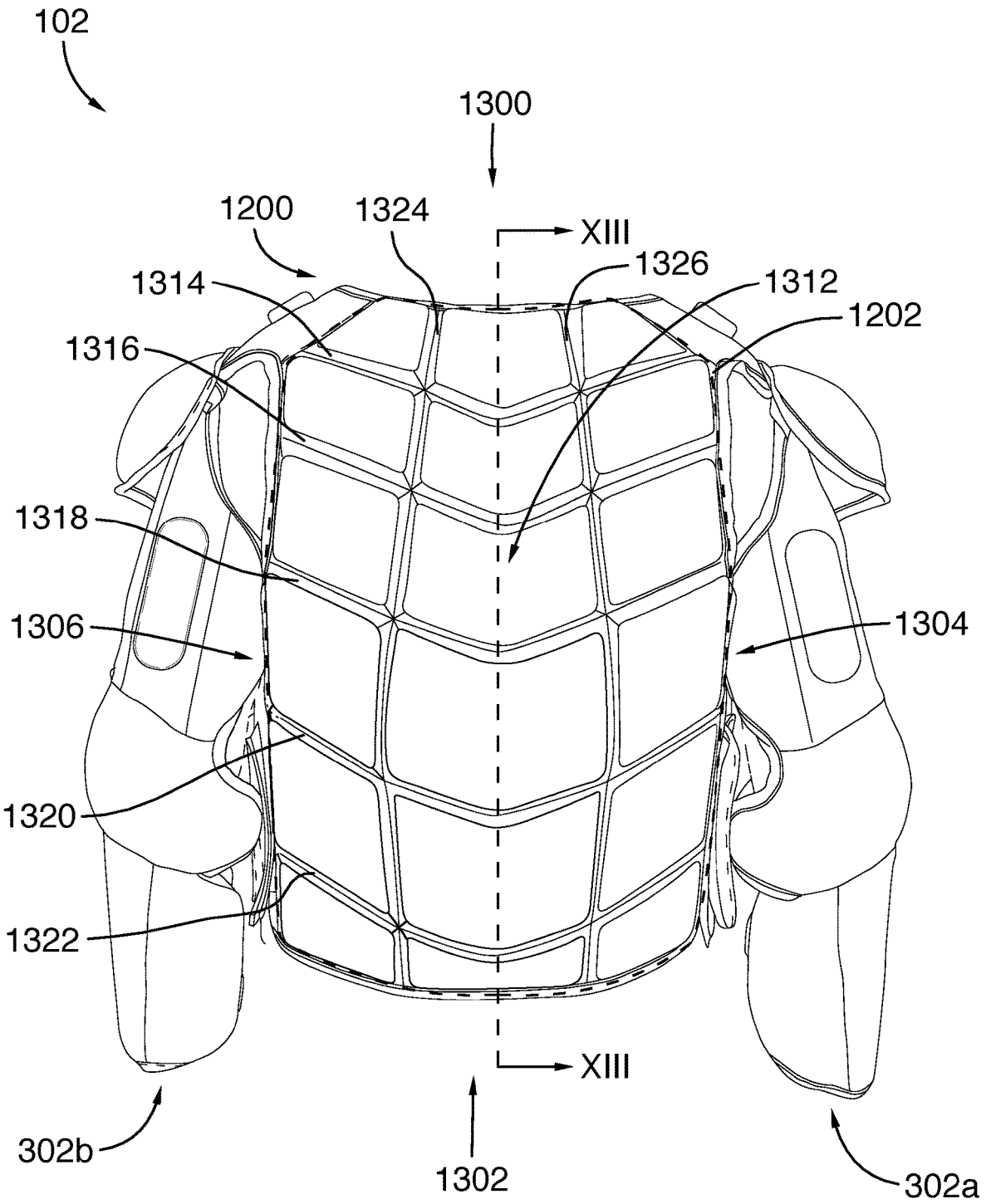
FIG. 12 is a rear perspective view of the protective upper body assembly illustrated in FIG. 3, showing a dorsal padding panel with a pair of left and right protective sleeves.

In one embodiment, as depicted in FIG. 12, the upper body assembly 102 comprises the dorsal padding panel 1200 that is permanently connected to the left and right sleeves 302*a*, 302*b*, as it will be describes in greater details below. The dorsal padding panel 1200 includes a top end 1300, a bottom end 1302, a left end 1304, and a right end 1306 (shown in FIG. 12), as well as an outer face 1312 facing away from the wearer when the upper body assembly 102 is worn (shown in FIGS. 12 and 17) and an inner face 1400 facing towards and contacting the wearer when the vest 300 is worn (shown in FIGS. 15 and 16).

Figure 13:
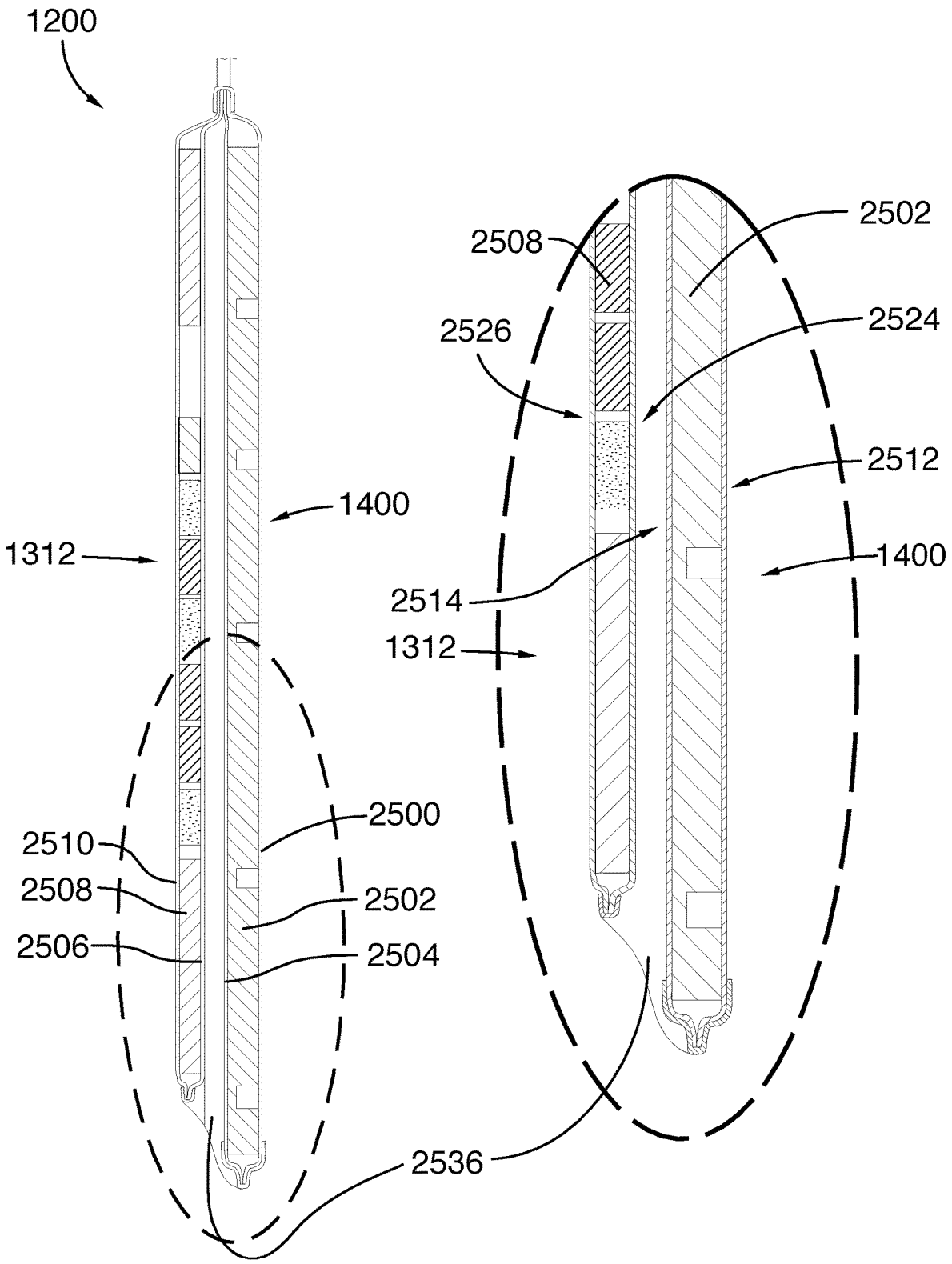
FIG. 13 is a cross-section view of the dorsal padding panel illustrated in FIG. 12, taken along the plane XIII-XIII of FIG. 12; showing the layers construction of the dorsal padding panel.

From the outer face 1312 to the inner face 1400, as shown in the embodiment of FIG. 13, the dorsal padding panel 1200 comprises a first fabric layer 2500 (corresponding to the outer face 1312 of dorsal padding panel 1200), a first foam layer 2502, a second fabric layer 2504, a third fabric layer 2506, a second foam layer 2508, and a fourth fabric layer 2510 (corresponding to the inner face 1400 of the dorsal padding panel 1200). The first foam layer 2502 has an outer face 2512 and an inner face 2514 (shown in FIG. 13), as well as a top end 2516, a bottom end 2518, a left end 2520, and a right end 2522 (shown in FIG. 14). Likewise, the second foam layer 2508 has an outer face 2524 and an inner face 2526 (shown in FIG. 13), as well as a top end 2528, a bottom end 2530, a left end 2532, and a right end 2534 (shown in FIG. 16).

In the embodiment of FIG. 13, the first foam layer 2502 is sandwiched between the first and second fabric layers 2500, 2504, whereas the second foam layer 2508 is sandwiched between the third and fourth fabric layers 2506, 2510. In this configuration, the outer face 1312 of the first foam layer 2502 contacts the first fabric layer 2500 and the inner face 1400 of the first foam layer 2502 contacts the second fabric layer 2504, while the outer face 2524 of the second foam layer 2508 contacts the third fabric layer 2506 and the inner face 2526 of the second foam layer 2508 contacts the fourth fabric layer 2510. In one embodiment, the inner face 2514 of the first foam layer 2502 and the outer face 2524 of the second foam layer 2508 are substantially flat. Alternatively, the inner face 2514 of the first foam layer 2502 and the outer face 2524 of the second foam layer 2508 independently comprise one or more pattern(s) defining one or multiple relief surfaces. Therefore, it will be appreciated that the general construction and assembling of the dorsal padding panel 1200 is essentially similar to the general construction and assembling of the ventral padding panel 500.

Figure 16:
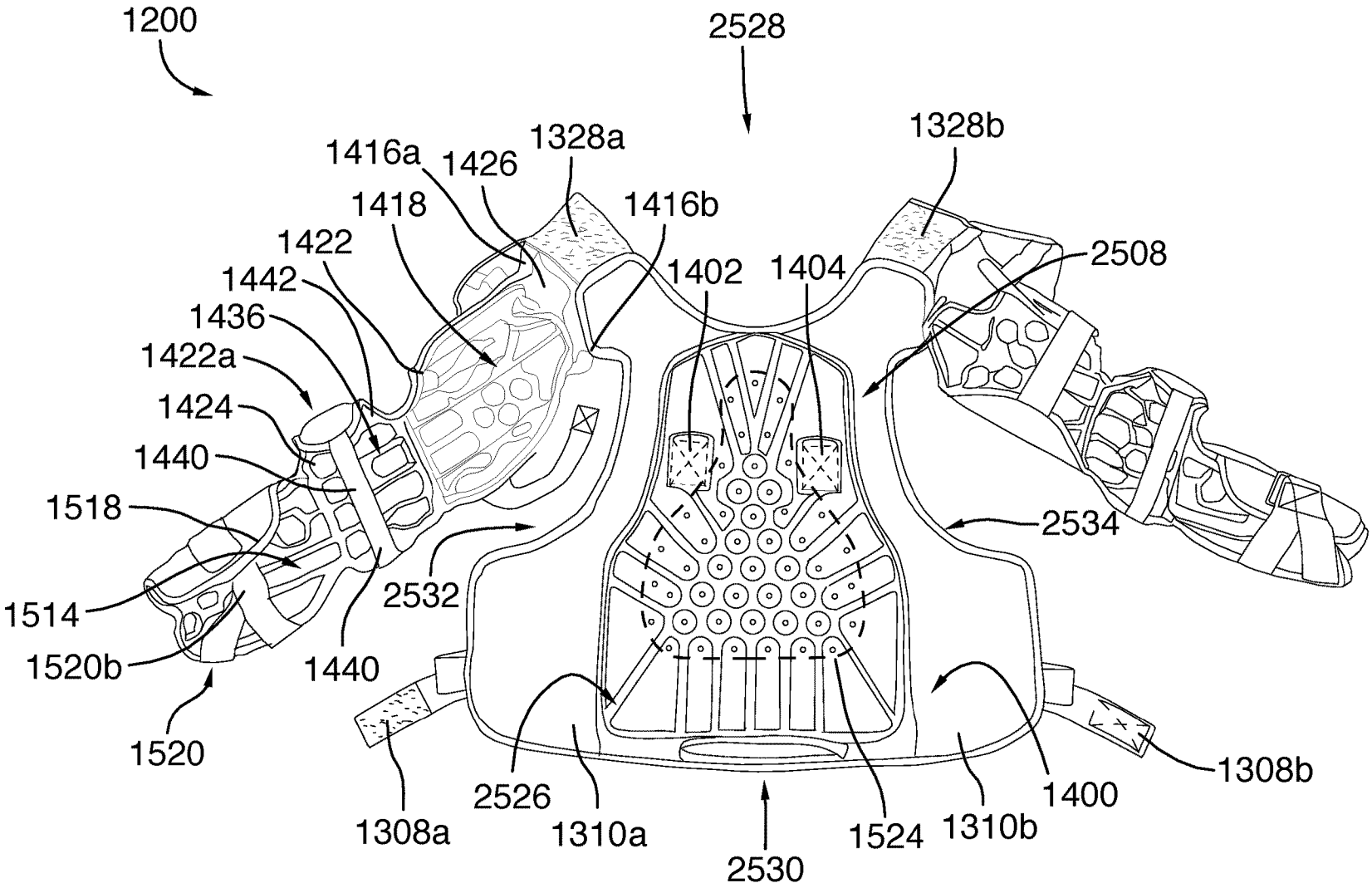
FIG. 16 is a front perspective view of the dorsal padding panel illustrated in FIG. 12, showing inner faces of the left and right shoulder fasteners.

As also shown in FIG. 13, the dorsal padding panel 1200 also comprises a pocket 2536, generally similar to the pocket 920 of the ventral padding panel 500, defined between the second and third fabric layers 2504, 2506 that is adapted to hold one or more ballistic shield(s) or bulletproof plate or trauma plate (not shown). The ballistic shield may be made of ballistic-rated fabric comprising strong synthetic fibers, like aromatic polyamide fibers (e.g. like Kevlar™ or Twaron™), ultra-high molecular weight polyolefin (UHMWPO) fibers, ultra-high molecular weight polyethylene (UHMWPE) fibers (e.g. Dyneema™ Spectra™), ultra-high molecular weight polypropylene (UHMWPP) fibers (e.g. Pure™), or any other material offering protection against high kinetic energy projectiles. As illustrated in FIG. 16, to hold the ballistic shield within the pocket 2536, a pair of fasteners 1402, 1404 is provided on the fabric layer 2506 inside the pocket 2536. The fasteners 1402, 1404 may be made of hook and loop components, such as Velcro®, or push-button(s), and the like that are configured to engage corresponding fasteners (not shown) of the ballistic shield for fastening and therefore holding the ballistic shield inside the pocket 2536. While in the present embodiment the ballistic shield is detachable from the pocket 2536. The ballistic shield may alternatively may be permanently attached inside the pocket 2536.

The outer face 1312 of the dorsal padding panel 1200 (which correspond to the outer face 2512 of the first foam layer 2502) also defines a first, second, third, fourth, and fifth generally horizontal V-shaped grooves 1314, 1316, 1318, 1320, 1322 having their sharp, common segments directed downwardly and extending horizontally between the left and right ends 1304, 1306 of the dorsal padding panel 1200, as it may be apparent in FIG. 12. As it will be appreciated, the horizontal V-shaped grooves 1314, 1316, 1318, 1320, 1322 work alone or together as movement-facilitating groove(s) for facilitating movement of the wearer (e.g. to facilitate freedom of movement of the upper body portion of the wearer, including the torso). The outer face 1312 of the dorsal padding panel 1200 also defines a pair of vertical grooves 1324, 1326 extending vertically between the top and bottom ends 1300, 1302 of the dorsal padding panel 1200. Each of the vertical grooves 1324, 1326 cross-section the horizontal grooves 1314, 1316, 1318, 1320, 1322 to define a plurality of trapezoid-like protective sections 1202 extending horizontally between the left and right ends 1304, 1306 and vertically between the top and bottom ends 1300 and 1302 of the dorsal padding panel 1200.

Figure 14:
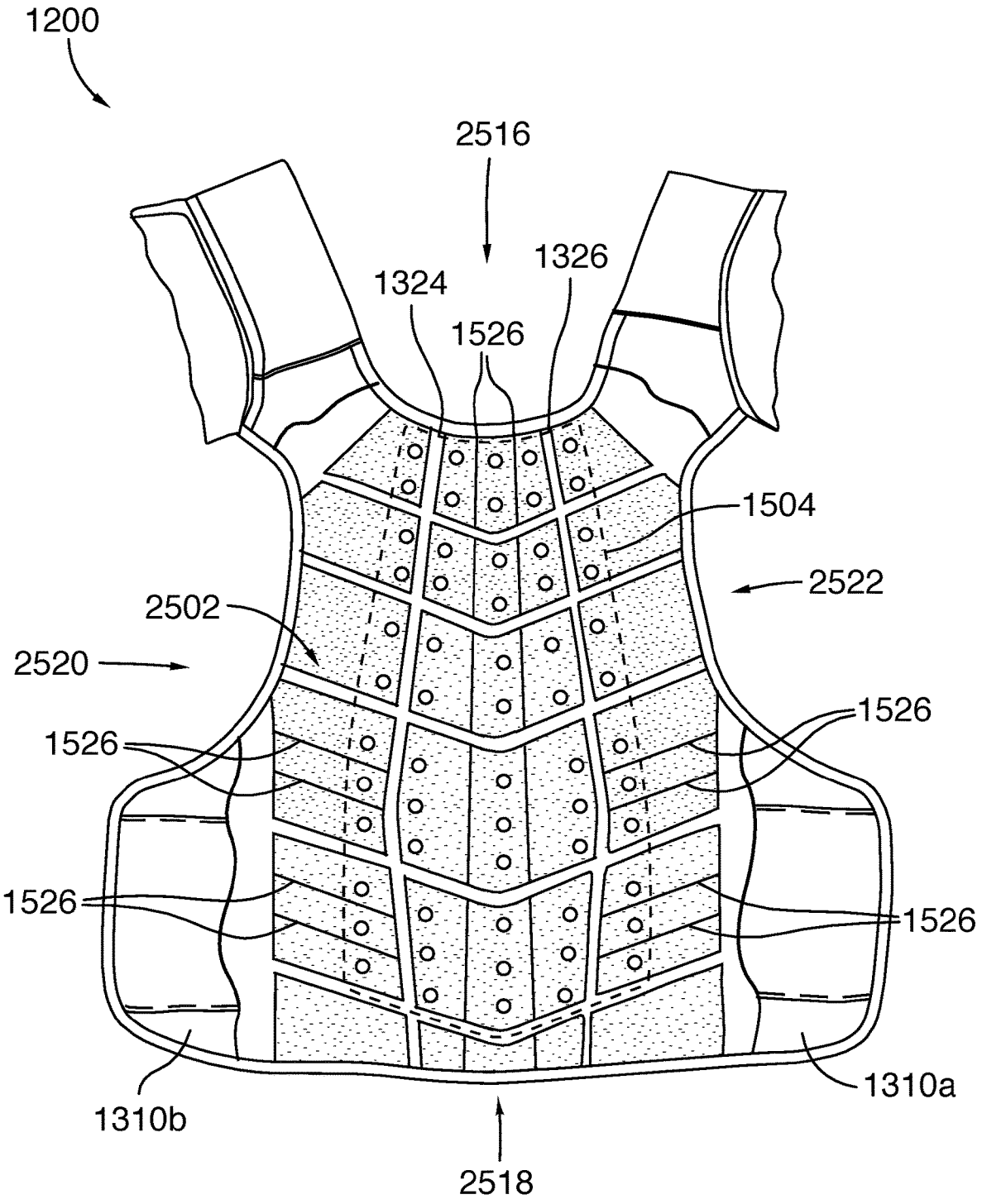
FIG. 14 is a partial front elevation and cross-section view of the dorsal padding panel illustrated in FIG. 12, showing a first foam layer.

Along with the grooves 1314, 1316, 1318, 1320, 1322, 1324, 1326, the outer face 2512 of the first foam layer 2502 further includes a plurality of cuts 1526, as it is apparent in FIG. 14. In one embodiment, the plurality of cuts 1526 extends horizontally between the left and right ends 2520, 2522 of the first foam layer 2502 and vertically between the top and bottom ends 2516, 2518 of the first foam layer 2502, on the corresponding plurality of trapezoid-like protective sections 1202. With such a configuration, the V-shaped grooves 1314, 1316, 1318, 1320, 1322, the vertical grooves 1324, 1326, and the plurality of cuts 1526 facilitate freedom of movement to the wearer by working like flex points or flex channels on the outer face 1312 for the dorsal padding panel 1200 to bend as the wearer torso moves or bends itself (e.g. the V-shaped grooves 1314, 1316, 1318, 1320, 1322 enabling the dorsal padding panel 1200 to bend vertically, while the vertical grooves 1324, 1326 enabling the bottom end 1302 of the dorsal padding panel 1200 to bend horizontally).

In one embodiment, as shown in FIG. 14, the first foam layer 2502 of the dorsal padding panel 1200 further includes a plurality of ventilation holes 1504 where most of the holes are disposed vertically in five lines generally parallel along the vertical grooves 1324, 1326. As it will be appreciated, the plurality of ventilation holes 1504 of the first foam layer 2502 may be configured with a plurality of ventilation holes 1524 on the second foam layer 2508 of the dorsal padding panel 1200 for enabling optimum airflow, body temperature control, sweat evacuation, for instance.

As described hereinbefore, the dorsal padding panel 1200 comprises, in addition to the first foam layer 2502, the second foam layer 2508 that is sandwiched between the third and fourth fabric layers 2506, 2510. In one embodiment, the first and second foam layers 2502, 2508 are generally sized and shaped to superpose or juxtapose each other within the construction of the dorsal padding panel 1200 when considering the fabric layers 2500, 2504, 2506, 2510.

Figure 15:
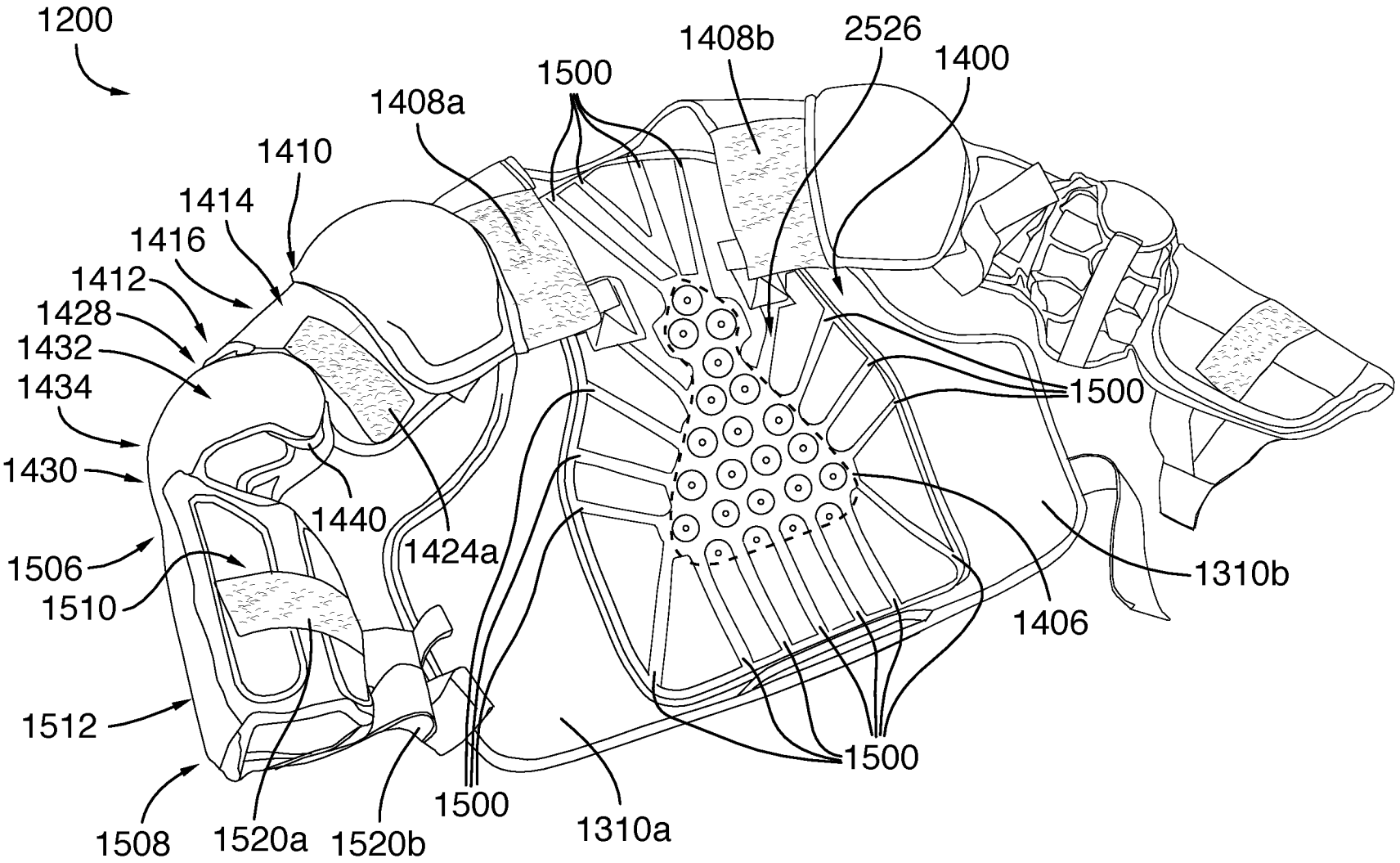
FIG. 15 is a front, right side perspective view of the dorsal padding panel illustrated in FIG. 12, showing outer faces of a left and right shoulder fasteners.

Turning to FIG. 15, the inner face 2526 of the second foam layer 2508 of the dorsal padding panel 1200 comprises a plurality of primary grooves defining somewhat of a honeycomb-like configuration 1406 along with a plurality of secondary grooves 1500 projecting therefrom towards the top, bottom, left, and right ends 2528, 2530, 2532, 2534 of the second foam layer 2508. As further illustrated in FIG. 16, the second foam layer 2508 of the dorsal padding panel 1200 further comprises a plurality of ventilation holes 1524 that is strategically located to maximize body temperature control. In one embodiment, most of the individual ventilation holes of the plurality of ventilation holes 1524 are located at the center of a honeycomb motif of the honeycomb-like configuration 1406; alternatively, some other ventilation holes may be located on the remaining area of the inner face 2526, for example, in the periphery of the honeycomb-like configuration 1406.

In this configuration, the honeycomb-like configuration 1406, the plurality of secondary grooves 1500, and the plurality of ventilation holes 1524 of the second foam layer 2508 of the dorsal padding panel 1200, along with the plurality of ventilation holes 1504 of the first foam layer 2502 operate together to enable optimum airflow, body temperature control, sweat evacuation in the presence or absence of the ballistic shield. To this end, the first, second, third, and fourth fabric layers 2500, 2504, 2506, 2510 sandwiching the first and second foam layers 2502, 2508 may be breathable to enable operation of the ventilation holes. Alternatively, any other suitable ventilation means (e.g. air vents) may be present at the aperture of the ventilation holes and the remaining of the fabric could be non-breathable.

Within the dorsal padding panel 1200 construction, the foam layers 2502, 2508 are sized and shaped to conform to the contour of the dorsal padding panel 1200 and are configured to provide most of the energy or shock-absorbing characteristics of the dorsal padding panel 1200. The foam layers 2502, 2508 may also each be made of a single piece extending between any one of the top, bottom, left, and right ends 1300, 1302, 1304, 1306 so that to cover partially or totally the outer and inner face 1312, 1400 dorsal padding panel 1200. Accordingly, the foam layers 2502, 2508 may each have different sizes, shapes, and configurations to provide protection to the dorsal padding panel 1200.

Figure 17:
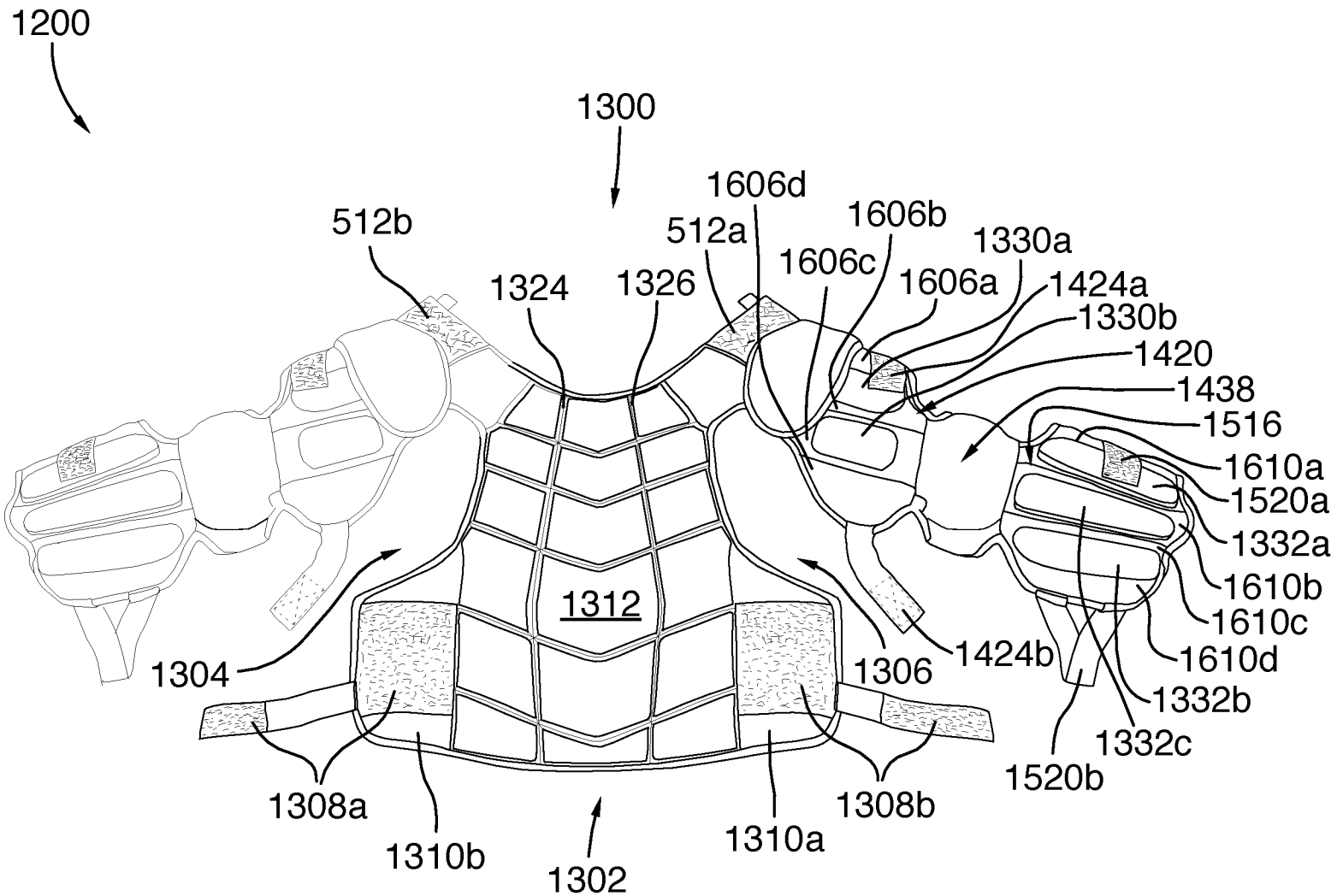
FIG. 17 is a rear perspective view of the dorsal padding panel illustrated in FIG. 12.

As shown in FIGS. 16 and 17, for example, the dorsal padding panel 1200 further comprises left and right flaps 1310*a*, 1310*b*, located on corresponding left and right ends 1304, 1306 of the dorsal padding panel 1200, that are adapted for protecting corresponding left and right flanks and under arms area of the wearer. In one embodiment, the left and right flaps 1310*a*, 1310*b* of the dorsal padding panel 1200 comprise the superimposed second, third, and fourth fabric layers 2502, 2506, 2510 glued and/or sewed together with the second foam layer 2508 sandwiched between the third and fourth layers of fabric 2506, 2510, providing the left and right flaps 1310*a*, 1310*b* with a thin foam layer to protect the under arm region generally less susceptible to receive impacts during interventions. Alternatively, the left and right flaps 1310*a*, 1310*b* comprise the superimposed first, second, third, and fourth fabric layers 2500, 2502, 2506, 2510 glued and/or sewed together with the first and/or second foam layers 2502, 2508 to provide maximum protection to the left and right flaps 1310*a*, 1310*b* and under arm areas. As it will be appreciated hereinbelow, the left and right flaps 1310*a*, 1310*b* are further adapted for receiving a corresponding portion of the left and right flank fasteners 306*a*, 306*b*.

In an alternative embodiment, the dorsal padding panel 1200 includes at least one hardened insert located anywhere within the layer construction of the dorsal padding panel 1200, for example, the at least one hardened insert may be located between the first foam layer 2502 and the first fabric layer 2500. In another alternative embodiment, the at least one hardened insert(s) is strategically located for providing additional protection to the dorsal padding panel 1200 by redistributing and reducing the pressure to the wearer's torso caused by an impact (e.g. when the wearer receives a blow). In still another alternative embodiment, the at least one hardened insert may also be configured in size, shape, and positioning for enabling operation of the ventilation holes, when such ventilation holes are present in the dorsal padding panel 1200.

Assembly and Construction of the Ventral and Dorsal Padding Panels

Since the ventral padding panel 500 and the dorsal padding panel 1200 generally follow the same manufacturing process, only the assembly and construction of the ventral padding panel 500 will be described. It will be appreciated that a similar description also applies to the dorsal padding panel 1200 with proper adaptation.

In one embodiment, the first and second foam layers 902, 908 of the ventral padding panel 500 are made of foam comprising XAP-500, XAP-250-H, and/or any other foam material known in the art to have characteristics, including foam density, adapted for providing protection properties to wearable protective equipment and the like. While foam material is used in the present embodiment, it will be appreciated that any resiliently compressible material may be used for manufacturing any of the ventral padding panel 500 and dorsal padding panel 1200. In this case, the foam layers 902, 908 are manufactured by cutting a foam blank from a sheet of foam and then defining the grooves, cuts and ventilation holes using for example a CNC machine. As such, it is possible to manufacture one-piece foam layers covering the entirety of the ventral padding panel 500 that provide flexibility and/or articulation to the desired area(s) thereof, facilitating the manufacture and assembly. Given that, it will be appreciated that the dimension of the various components of the suit, including the foam and fabric layers 900, 902, 904, 906, 908, 910, may be adapted to the wearer's size and that the position of the grooves and cuts may also be adapted to provide maximum flexibility for a given size.

In one embodiment, to assemble the ventral padding panel 500, the first fabric layer 900 is in a first step cut according to the desired specifications, including the wearer's size. The first foam layer 902, which is precut with the corresponding grooves, cuts, and ventilation holes predefined therein, has glue applied to its outer face 912 prior to positioning same on the inner face 914 of the first fabric layer 900. The assembling of the fourth fabric layer 910 to the second foam layer 908 follow the same process as for the first fabric layer 900 and the first foam layer 902. As it will be appreciated, the presence of glue facilitate the permanent positioning to the foam layer relative to the fabric layer, facilitating further manufacturing steps.

In another step, the second and third fabric layers 904, 906 are assembled together to define the pocket 920 for holding the ballistic shield. In this embodiment, the second and third fabric layers 904, 906 are cut to the appropriate size and positioned relatively to one another, the inner face of the second fabric layer 904 being adjacent to the outer face of the third fabric layer 906. The second and third fabric layers 904, 906 are then assembled together by sewing same in appropriate locations.

Once the second and third fabric layers 904, 906 are assembled together, they are positioned onto the first foam layer 902 assembled with the first fabric layer 900. More specifically, the outer face of the second fabric layer 904 is positioned adjacent to the inner face 914 of the first foam layer 902, the inner face of the third fabric layer is positioned adjacent to the outer face 916 of the second foam layer 908, and the respective layers of fabric and foam are aligned appropriately. In one embodiment, glue is applied to the outer face 916 of the second foam layer 908 so as to increase contact between the fabric and foam layers, facilitating further manufacturing steps.

When all the fabric and foam layers are properly positioned, they are assembled together by sewing. In one embodiment, sewing lines are drawn in the periphery of the fabric second, third, and fourth fabric layers 904, 906, 910, which are of a larger dimension than the first and second foam layers 902, 908. In another embodiment, sewing lines are also drawn in a location corresponding to the V-shaped grooves 608, 610, 612, 614, 616 and the vertical grooves 618*a*, 618*b*. As such, the sewing lines may define the protective sub-sections 620, 622, 624, 626, 628*a*, 628*b*, 628*c*, 630*a*, 630*b*, and 630*c* of the ventral padding panel 500.

In one embodiment, any one of the fabric layers 900, 904, 906, 910 of the ventral padding panel 500 is made of polyester spandex (e.g. R5856W polyester spandex), ballistic nylon (e.g. M3568 ballistic nylon (1680 denier)), and/or polyester (e.g. R3612 polyester). Alternatively, the fabric layers 900, 904, 906, 910 may be made of any other fabric material known in the art to have characteristics, including abrasive resistance, ballistic properties, and puncture resistance, adapted for providing protection properties to wearable protective equipment and the like. In one particular embodiment, the fabric layer 900 (which is the outer layer) is made of polyester spandex (e.g. R5856W polyester spandex) to provide abrasive resistance to the ventral padding panel 500, the fabric layers 904, 906 (which are the middle layers) are made of ballistic nylon (e.g. M3568 nylon (1680 denier)), and the fabric layer 910 (which is the inner layer) is made of polyester (e.g. R3612 polyester). As it will be appreciated, the use of abrasion-resistant material may prove advantageous to extend the lifetime of the garment, which is often exposed to wear and tear, whether because of the impacts it is subject to during riots or other types of law enforcement interventions, or because of its storage and/or transport conditions.

In another embodiment, any one of the fabric layers 900, 904, 906, 910 of the ventral padding panel 500 is capable of enabling the passage of fluids, like liquids and gases, through said fabric layers. Therefore the material of any one of the fabric layers 900, 904, 908, 910 may operate in collaboration with the plurality of ventilation holes 720, 1100, 1504, 1524 for enabling optimum airflow, body temperature control, and sweat evacuation of the wearer, for instance.

In yet another embodiment, the hardened inserts 708, 710*a*, 710*b*, 712*a*, 712*b*, 714*a*, 714*b*, 716 of the ventral padding panel 500 are made of high-density polyethylene (HDPE or polyethylene high-density (PEHD)), carbon fibers, and/or any other material, including polymer and/or metal material, known in the art to have characteristics adapted for providing protection properties to wearable protective equipment and the like.

Taken separately or as a whole, the fabric and foam layers 900, 902, 904, 906, 908, 910, hardened inserts 708, 710*a*, 710*b*, 712*a*, 712*b*, 714*a*, 714*b*, 716 (when applicable), and ballistic shield 632 (or any other shield or corresponding inserts) used in the assembling of the vest 300 are configured to confer strength, abrasive resistance, anti-perforation (e.g. anti-stab), and ballistic properties to the ventral and dorsal padding panels 500, 1200, for instance. On the other hand, the foam layers 902, 908, hardened inserts 708, 710*a*, 710*b*, 712*a*, 712*b*, 714*a*, 714*b*, 716, and ballistic shield 632 are conjointly or independently configured in size, shape, and location (e.g. the foam density, thickness, motif, and configuration may vary depending on the location) to provide most of the energy-absorbing characteristic of the vest 300 in order to protect the wearer from shocks, collisions or any other injury-causing or life-threatening aggression, for instance. All together, the different components of the vest 300, including but not limited to the foam and fabric layers 900, 902, 904, 906, 908, 910, hardened inserts 708, 710*a*, 710*b*, 712*a*, 712*b*, 714*a*, 714*b*, 716, and ballistic shield 632, are configured to optimize protection, freedom of movement, as well as air exchange and circulation with the outside environment (e.g. to facilitate body temperature control and sweat evacuation of the wearer).

Left and Right Protective Sleeves

In one embodiment, referring back to FIG. 3, the upper body assembly 102 comprises a pair of left and right protective sleeves 302*a*, 302*b* permanently connected to the vest 300 to form a jacket-like garment. The left and right protective sleeves 302*a*, 302*b* are adapted for protecting the wearer's upper limbs, including the shoulders, upper arms, elbows, forearms, and part of the wrists. The protective left and right sleeves 302*a*, 302*b* being mirror images of one another, only the left protective sleeve 302*a* will be described. It will be appreciated that a similar description also applies to the right protective sleeve 302*b* with proper adaptation.

The left protective sleeve 302*a* comprises, moving from the top (i.e. from the wearer's left shoulder) to the bottom (i.e. adjacent to the wearer's left wrist), a left shoulder shell 1604, a left upper arm portion 1606, a left elbow shell 1608, and a left forearm portion 1610, as shown in FIG. 3.

Shoulder Shells

Still referring back to FIG. 3, at the junction between the vest 300 and the corresponding left protective sleeve 302*a*, the left shoulder shell 1604 generally defines a hemisphere-like shape adapted for siting on the wearer's left shoulder, for protecting same. At this location, the left shoulder shell 1604 extends between the ventral padding panel 500 and the dorsal padding panel 1200 so as to cover a substantial portion of the left upper arm portion 1606. In one embodiment, the left shoulder shell 1604 may be pivotally attached to vest 300 by sewing and may also be configured to enable freedom movement as the left shoulder shell 1604 may pivot when the wearer's arm is moved or raised in the air, for instance. More particularly, as it will be appreciated hereinbelow, the left shoulder shell 1604 is pivotally connected to a corresponding portion of a left shoulder fastener 512*a*.

In one embodiment, the left shoulder shell 1604 of the left sleeve 302*a* is made of an outer hardened cap molded from any hardened material (e.g. polymers, plastics, high-density polyethylene (HDPE or polyethylene high-density (PEHD)), carbon fibers, fiberglass, and the likes) and of an inner foam layer together sandwiched between an outer and inner fabric layers by sewing and/or gluing the various layer(s) together. Therefore, it will be understood that the left shoulder shell 1604 may generally be assembled and built as the ventral and dorsal padding panels 500, 1200, as disclosed hereinbefore.

Upper Arm Portions

Still referring to FIG. 3, the left upper arm portion 1606 of the upper body assembly 102 generally defines an elongated C-shaped structure adapted for receiving and protecting at least partially the wearer's left upper arm when the left sleeve 302*a* is worn. With reference to FIGS. 15 to 17, the left upper arm portion 1606 comprises a top end 1410, a bottom end 1412, a front end 1414, and a rear end 1416 (shown in FIG. 15), as well as, an inner face 1418 and an outer face 1420 (shown in FIGS. 16 and 17).

In one embodiment, the left upper arm portion 1606 comprises a foam layer sandwiched between an inner and outer fabric layers wherein, as it may be seen on the inner face 1418 of the left upper arm portion 1606 (best shown in FIG. 16), the foam layer defines somewhat of a honeycomb-like configuration 1422 with ventilation holes operating together to enable optimum airflow, body temperature control, sweat evacuation of the wearer. With respect to FIG. 17, defined on the outer face 1420 of the left upper arm portion 1606, running from the front end 1414 to the rear end 1416 and extending between the top and bottom ends 1410, 1412 thereof, the left upper arm portion 1606 also includes first, second, third, and fourth protective sections 1606*a*, 1606*b*, 1606*c*, 1606*d*.

In another embodiment, the outer face 1420 of the left upper arm portion 1606 further comprises, on the corresponding second and third protective sections 1606*b*, 1606*c* thereof, a first and second hardened inserts 1330*a*, 1330*b* strategically located between the foam layer and the outer fabric layer for providing additional protection to the left upper arm portion 1606, as illustrated in FIG. 17. As such, it will be appreciated that the left upper arm portion 1606 may generally be assembled and constructed as the ventral and dorsal padding panels 500, 1200, and may therefore include any number of foam and fabric layers, hardened inserts, and hardened shells.

As depicted in FIGS. 16 and 17, the left upper arm portion 1606 is connected to the vest 300 and to the left elbow shell 1604. In one embodiment, for attaching the left protective sleeve 302*a* to the vest 300, a pair of elastics elements 1416*a*, 1416*b* are provided on the left upper arm portion 1606, at the top end 1410 thereof, as shown in FIG. 16. As it will be apparent hereinbelow, the elastics elements 1416*a*, 1416*b* attach the left protective sleeve 302*a* to a corresponding portion of the left shoulder fastener 304*a* on the dorsal padding panel 1200. It will be understood that the elastics elements 1416*a*, 1416*b* operate to accommodate any variation in distance separating the sleeve 302*a* from the vest 300 as the wearer move the left arm, therefore facilitating freedom of movement (e.g. when the wearer raise the left arm in the air). It will be appreciated that the elastics elements 1416*a*, 1416*b* may be configured to detachably attach the left and right sleeves 302*a*, 302*b* to the vest 300.

On the other hand, for attaching and adjusting the left upper arm portion 1606 to the wearer's left upper arm, the left upper arm portion 1606 is provided with a corresponding elastic strap assembly 1424 having a first portion 1424*a* located on the first and second protective section 1606*a*, 1606*b* and a second portion 1424*b* connected to the fourth protective section 1606*d*, as illustrated in FIG. 17. The first and second portions 1424*a*, 1424*b* of the elastic strap assembly 1424 collaborate together for wrapping and surrounding the left upper arm portion 1606 to the wearer's left upper arm portion. In one embodiment, the elastic strap assembly 1424 includes an elastic component and a hook and loop components, such as Velcro® component. It will be appreciated that the elastic component provide the required tension for the left upper arm portion 1606 to optimally wrap and surround the wearer's left upper arm, whereas the hook and loop components component enables the wearer to easily and rapidly operate the elastic strap assembly 1424.

In the embodiment of FIG. 16, the left upper arm portion 1606, on the upper end 1410 thereof, comprises a left opening 1426, which is concealed under the left shoulder shell 1604, providing the required clearance for the left sleeve 302 not to offer resistance to wearer's left arm movement (e.g. when the wearer's left arm is raised in the air). As such, the left opening 1426 may be adapted to work with the left shoulder shell 1604 to facilitate freedom of movement to the wearer.

While in the present embodiment the left upper arm portion 1606 is attached to the vest 300 independently from the left shoulder shell 1600*a*, in an alternative embodiment the left upper arm portion 1606 is attached to the left shoulder shell 1600*a*, which itself is attached to the vest 300. Also, while in the present embodiment the left protective sleeve 302*a* is permanently attached to the vest 300 by the elastic elements 1416*a*, 1416*b*, in an alternative embodiment the left protective sleeve 302*a* is detachably attached to the vest 300 (e.g. by at least one detachable fastener or clip like a hook and loop fastener). It will also be appreciated that no matter how the left protective sleeve 302*a* is attached to the vest (e.g. permanently or detachably), the attachment of the left protective sleeve 302*a* to the vest 300 may comprise a means to modify the length between the left protective sleeve 302*a* and the vest 300, as the elastic elements 1416*a*, 1416*b* enable to do.

Elbow Shells

Referring back to FIG. 3, bridging the left upper arm and left forearm portions 1606, 1610, the left elbow shell 1608 generally defines a hemisphere-like shape with a concave portion adapted for receiving and surrounding at least partially the wearer's left elbow therein when the left elbow shell 1608 is attached thereto. With reference to FIGS. 15 to 17, the left elbow shell 1608 comprises a top end 1428, a bottom end 1430, a front end 1432, and a rear end 1434 (shown in FIG. 15), as well as an inner face 1436 and an outer face 1438 (shown in FIGS. 16 and 17).

In one embodiment, for attaching and adjusting the left elbow shell 1608 to the wearer's left elbow, the left elbow shell 1608 is provided with a corresponding elastic strap 1440, as illustrated in FIGS. 15 and 16. More particularly, the elastic strap 1440, which extend between the front end 1432 and the rear end 1434 of the left elbow shell 1608, is configured for providing the tension required for maintaining the left elbow shell 1608 around the wearer's left elbow. Accordingly, the left elbow shell 1608 is adapted for protecting the sensitive region of the wearer's elbow joint. While the elastic strap 1440 is permanently connected to the left elbow shell 1608, it will be appreciated that the elastic strap 1440 may be detachably attached to the left elbow shell 1608.

As best shown in FIG. 3, together with the left upper arm and left forearm portions 1606, 1610, the left elbow shell 1608 may also be configured for defining a corresponding first and second spacings 1612, 1614 providing the required clearance for a full range of left elbow articulation movement (e.g. when the wearer folds its left upper limb) without resistance or hindering from the left sleeve 302*a*. The first spacing 1612 being defined at the junction between the left upper arm portion 1606 and the left elbow shell 1608, while the second spacing 1614 being defined at the junction between the left elbow shell 1608 and the left forearm portion 1610.

In one embodiment, the left elbow shell 1608 of the left sleeve 302*a* is made of an outer hardened cap molded from any hardened material (e.g. polymers, plastics, high-density polyethylene (HDPE or polyethylene high-density (PEHD)), carbon fibers, fiberglass, and the likes) and of an inner foam layer together sandwiched between an outer and inner fabric layers by sewing and/or gluing the various layer(s) together. In another embodiment, the foam layer defines somewhat of a honeycomb-like configuration 1442 on the inner face 1436 of the left elbow shell 1608, as shown in FIG. 16. Therefore, it will be understood that the left shoulder shell 1604 may generally be assembled and built as the ventral and dorsal padding panels 500, 1200, as disclosed hereinbefore.

While in the present embodiment the elastic strap 1440 is permanently attached to the left elbow shell 1608, in an alternative embodiment the elastic strap 1440 is detachably attached to the left elbow shell 1608, as it is the case for the elastic strap assembly 1424 of the left upper arm 1606.

Forearm Portions

Referring back to FIG. 3, the left forearm portion 1610 of the upper body assembly 102 generally defines an elongated C-shaped structure adapted for receiving and protecting at least partially the wearer's left forearm when the sleeve 302*a* is worn. With reference to FIGS. 15 to 17, the left forearm portion 1610 comprises a top end 1506, a bottom end 1508, a front end 1510, and a rear end 1512 (shown in FIG. 15), as well as an inner face 1514 and an outer face 1516 (shown in FIGS. 16 and 17). In one embodiment, and still referring to FIGS. 15 to 17, the top end 1506 of the left forearm portion 1610 is connected to the bottom end 1430 of the left elbow shell 1608.

The left forearm portion 1610 comprises a foam layer sandwiched between an inner and outer fabric layers wherein, as it may be seen on the inner face 1514 of the left forearm portion 1610 (perhaps best shown in FIG. 16), the foam layer defines somewhat of a honeycomb-like configuration 1518 with ventilation holes operating together to enable optimum airflow, body temperature control, sweat evacuation of the wearer. With respect to FIG. 17, defined on the outer face 1516 the left forearm portion 1610, running from the front end 1510 to the rear end 1512 and extending between the top and bottom ends 1506, 1508 thereof, the left forearm portion 1610 also includes first, second, third, and fourth protective sections 1610*a*, 1610*b*, 1610*c*, 1610*d* extending between the top and bottom ends 1506, 1508.

In another embodiment, the outer face 1516 of the left forearm portion 1610 further comprises, on the corresponding first, second and third protective sections 1610*a*, 1610*b*, 1610*c* thereof, a first, second, and third hardened inserts 1332*a*, 1332*b*, 1332*c* strategically located between the foam layer and the outer fabric layer for providing additional protection to the left forearm portion 1610, as illustrated in FIG. 17. In one embodiment, the first and second hardened inserts 1332*a*, 1332*b*, 1332*c* are located between the foam layer and the outer fabric layer. As such, it will be appreciated that left forearm portion 1610 may generally be assembled and constructed as the ventral and dorsal padding panels 500, 1200, and may therefore include any number of foam and fabric layers, hardened inserts, and hardened shells.

For attaching and adjusting the left forearm portion 1610 to the wearer's left forearm, the left forearm portion 1610 is provided with a corresponding elastic strap assembly 1520 having a first portion 1520*a* located on the first protective section 1610*a* and second portion 1520*b* connected to the fourth protective section 1610*d*, adjacent to the top and bottom ends 1506, 1508, as illustrated in FIGS. 15 and 16. The first and second portions 1520*a*, 1520*b* of the elastic strap assembly 1520 collaborate together for wrapping and surrounding the left forearm portion 1610 to the wearer's left upper arm portion. In one embodiment, the elastic strap assembly 1520 includes an elastic component and a hook and loop components, such as Velcro® component. It will be appreciated that the elastic component provide the required tension for the left forearm portion 1520 to optimally wrap and surround the wearer's left forearm, whereas the hook and loop components enables the wearer to easily and rapidly operate the elastic strap assembly 1520. While in the present embodiment the left forearm portion 1610 is permanently attached to the left elbow shell 1608, in an alternative embodiment the left forearm portion 1610 detachably attached to the left elbow shell 1608.

Taken together, it will be appreciated that the left protective sleeves 302*a* optimally positions and disposes soft protective materials like foam(s) and more rigid protective material(s) like hardened insert(s) and hardened shell(s) on the wearer's upper limb such as to provide protection of same while enabling freedom of movement and body temperature control, for example by sweat evacuation.

In an alternative embodiment, the left protective sleeves 302*a* is provided with a means to adjust the length of the sleeves 302*a* according to the wearer's size. More particularly, the left elbow 1608 further comprises a first elastic strap connecting the left upper arm portion 1606 to the left elbow shell 1608 and a second elastic strap connecting the left elbow shell 1608 to the left forearm portion 1610. Taken together, the first and second elastic strap are configured for enabling an adjustment of the left sleeve 302*a* length according to the wearer's arm size. More particularly, the first elastic strap is configured for adjusting the length between the left upper arm 1606 and the left elbow shell 1608, while the second elastic strap is configured for adjusting the length between the left elbow shell 1608 and the left upper arm 1606. When the lengths are shortened, the left upper arm and left forearm portions 1606, 1610 as well as the left elbow shell 1608 may further be adapted superimpose one another and to conform the corresponding contours thereof.

Left and Right Shoulder Fasteners

As described hereinbefore, and referring back to FIGS. 3 and 5, the ventral padding panel 500 may be detachably attached to the dorsal padding panel 1200 by the pair of left and right shoulder fasteners 304*a*, 304*b* and the pair of left and right flank fasteners 306*a*, 306*b*. As such, the pair of left and right shoulder fasteners 304*a*, 304*b* detachably attach the top end 600 of the ventral padding panel 500 to the top end 1300 of the dorsal padding panel 1200. On the other hand, the pair of left and right flank fasteners 306*a*, 306*b* detachably attach the corresponding left and right ends 604, 606 of the ventral padding panel 500 to the corresponding left and right ends 1304, 1306 of the dorsal padding panel 1200. In this configuration, as it will become apparent, the top ends 600, 1300 of the ventral padding panel 500 and the dorsal padding panel 1200 may be adjusted independently from the left and right ends 604, 606, 1304, 1306 of the ventral padding panel 500 and the dorsal padding panel 1200.

More particularly, and referring back to the embodiment of FIG. 5 for the portion of the left and right shoulder fasteners belonging to the ventral padding panel 500, extending upwardly from the top end 600 of the ventral padding panel 500, at the junction of the left end 604 thereof, are left inner and outer shoulder fastener portions 508*a*, 508*b*. Likewise, extending at the top end 600 of the ventral padding panel 500, at the junction of the right end 606 thereof, are right inner and outer shoulder fastener portions 510*a*, 510*b*. For the portion of the left and right shoulder fasteners belonging to the dorsal padding panel 1200, and referring back in this case to the embodiments of FIGS. 15 to 17, extending upwardly from the top end 1300 of the dorsal padding panel 1200, at the junction of the left end 1304 thereof, is a left shoulder fastener 512*a* (shown in FIG. 17) with inner and outer faces 1328*a*, 1408*a* (shown in FIGS. 15 and 16). Likewise, extending at the top end 1300 of the dorsal padding panel 1200, at the junction of the right end 1306 thereof (shown in FIG. 17), is a shoulder fastener 512*b* with inner and outer faces 1328*b*, 1408*b* (shown in FIGS. 15 and 16).

To detachably attach the top end 600 of the ventral padding panel 500 to the top end 1300 of the dorsal padding panel 1200, the left and right inner faces 1328*a*, 1328*b* of the left, right shoulder fasteners 512*a*, 512*b* collaborate with the inner shoulder fastener portions 508*a*, 510*a* of the left and right shoulder fasteners 304*a*, 304*b*, while the left and right outer faces 1408*a*, 1408*b* of the left, right shoulder fasteners 512*a*, 512*b* collaborate with the outer shoulder fastener portions 508*b*, 510*b* of the left and right shoulder fasteners 304*a*, 304*b* for sandwiching the left and right shoulder fastener portions 512*a*, 512*b* between the left and right shoulder fasteners 304*a*, 304*b*.

In one embodiment, as shown in FIG. 3 for example, the left and right shoulder fasteners 304*a*, 304*b* comprise a pair of corresponding left and right emergency pull tabs 802*a*, 802*b* indicating how to detach the top end 600 of the ventral padding panel 500 from the upper body assembly 102. It will be appreciated that the emergency pull tabs 802*a*, 802*b* may have a visible color to facilitate the identification of such tabs by first respondents, paramedics or healthcare professionals in case the wearer is injured and the upper body assembly 102 must be removed rapidly, for example, to access vital organs.

Therefore, it will be appreciated that the pair of left and right shoulder fasteners 304*a*, 304*b*, along with the ventral padding panel 500 and the dorsal padding panel 1200, together define a neck opening within the upper body assembly 102 that is adapted for receiving the wearer's neck.

Left and Right Flank Fasteners

As for the left and right shoulder fasteners 304*a*, 304*b*, the left and right flank fasteners 306*a*, 306*b* also enable the ventral padding panel 500 to be detachably attached to the upper body assembly 102. Referring back to the embodiments of FIG. 11 in the case of the ventral padding panel 500 and FIG. 17 in the case of the dorsal padding panel 1200, extending on the left end 604 of the ventral padding panel 500, is a left flap 804*a* configured to cover the left flank of the wearer's torso and to receive the left flank fastener portion 806*a* collaborating with the corresponding left flank fastener portion 1308*b*, which is received on the left flap 1310*a* of the dorsal padding panel 1200. Likewise, extending on the right end 606 of the ventral padding panel 500, is a right flap 804*b* configured to cover the right flank of the wearer's torso and to receive the right flank fastener portion 806*b* collaborating with the corresponding right flank fastener portion 1308*b* of the dorsal padding panel 1200, which is received on the right flap 1310*b* of the dorsal padding panel 1200. The left and right flank fastener portions 806*a*, 806*b* of the ventral padding panel 500 collaborate with corresponding left and right flank fastener portions 1308*a*, 1308*b* of the dorsal padding panel 1200 for adjustably and detachably attaching left and right ends 604, 606 of the ventral padding panel 500 to the left and right ends 1304, 1306 ends of the dorsal padding panel 1200. In an alternative embodiment, the left and right flank fasteners 306*a*, 306*b* may also include a pair of corresponding emergency pull tabs indicating how to detach the left and right 604, 606 ends of the ventral padding panel 500 from the upper body assembly 102, where such pull tab may have a visible color for facilitate their identification by first respondents, paramedics or healthcare professionals in case the wearer is injured and the upper body assembly 102 must be removed rapidly, for example, to access vital organs.

In one embodiment, the left and right shoulder fasteners 304*a*, 304*b* and the left and right flank fasteners 306*a*, 306*b* each comprise at least one hook and loop components, such as Velcro®, for detachably attaching the ventral padding panel 500 to the dorsal padding panel 1200. In another embodiment, the left and right flank fasteners 306*a*, 306*b* further comprise an elastic strap coupled to the hook and loop components. It will be understood that the combined used of a hook and loop components and an elastic strap enable an easy and quick way to detachably attach the ventral padding panel 500 to the upper body assembly 102. In an alternative embodiment, the left and right shoulder fasteners 304*a*, 304*b* and the left and right flank fasteners 306*a*, 306*b* comprise at least one push-in button or any other kind of fasteners known in the art of protective garments that may or not be coupled to any kind of strap or resilient element know in the art of protective garments.

Taken together, it will also be appreciated that the left and right shoulder fasteners 304*a*, 304*b* and the left and right flank fasteners 306*a*, 306*b* enable the wearer to itself easily detach and remove the ventral padding panel 500 from the upper body assembly 102 and, therefore, facilitate the dressing of the upper body assembly 102. Also, the left and right shoulder fasteners 304*a*, 304*b* and the left and right flank fasteners 306*a*, 306*b* may provide a way for the wearer to facilitate body temperature control by removing partially the ventral padding panel 500 when in warm temperature, for example, while the wearer is not involved in any activities requiring protection of the ventral face of the upper body.

Therefore, it will be appreciated that the pair of left and right shoulder fasteners 304*a*, 304*b* and the pair of left and right flank fasteners 306*a*, 306*b*, along with the ventral padding panel 500 and the dorsal padding panel 1200, together define a pair of left and right arm openings within the upper body assembly 102 that is adapted for receiving the wearer's left and right upper limb.

Neck Collar

In one embodiment, as shown in FIGS. 18 to 21B, the upper body assembly 102 further includes a neck collar 1600 for protecting at least partially the wearer's neck and the area extending therefrom towards the wearer's left and right shoulders and the upper, ventral body portion. In this configuration, the neck collar 1600 is adapted not only for protecting the wearer from physical, direct force impacts and other type of aggressions, but is also adapted for protecting the wearer from liquid entering the upper body assembly 102 when such liquid is directed against the wearer. In such instance, hazardous or potentially hazardous liquid (e.g. bleach, vinegar containing pepper, etc.) or even thrown object containing such liquid (which breaks upon hitting the wearer) may enter inside the upper body assembly 102 and contact and wound the wearer's skin. When it happens, the wearer is usually required to remove its protective equipment quickly, wash away such liquid, and receive medical attention. Therefore, no matter how a given protective equipment protects the wearer from a direct force impact, the protective equipment must also provide protection against various forms of aggression, include one coming from hazardous or potentially hazardous liquid.

In one embodiment, the neck collar 1600 generally defines an annular-like structure comprising an outer face 1900, an inner face 1902, a font end 1602 located on the same end as the ventral padding panel 500, a back end 1700 located on the same end as the dorsal padding panel 1200, an external circumference 1800, and an internal circumference 1802 from which a generally cylindrical neck wall 1804 extends perpendicularly therefrom (i.e. upwardly). The cylindrical neck wall 1804 together with the internal circumference 1802 defines an opening 1806 for receiving the wearer's neck.

Figure 18:
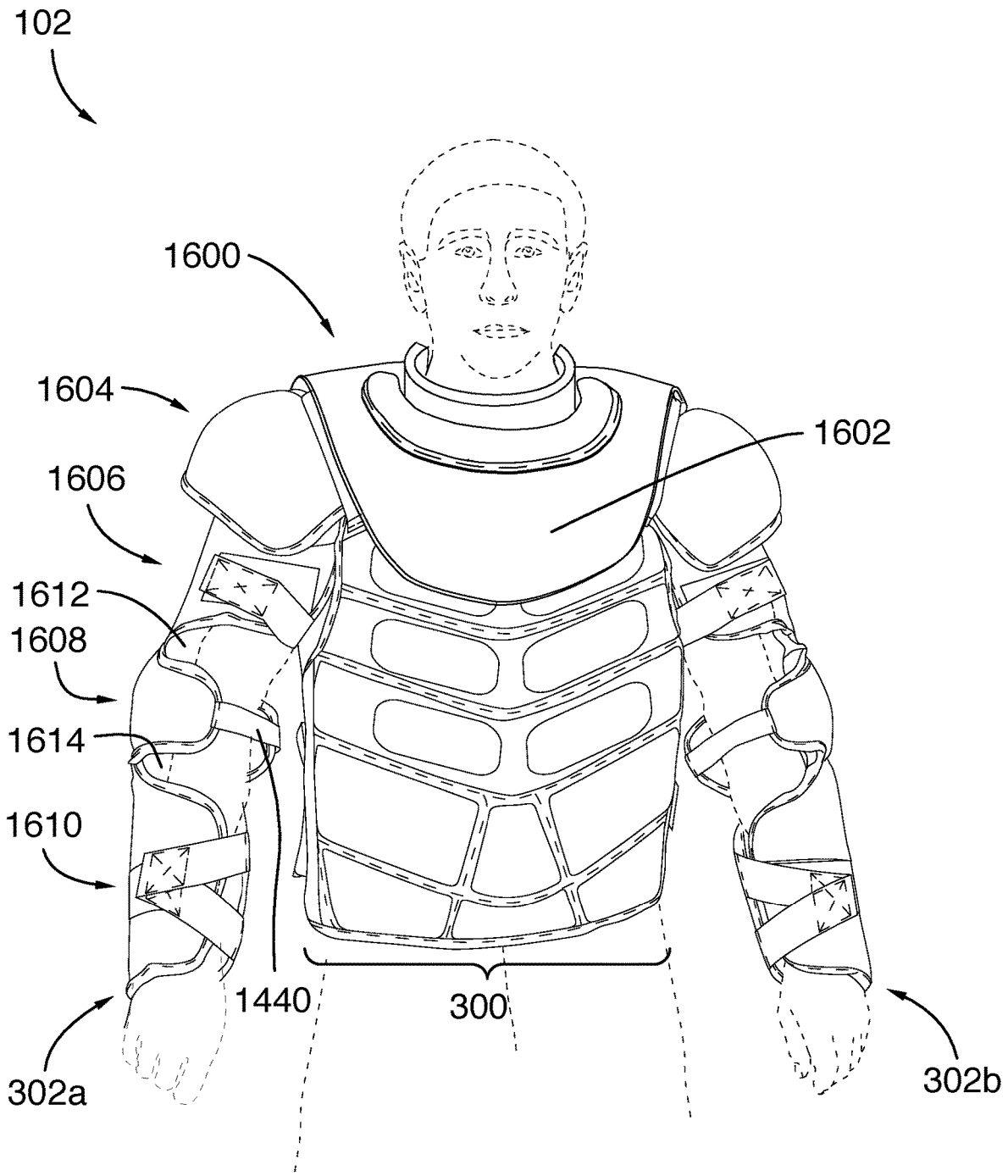
FIG. 18 is a front perspective view of the protective upper body assembly illustrated in FIG. 3, and a neck collar, in accordance with an embodiment.
Figure 19:
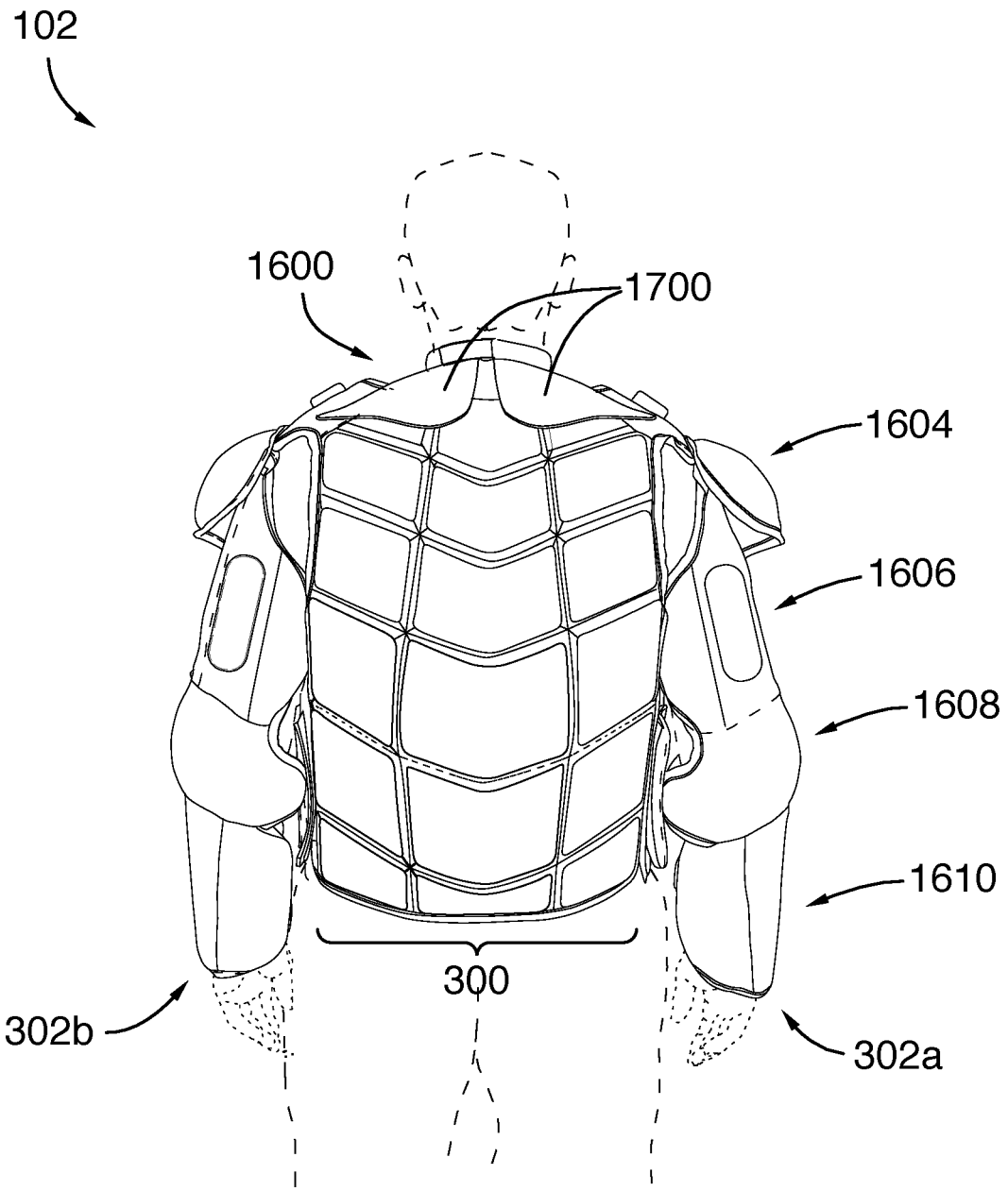
FIG. 19 is a rear perspective view of the protective upper body assembly illustrated in FIG. 18.
Figure 20:
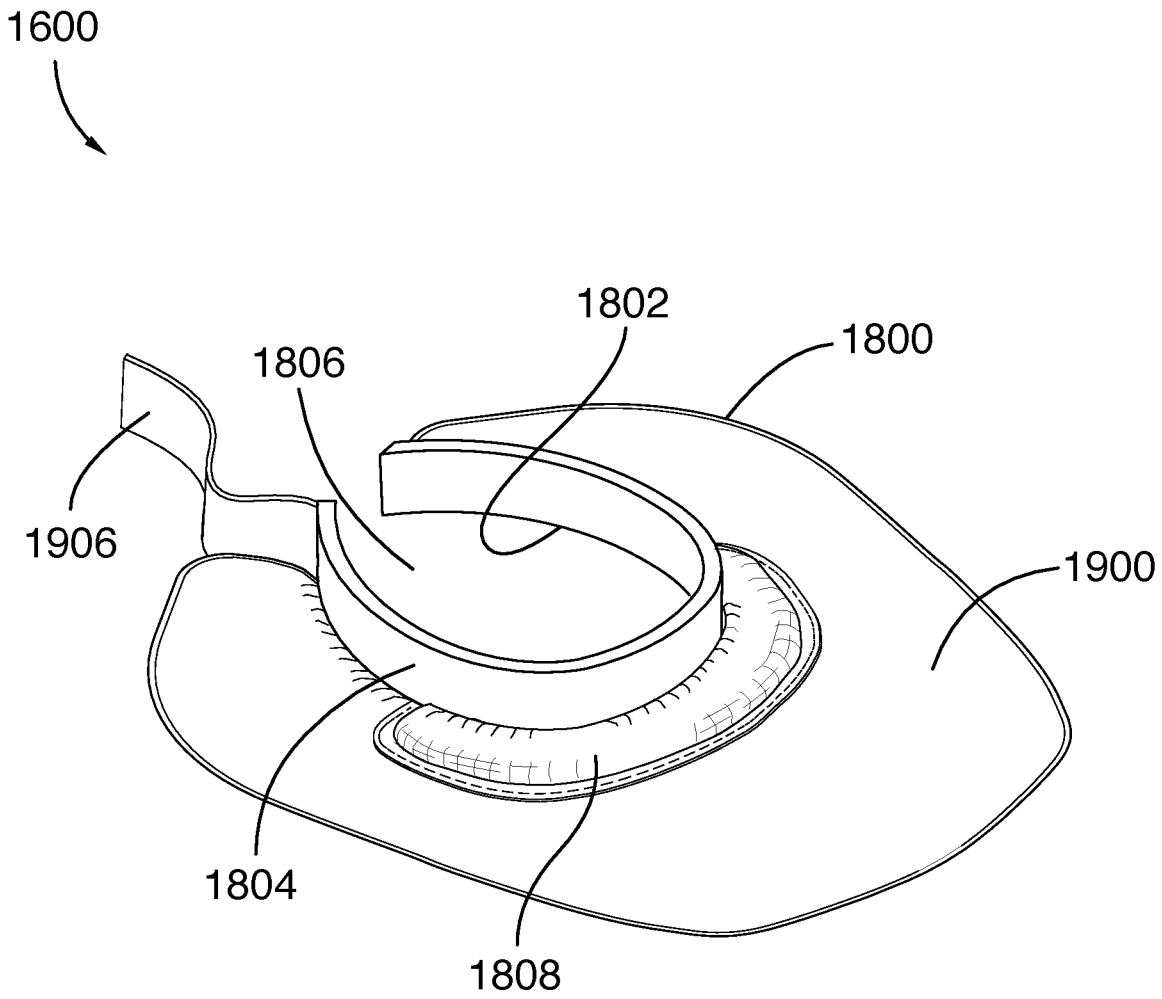
FIG. 20 is top, front, right side perspective view of the neck collar illustrated in FIG. 18.

As shown in the embodiments of FIG. 18, because the cylindrical neck wall 1804 and internal circumference 1802 are generally excentric relative to the external circumference 1800, the neck collar 1600 generally sits around the wearer's neck in a forward position when properly positioned relative to the upper body assembly 102, extending from the base of the wearer's neck to the vicinity of the V-shaped grooves 610 of the ventral padding panel 500. In one embodiment, as depicted on FIG. 21B, a pair of left and right collar fasteners 1904*a*, 1904*b* are also provided for detachably attaching the neck collar 1600 to the upper body assembly 102. The right and left collar fastener portions 1904*a*, 1904*b* may be both generally diametrically opposed on the internal circumference 1802 of the neck collar 1600, on the inner face 1902 thereof, and are configured to collaborate with the corresponding right and left collar fastener portions (not shown) of the upper body assembly 102.

Figure 21A:
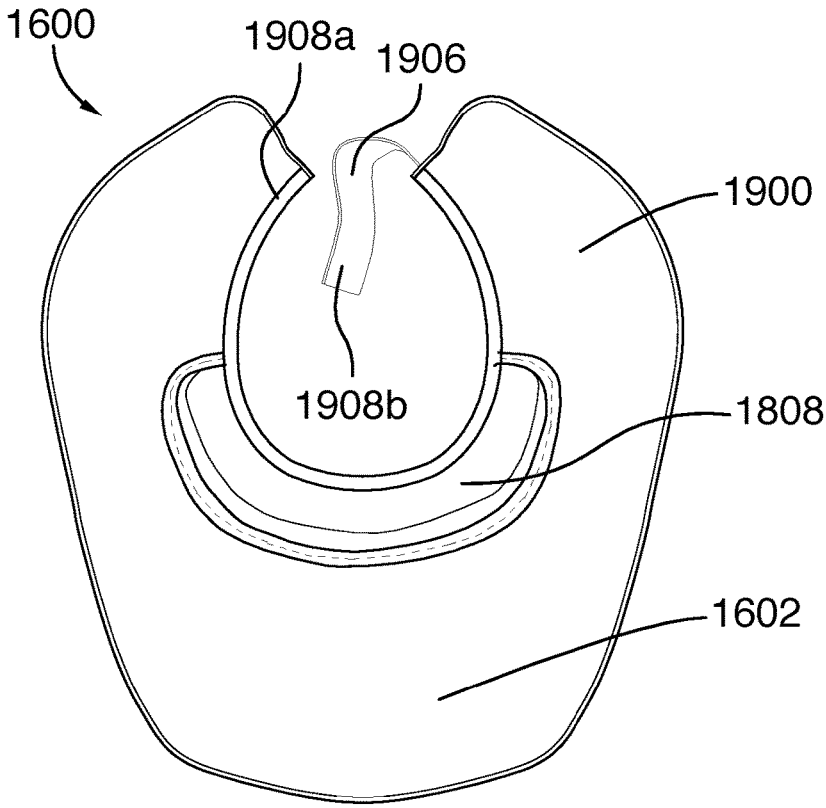
FIG. 21A is top perspective view of the neck collar illustrated in FIG. 18.
Figure 21B:
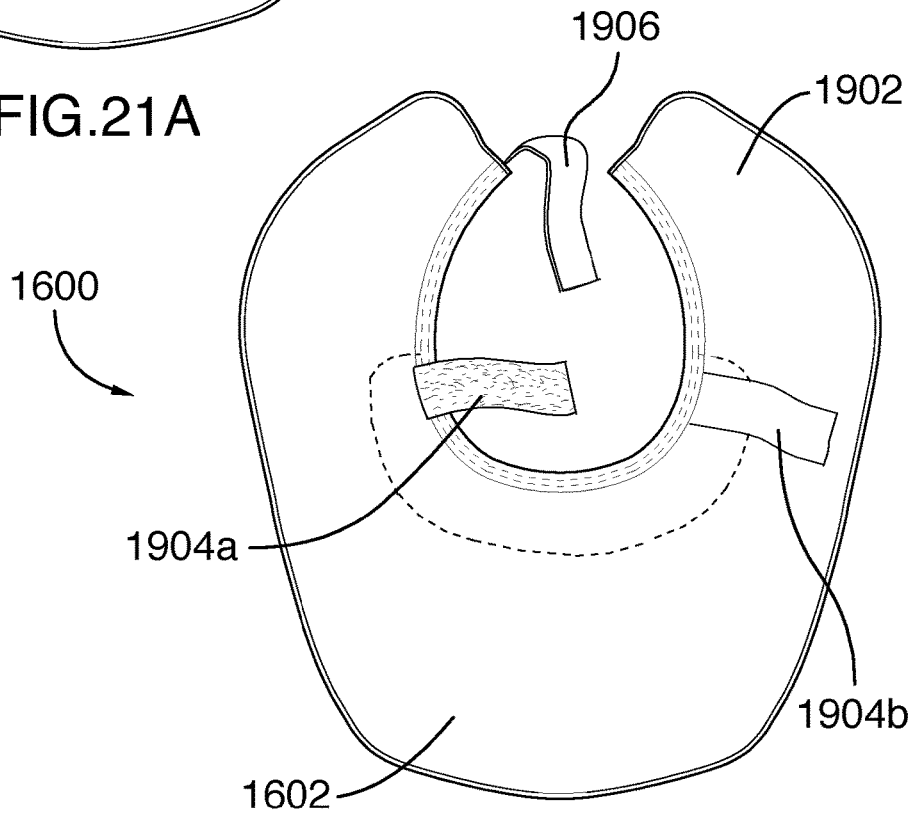
FIG. 21B is bottom perspective view of the neck collar illustrated in FIG. 18.

In another embodiment, referring to FIG. 21A, a neck fastener 1906 is further provided for detachably adjusting the neck collar 1600 to the wearer's neck. The neck fastener 1906 comprises a first and second neck fastener portions 1908*a*, 1908*b* located on the cylindrical neck wall 1804, on the outer face 1900 and back end 1700 of the neck collar 1600, collaborating together to sealingly close the cylindrical neck wall 1804 around the wearer's neck. In one embodiment, the attachment of the neck collar 1600 to the upper body assembly 102 provides a means to conceal the emergency pull tabs 802*a*, 802*b* to prevent unwanted attempt to remove the upper body assembly by hostile individual(s).

While the neck collar 1600 may be comprised of the same material(s) as the remaining of the upper body assembly 102 (e.g. fabric, foam, hardened insert(s), and ballistic shield), it may also comprise at least one layer one liquid-proof material (e.g. liquid-proof ballistic nylon) adapted for protecting the wearer from hazardous or potentially hazardous liquid that may come in contact with him. Moreover, the neck collar 1600 may also comprise one or more foam layer(s) to provide additional protection and/or comfort to the wearer. More precisely, the cylindrical neck 1804 wall may include a layer of foam (e.g. XAP-500, XAP-250-H, and/or any other foam material known in the art) sandwiched between two layers of fabric as described herein for the assembling of the ventral and dorsal padding panels 500, 1300. Alternatively, the face of the cylindrical neck wall 1804 contacting the wearer's neck may also comprise a foam, a fabric or any other material offering suitable protection and/or comfort to the wearer's neck. For additional protection to the lower part of the face, including the wearer's chin and cheeks, a soft foam pad 1808 (e.g. XAP-500, XAP-250-H, and/or any other foam material known in the art) surrounding a part of the cylindrical neck wall 1804 may also be provided on the outer face 1900 and font end 1602 of the neck collar 1600. Alternatively, the soft foam pad 1808 substantially surround the cylindrical neck wall 1804. In one embodiment, one of more foam layer(s) or hardened insert(s) are further provided to the neck collar 1600, which are strategically located thereto for additional protection.

Groin Protector

Figure 22:
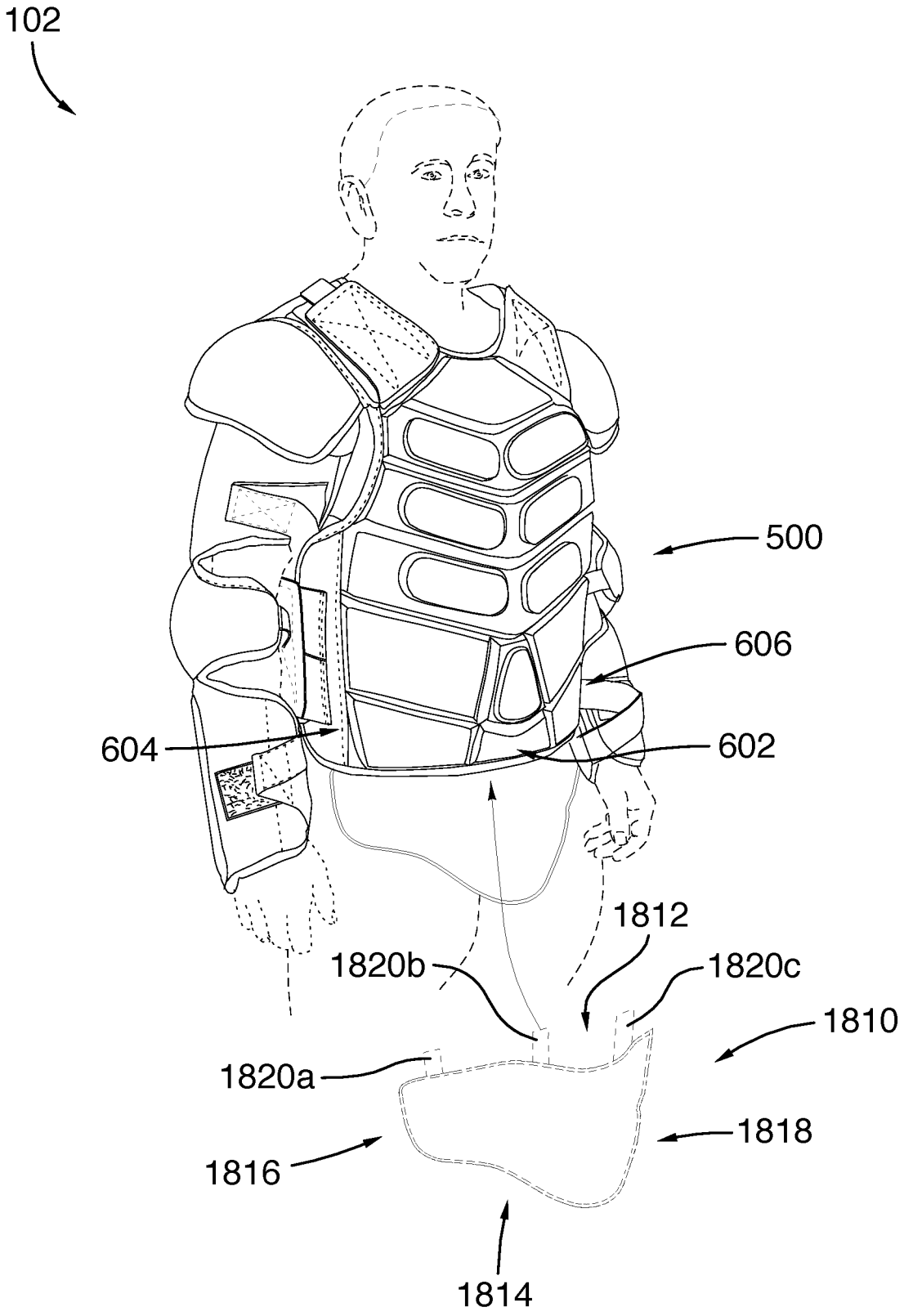
FIG. 22 is a front, right side perspective view of the upper body assembly illustrated in FIG. 3, and a groin protector, in accordance with an embodiment.

In an alternative embodiment, as depicted in FIG. 22, the upper body assembly 102 further comprises a groin protector 1810 generally defining a trapezoid-like structure and comprises a top end 1812, a bottom end 1814, a left end 1816, and a right end 1818. The groin protector 1810 generally extend between the bottom end 602 of the ventral padding panel 500 and the lower body assembly 104. In this location, the groin protector may generally cover an area corresponding to the width of the ventral padding panel 500 (that is the distance running from the left end 604 to the right end 606 of the ventral padding panel 500) and is therefore adapted for protecting the wearer's groin area, including the anterior pelvic region.

The top end 1812 of the groin protector 1810 is also configured for conforming to the contour of the bottom end 602 of the ventral padding panel 500 and, as it progress downwards, the groin protector 1810 progressively tapers and converges between the wearer's legs such that the bottom end 1814 of the groin protector 1810 is sized and shaped to facilitate freedom of movement to the lower part of the wearer's body, including the legs (e.g. when the wearer is raising a leg).

The groin protector 1810 also comprised a first, second, third groin protector fasteners 1820*a*, 1820*b*, 1820*c* adapted for suspending the groin protector 1810 to the upper body assembly 102, generally below the ventral padding panel 500 thereof. The groin protector fastener may be configured to releasably and somewhat loosely attach the groin protector to the bottom end 602 of the ventral padding panel 500 for facilitating freedom of movement to the wearer. To attach to the upper body assembly 102, the first, second, third groin protector fasteners 1820*a*, 1820*b*, 1820*c* may comprise any kind of fasteners known in the art, including quick-release fasteners, hooks and loops, and the like. It will also be appreciated that the groin protector 1810 may be attached to the upper body assembly by any number of fasteners.

In one embodiment, the groin protector 1810 is configurable according to the need of the wearer depending of the level of protection desired. To this end, the groin protector 1810 comprises a groin wrap (not shown) with a pocket (not shown) adapted for supporting and positioning one or more protective groin panel(s) (not shown) in register with the anterior pelvic region of the wearer for protecting same. In one embodiment, the groin protector 1810 include a resiliently elastic material such as spandex, while the protective groin panel(s) include foam(s), hardened insert(s), padding panel(s), ballistic shield(s), and the like. By configuring the groin protector 1810 with the right protective material, the wearer may therefore find the right balance between the level of protection and the freedom of movement desired.

In another embodiment, the groin protector 1810 is not configurable. In this case, and as for the ventral and dorsal padding panels 500, 1200, the groin protector may include one of more foam layer(s) sandwiched between at least two fabric layers (e.g. by gluing and/or sewing) and may further include hardened insert(s), hardened shell(s), and/or ballistic shield(s) for additional protection. Therefore, it will be understood that the groin protector 1810 may generally be assembled and built like the ventral and dorsal padding panels 500, 1200, as disclosed herein.

While in the present alternative embodiment the groin protector 1810 provide protection for the pelvic region of the wearer, the groin protector 1810 may also provide protection for the wearer's medial thigh regions and/or femoral arteries.

In one embodiment, the upper body assembly 102 is worn by first dressing the vest 300, which may or not include the ventral padding panel 500. If absent, then the ventral padding panel 500 is attached to the remaining of the vest 300 and adjusted to the wearer's size and the various components of the vest 300 are attached and adjusted to the corresponding arm portions according to the wearer's size. Finally, the neck collar 1600 (if present) and the groin protector 1810 (if present) is dressed and attached on the vest 300 and further adjusted to the wearer's size.

Lower Body Assembly

Referring back to the embodiments of FIGS. 1 and 2, the protective suit 100 comprises a lower body assembly 104, which itself includes corresponding left and right leg protectors 110*a*, 110*b* generally defining a pants-like garment. Since the left and right leg protectors 110*a*, 110*b* are mirror images of one another, only the left leg protector 110*a* will be described. It will be appreciated that a similar description also applies to the right leg protector 110*b* with proper adaptation. As it will be appreciated, the lower body assembly 104 provide protection to the lower part of the body, including the lower limbs and legs (e.g. thighs, knees, shins, ankles, and feet), and may be used separately or together with the upper body assembly 102.

In one embodiment, moving from the top (i.e. adjacent to the wearer's pelvic region when the lower body assembly 104 is worn) to the bottom (i.e. adjacent to the wearer's ankles and toes regions when the lower body assembly 104 is worn), the leg protector 110*a* comprises a left thigh portion 2001*a*, a left knee shells 2004*a*, a left lower leg portion 2006*a*, and a left foot shell 2008*a*.

Thigh Portions

In the embodiment shown in FIGS. 23 to 27, the left thigh portions 2001*a* of the left leg protector 110*a* comprises an upper thigh portion 2000*a* and a lower thigh portion 2002*a*. More particularly, in FIGS. 23 and 24, the left upper thigh portion 2000*a* of the left leg protector 110*a* generally defines an elongated C-shaped structure adapted for receiving the wearer's left upper thigh therein when the left leg protector 110*a* is worn. The left upper thigh portion 2000*a* comprises a top end 2218, a bottom end 2220, a left end 2222, and a right end 2224 (shown in FIG. 23), as well as an outer face 2216 (shown in FIG. 26) and inner face 2214 (shown in FIG. 27).

Figure 25:
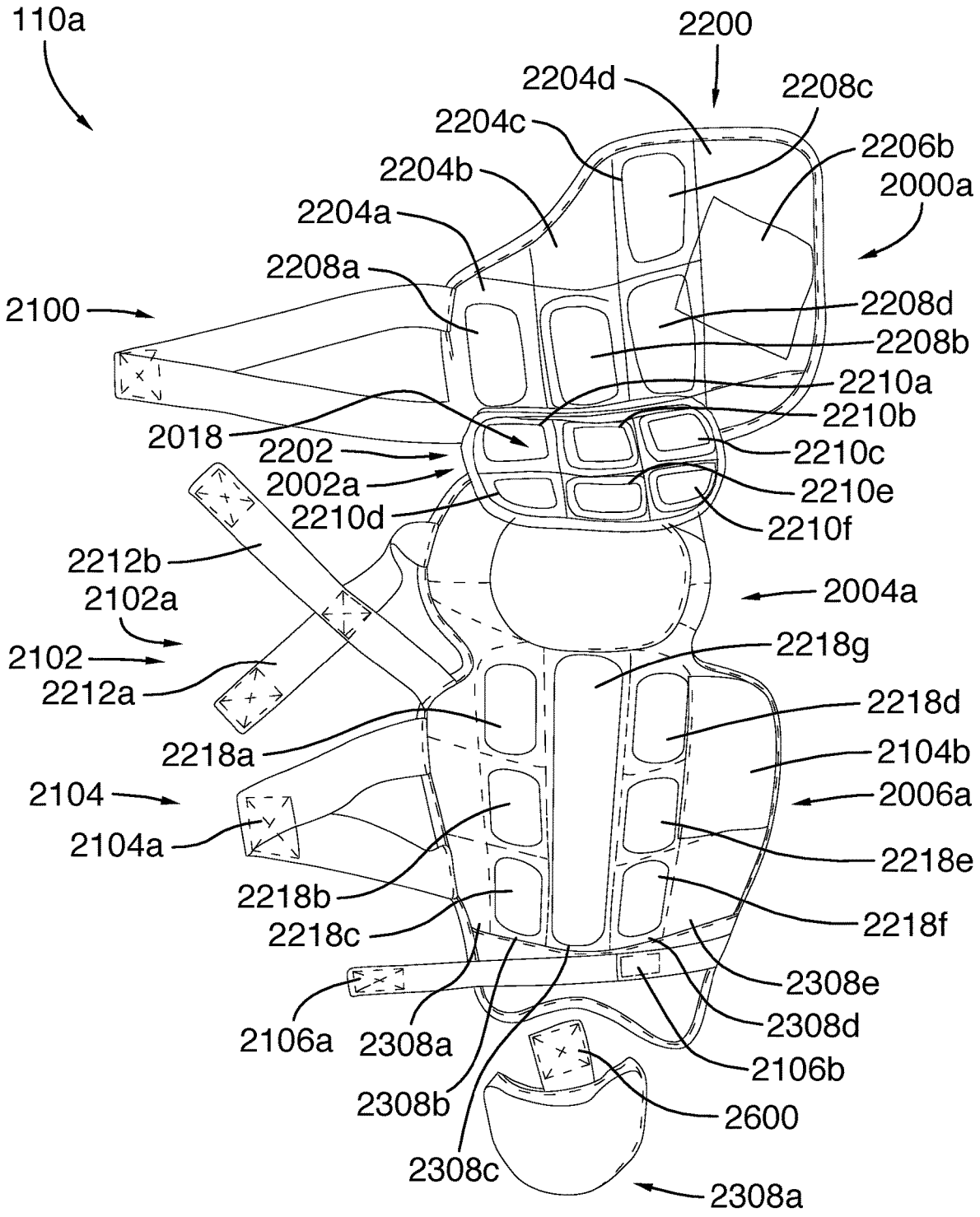
FIG. 25 is a front elevation view of the left leg protector illustrated in FIG. 23, showing a left lower thigh portion in an upward pose.
Figure 27:
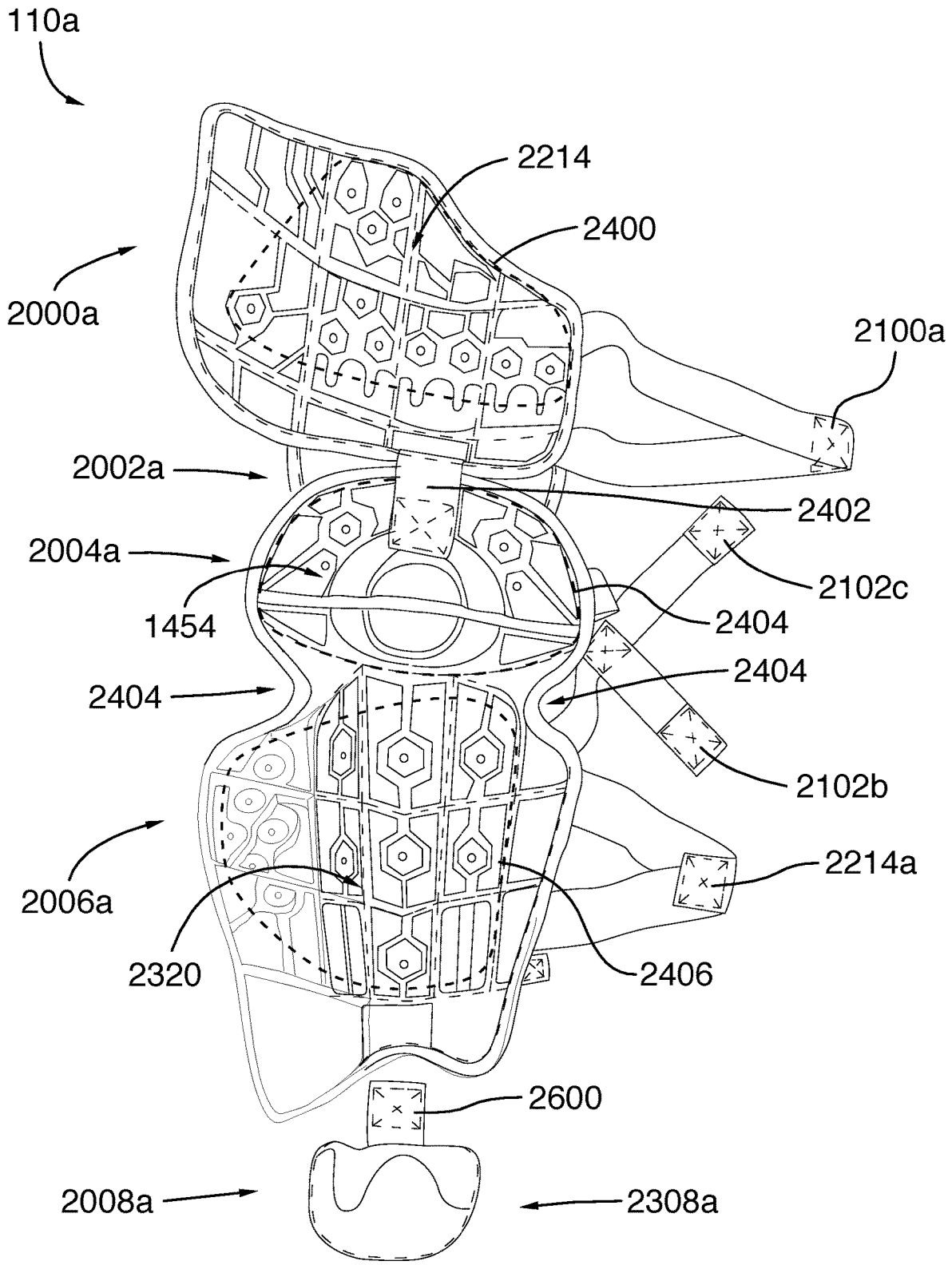
FIG. 27 is a rear elevation view of the left leg protector illustrated in FIG. 23, showing a foam layer.

In one embodiment, as illustrated in FIG. 27, the left upper thigh portion 2000*a* comprises a foam layer sandwiched between an inner and outer fabric layers wherein, as it may be seen on the inner face 2214 of the left upper thigh portion 2000*a*, the foam layer defines somewhat of a honeycomb-like configuration 2400 with ventilation holes operating together to enable optimum airflow, body temperature control, sweat evacuation of the wearer. As illustrated in FIG. 25, defined on the outer face 2216, running from the left end 2202 to the right end 2204, the left upper thigh portion 2000*a* also includes first, second, third, and fourth protective sections 2204*a*, 2204*b*, 2204*c*, 2204*d* extending between the top and bottom ends 2218, 2220.

In another embodiment, the outer face 2216 of the left upper thigh 2000*a* further comprises, on the corresponding first, second, and third protective sections 2204*a*, 2204*b*, 2204*c* thereof, a first, second, third, and fourth hardened inserts 2208*a*, 2208*b*, 2208*c*, 2208*d* for providing additional protection to the left upper thigh portion 2000*a*, as shown in FIG. 25. More particularly, the first hardened insert 2208*a* is received on the first protective section 2204*a*, the second hardened insert 2208*b* is received on the second protective section 2204*b*, and the third and fourth hardened inserts 2208*c*, 2208*d* are received on the third protective section 2204*c*. In one embodiment, the hardened inserts 2208*a*, 2208*b*, 2208*c*, 2208*d* are located between the foam layer and the outer fabric layer. As such, it will be appreciated that the left upper thigh portion 2000*a* may generally be assembled and constructed as the ventral and dorsal padding panels 500, 1200, and may therefore include any number of foam and fabric layers, hardened inserts, and hardened shells.

Figure 23:
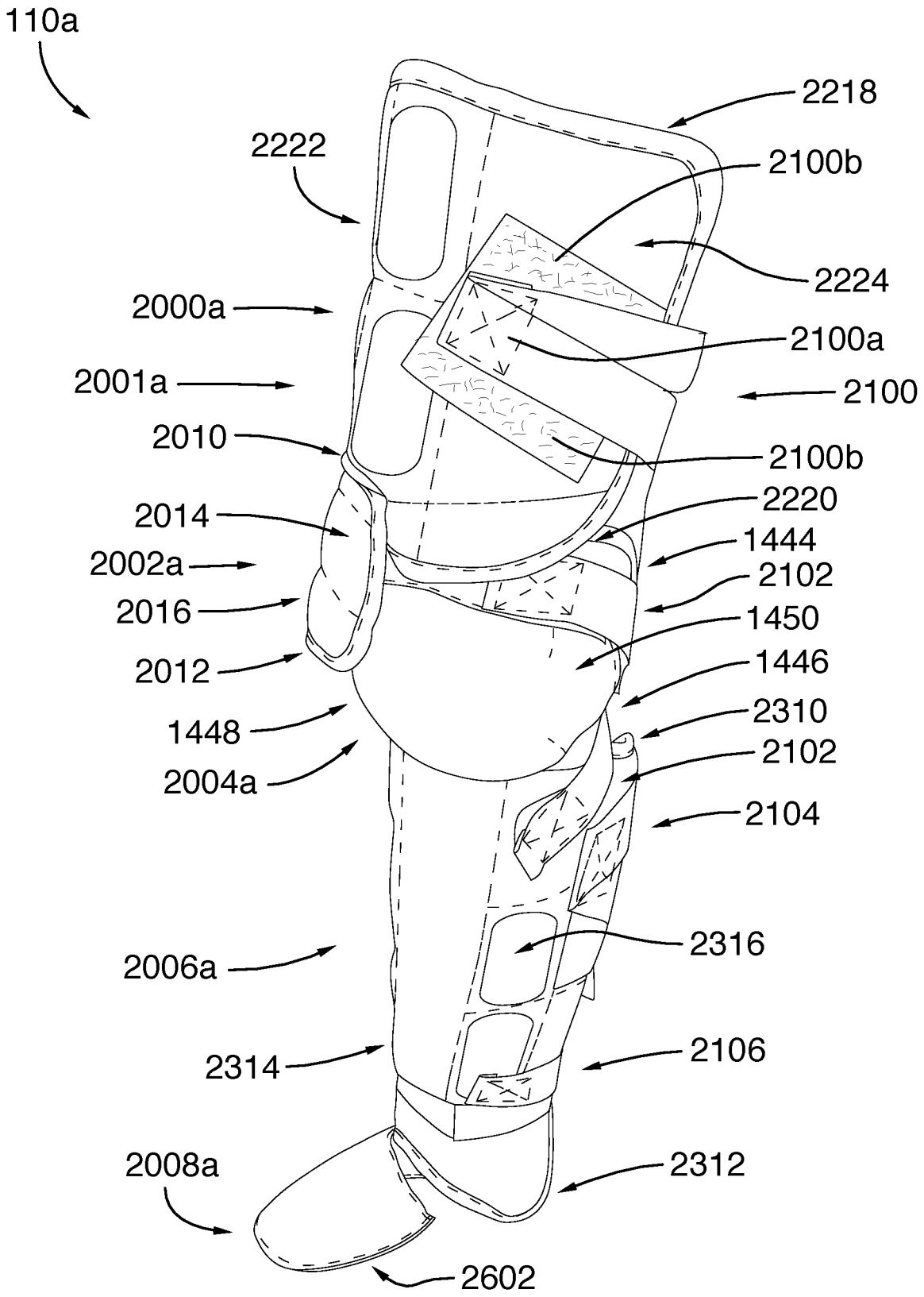
FIG. 23 is a top, front, left side perspective view of a left leg protector of the protective lower body assembly illustrated in FIG. 1.
Figure 24:
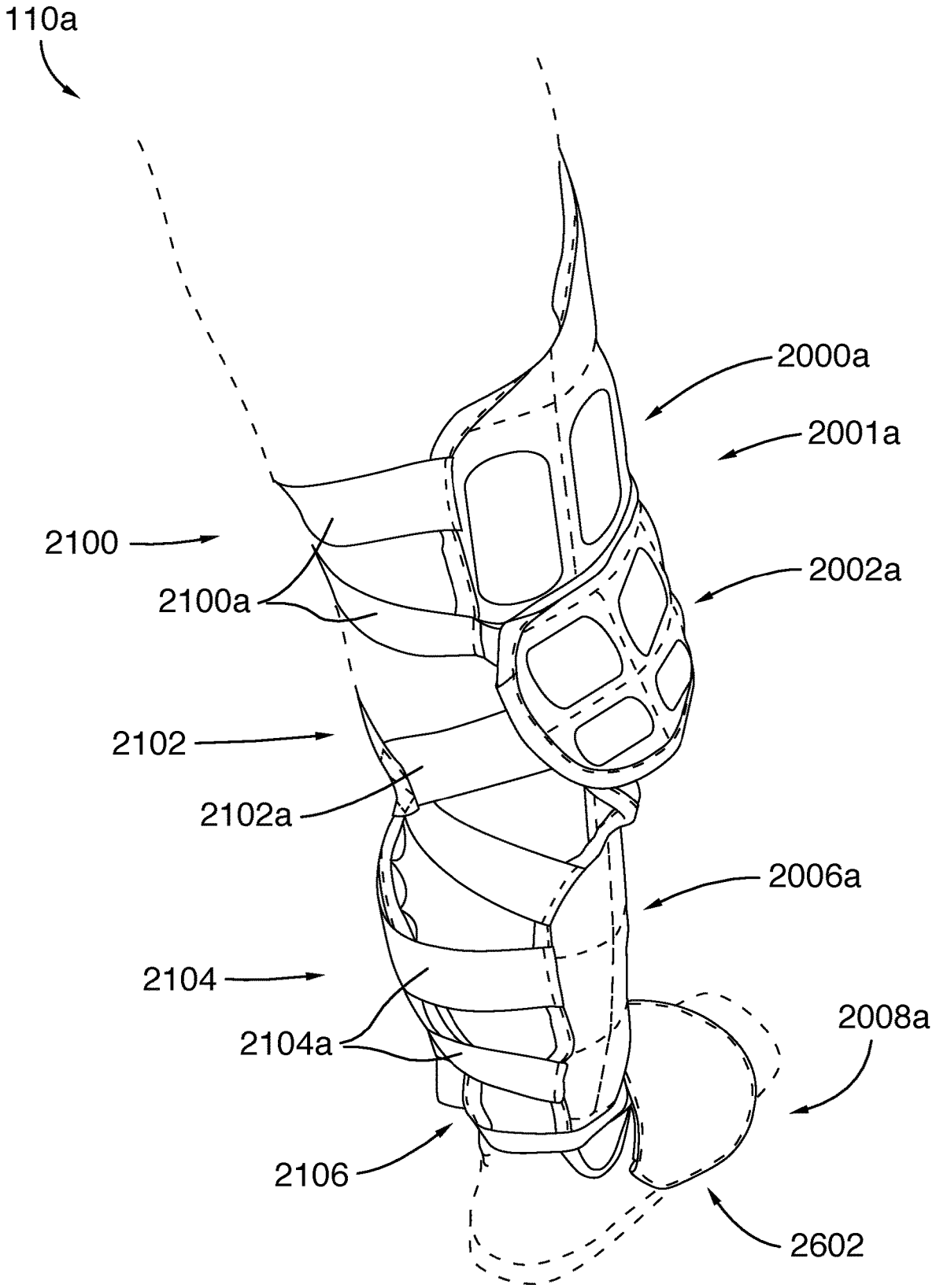
FIG. 24 is a top, rear, right side perspective view of the left leg protector illustrated in FIG. 23.

As depicted in FIGS. 23 and 24, the left upper thigh portion 2000*a* is attached to the wearer's left upper thigh and is connected to the left knee shell 2004*a* of the left leg protector 110*a*. More particularly, and referring to FIG. 26, for attaching and adjusting the left upper thigh portion 2000*a* to the wearer's left upper thigh, the left upper thigh portion 2000*a* is provided with a corresponding elastic strap assembly 2100 having a first portion 2100*a* located on the first protective section 2204*a*, adjacent to the top and bottom ends 2218, 2220, and a second portion 2100*b* connected to the fourth protective section 2204*d*. The first and second portions 2100*a*, 2100*b* of the elastic strap assembly 2100 collaborate together for wrapping and surrounding the left upper thigh portion 2000*a* to the wearer's left upper arm portion. In this configuration, the elastic strap assembly 2100, which makes two contact points on the dorsal face of the wearer's left upper thigh for an optimal attachment and adjustment thereto, is configured for closing the left upper thigh portion 2000*a* around the wearer's left upper thigh, positioning the first, second, third, and fourth protective sections 2204*a*, 2204*b*, 2204*c*, 2204*d* mostly on the frontal and lateral faces of the wearer's left thigh. In one embodiment, the top end 2218 of the left upper thigh portion 2000*a* is adapted in size and shape to conform to the contour of the wearer's left leg in the pelvic region to facilitate freedom of movement when sitting, walking, and running, for instance. In another embodiment, as shown in FIG. 27, the bottom end 2220 of the left upper thigh portion 2000*a* is detachably attached to the top end 1444 of the left knee shell 2004*a* by an elastic element 2402, as it will become apparent hereinbelow.

As for the elastic strap assembly 1424 of the left upper arm portion 1606, the elastic strap assembly 2100 of the upper thigh portion 2000*a* may also include an elastic component and hook and loop components, such as a Velcro® component. It will be appreciated that the elastic component provide the required tension for the left upper thigh portion 2000*a* to optimally wrap and surround the wearer's left upper thigh, whereas the hook and loop components enables the wearer to easily and rapidly operate the elastic strap assembly 2100.

For its part, and as it may be appreciated in the embodiment of FIGS. 23 and 24, the left lower thigh portion 2002*a* of the left leg protector 110*a* generally defines a pad extending from the left upper thigh portion 2000*a*, at the vicinity of the bottom and left ends 2220, 2222 thereof. As for the upper thigh portion 2000*a*, the left lower thigh portion 2002*a* is made of a foam layer sandwiched between an inner and outer fabric layers. The left lower thigh portion 2002*a* comprises a top end 2010, a bottom end 2012, a left end 2014, and a right end 2016 (shown in FIG. 23), as well as an outer face 2018 (shown in FIG. 25) and inner face 2020 (shown in FIG. 26).

Figure 26:
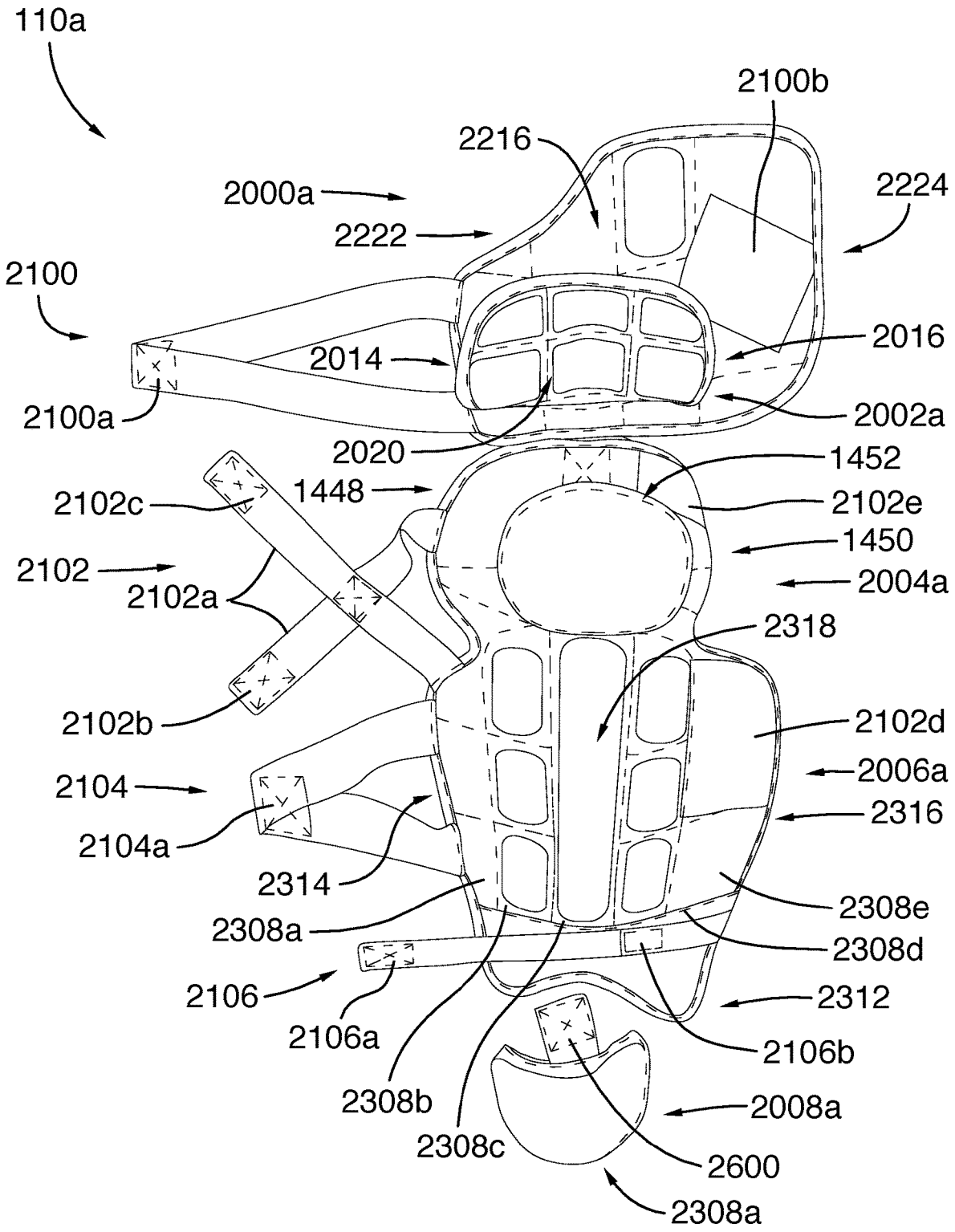
FIG. 26 is a front elevation view of the left leg protector illustrated in FIG. 23, showing the left lower thigh portion in a downward pose.

While offering additional protection to the lateral, external side of the wearer's left thigh and left knee, the left lower thigh portion 2002*a* is pivotally connected, at the top end 2010 thereof, to the bottom and left ends 2220, 2222 of the left upper thigh portion 2000*a* so that to extend below the first, second, and third protective sections 2204*a*, 2204*b*, 2204*c* of the upper thigh portion 2000*a*, as well as over the left end 1448 of the left knee shell 2004*a*. The pivotal connection of the lower thigh portion 2002*a* to the upper thigh portion 2000*a* enables the lower thigh portion 2002*a* to move in order to accommodate knee articulation movement (e.g. when the wearer's left leg is bent), facilitating freedom of movement (for comparison, FIG. 25 shows the lower thigh portion 2002*a* in a downward pose, while FIG. 26 shows the lower thigh portion 2002*a* in an upward pose).

For additional protection, defined on the outer face 2018, the left lower thigh portion 2002*a* also includes first, second, third, fourth, fifth, and sixth protective sections 2210*a*, 2210*b*, 2210*c*, 2210*d*, 2210*e*, 2210*f* extending between the top and bottom ends 2010, 2012 as well as left and right ends 2014, 2016 of the left lower arm portion 2002*a*, as depicted in FIG. 25. In one embodiment, each of the first, second, third, fourth, fifth, and sixth protective sections 2210*a*, 2210*b*, 2210*c*, 2210*d*, 2210*e*, 2210*f* receive on the outer face 2018 of left lower arm portion 2002*a*, between the foam and the outer fabric layers, at least one corresponding hardened insert. As such, it will be appreciated that the left lower thigh portion 2002*a* may generally be assembled and constructed as the ventral and dorsal padding panels 500, 1200, and may therefore include any number of foam and fabric layers, hardened inserts, and hardened shells.

In an alternative embodiment, a strap may be provided at the top end 2218 of the left upper thigh portion 2000*a* for detachably attaching the upper body assembly 102 to the lower body assembly 104, therefore assisting the latter to be maintained in place on the wearer's left leg.

Knee Shells

With reference to FIG. 23, bridging the left upper thigh and left lower leg portions 2000*a*, 2006*a*, the left knee shell 2004*a* generally defines a hemisphere-like shape with a concave portion adapted for receiving and surrounding at least partially the wearer's left knee therein when the left elbow knee 2004*a* is attached thereto. With reference to FIGS. 23, 26, and 27, the left knee shell 2004*a* comprises a top end 1444, a bottom end 1446, a front end 1448, and a rear end 1450 (shown in FIG. 23), as well as an outer face 1452 (shown in FIG. 26) and an inner face 1454 (shown in FIG. 27). Also, the left knee shell 2004*a* is continuously connected to the left lower leg portion 2006*a* and further connected to the left knee shell 2004*a* by the elastic element 2402.

More particularly, and referring to the embodiment of FIG. 27, the elastic element 2402 is provided on the top end 1444 of the left knee shell 2004*a* and detachably attached by hook and loop components, such as a Velcro®, to the left upper thigh portion 2000*a*, on the bottom end 2220 thereof. In this configuration, the elastic element 2402 generally lies concealed behind the lower thigh portion 2002*a*, adjacent to the inner face 2020 thereof. It will be appreciated that the elastic element 2402 is adapted for accommodating any variation in distance separating the left knee shell 2004*a* from the left upper thigh portion 2000*a* as the wearer move the left leg, facilitating freedom of movement (e.g. when the wearer bend the left leg). It will further be appreciated that the detachable attachment of the left knee shell 2004*a* with the left upper thigh portion 2000*a* enable the wearer to use the left knee shell 2004*a* independently from the left upper thigh portion 2000*a*.

As depicted in FIGS. 23 and 24, for attaching and adjusting the left knee shell 2004*a* to the wearer's left knee, the left knee shell 2004*a* is provided with a corresponding elastic strap assembly 2102 assembly. More particularly, and referring to FIG. 26, the elastic strap assembly 2102 assembly, which extend between the left and right ends 1448, 1450 of the left knee shell 2004*a*, comprises a first portion 2102*a* with a first and second segments 2102*b*, 2102*c*, as well as a second and third portions 2102*d*, 2102*e*. The first segment 2102*b* is connected to the left knee shell 2004*a*, on the left end 1448 thereof, and detachably attach to the corresponding second portion 2102*d* of the elastic strap assembly 2102 assembly. The second segment 2102*c* is connected to the left lower leg portion 2006*a*, on the left end 2314 thereof, and detachably attach to the corresponding third portion 2102*e* of the elastic strap assembly 2102. In such an arrangement, the first and second segments 2102*b*, 2102*c* cross each other on the dorsal face of the wearer's left elbow for an optimal attachment and adjustment thereto. It will be appreciated that the elastic strap assembly 2102 assembly may be adjusted for providing the tension required for maintaining the left elbow knee 2004*a* around the wearer's left elbow to protect the sensitive region of the wearer's knee joint.

In one embodiment, the left knee shell 2004*a* of the left sleeve 302*a* is made of an outer hardened cap molded from any hardened material (e.g. polymers, plastics, high-density polyethylene (HDPE or polyethylene high-density (PEHD)), carbon fibers, fiberglass, and the likes) and of an inner foam layer together sandwiched between an outer and inner fabric layers by sewing and/or gluing the various layer(s) together. In another embodiment, as shown in FIG. 27, the foam layer defining somewhat of a honeycomb-like configuration 2404 on the inner face 1454 of the left knee shell 2004*a*. Therefore, it will be understood that the left knee shell 2004*a* may generally be assembled and built as the ventral and dorsal padding panels 500, 1200, as disclosed hereinbefore.

In an alternative embodiment, the left knee shell 2004*a* is connected to the lower leg portion 2006*a* by a strap or any other means known in the art enabling the wearer to adjust the length between left knee shell 2004*a* and the lower leg portion 2006*a* according to the wearer's size or preference.

Lower Leg Portion

With reference to FIGS. 23 and 24, the left lower leg portion 2006*a* of the left leg protector 110*a* generally defines an elongated C-shaped structure adapted for receiving the wearer's left lower leg therein when the left leg protector 110*a* is worn. More particularly, and referring to FIGS. 23, 26, and 27, the left lower leg portion 2006*a* comprises a top end 2310, a bottom end 2312, a left end 2314, and a right end 2316 (shown in FIG. 23), as well as an outer face 2318 (shown in FIG. 26) and inner face 2320 (shown in FIG. 27).

In one embodiment, as illustrated in FIG. 27, the left lower left leg portion 2006*a* comprises a foam layer sandwiched between an inner and outer fabric layers wherein, as it may be seen on the inner face 2320 of the left lower leg portion 2006*a*, the foam layer defines somewhat of a honeycomb-like configuration 2406 with ventilation holes operating together to enable optimum airflow, body temperature control, sweat evacuation of the wearer. In the embodiment of FIG. 25, defined on the outer face 2318 of the left lower left leg portion 2006*a*, running from the left end 2314 to the right end 2316 and extending between the top and bottom ends 2310, 2312 thereof, the left lower left leg portion 2006*a* also includes a first, second, third, fourth, and fifth protective sections 2308*a*, 2308*b*, 2308*c*, 2308*d*, 2308*d* extending between the top and bottom ends 2310, 2312.

In another embodiment, the outer face 2318 of the left lower leg portion 2006*a* further comprises a first, second, third, fourth, fifth, sixth, and seventh hardened inserts 2218*a*, 2218*b*, 2218*c*, 2218*d*, 2218*e*, 2218*f*, 2218*g* for providing additional protection to the left lower leg portion 2006*a*. More particularly, the first, second, and third hardened inserts 2218*a*, 2218*b*, 2218*c* are received on the second protective sections 2308*b*, the fourth, fifth, and sixth hardened inserts 2218*d*, 2218*e*, 2218*f* are received on the third protective sections 2308*c*, and the seventh hardened inserts 2218*g* is received on the fourth protective sections 2308*d*. In one embodiment, the hardened inserts 2218*a*, 2218*b*, 2218*c*, 2218*d*, 2218*e*, 2218*f*, 2218*g* are located between the foam layer and the outer fabric layer. As such, it will be appreciated that the left lower leg portion 2006*a* may generally be assembled and constructed as the ventral and dorsal padding panels 500, 1200, and may therefore include any number of foam and fabric layers, hardened inserts, and hardened shells.

As depicted in FIGS. 23 and 24, the left lower leg portion 2006*a* is attached to the wearer's left lower leg by an elastic strap assembly 2104. More particularly, and referring to FIG. 26, for attaching and adjusting the left lower leg portion 2006*a* to the wearer's left lower leg, the left lower leg portion 2006*a* is provided with a corresponding elastic strap assembly 2102 having a first portion 2102*a* located on the first protective section 2308*a*, on the vicinity of the top and bottom ends 2310, 2312, that detachably attach to the third portion 2102*d* of the elastic strap assembly 2102 assembly, which is located on the left knee shell 2004*a*, on the fifth protective section 2308*e* thereof. The first portions 2102*a* of the elastic strap assembly 2102 and the third portion 2102*d* of the elastic strap assembly 2102 assembly collaborate together for wrapping and surrounding the left lower leg portion 2006*a* to the wearer's left lower leg portion. In this configuration, the elastic strap assembly 2102*a*, which makes two contact points on the dorsal face of the wearer's left upper thigh for an optimal attachment and adjustment thereto, is configured for closing the left lower leg portion 2006*a* around the wearer's left lower leg, positioning the first, second, third, fourth, and fifth protective sections 2308*a*, 2308*b*, 2308*c*, 2308*d*, 2308*d* mostly on the frontal and lateral faces of the wearer's lower leg. In one embodiment, the bottom end 2312 of the left lower leg portion 2006*a* is adapted in size and shape to conform to the contour of the wearer's ankle to facilitate freedom of movement. In another embodiment, as shown in FIG. 27, the bottom end 2312 of the left lower leg portion 2006*a* is detachably attached to the foot section, as it will become apparent hereinbelow.

As shown in FIGS. 23 and 24, the left lower leg portion 2006*a* is also attached to the wearer's left lower leg, at the vicinity of the wearer's ankle, by an elastic strap assembly 2106. More particularly, and referring to FIG. 26, the elastic strap 2106 is provided with a first and second portions 2106*a*, 2106*b* running between the left and right ends 2314, 2316 of the lower leg portion 2006*a*, at the bottom end 2312 thereof. The first and second portions 2106*a*, 2106*b* of the elastic strap 2106 collaborate together for wrapping and surrounding the bottom end 2312 of the left lower leg portion 2006*a* to the wearer's left lower leg portion, including the wearer's ankle.

As for the elastic strap assembly 2100 of the upper thigh portion 2000*a*, the elastic element the elastic strap assemblies 2104, 2106 of the left lower leg portion 2006*a* may also include an elastic component and hook and loop components, such as a Velcro® component. It will be appreciated that the elastic component provide the required tension for the left lower leg portion 2006*a* to optimally wrap and surround the wearer's left lower leg, whereas the hook and loop components enables the wearer to easily and rapidly operate the elastic strap 2104.

In an alternative embodiment, the left lower leg portion 2006*a* is not integrally assembled and built with the left knee shell 2004*a* but is rather configured to be separate therefrom, where it may connect by a strap configurable (e.g. by an elastic strap or any other means) in length to modulate the distance between the left knee shell 2004*a* and the left lower leg portion 2006*a*.

Foot Shell

As depicted on FIGS. 23 to 24, provided on the lower leg portion 2006*a*, at the bottom end 2312 thereof, is a left-foot shell 2008*a* adapted for protecting the upper part of the wearer's left foot. Referring to FIG. 26, the left foot shell 2008*a* generally defines a semicircle and comprises a strap 2600 extending from its periphery and a concave portion 2602 for at least partially receiving the wearer's foot. In one embodiment, the left-foot shell 2008*a* generally conforms to the bottom end 2312 of the lower leg portion 2006*a* and to the shape of the wearer's foot. In another embodiment, the left-foot shell 2008*a* is detachably attached by the strap 2600 to the bottom end 2312 of the left lower leg portion 2006*a*, as it may be appreciated in FIGS. 25 to 26.

In one embodiment, the left foot shell 2008*a* of the left sleeve 302*a* is made of an outer hardened cap molded from any hardened material (e.g. polymers, plastics, high-density polyethylene (HDPE or polyethylene high-density (PEHD)), carbon fibers, fiberglass, and the likes) and of an inner foam layer together sandwiched between an outer and inner fabric layers by sewing and/or gluing the various layer(s) together. Therefore, it will be understood that the left knee shell 2004*a* may generally be assembled and built as the ventral and dorsal padding panels 500, 1200, as disclosed hereinbefore.

In an alternative embodiment, the left leg protector 110*a* comprises a first strap connecting the left upper thigh portion 2000*a* to the left knee shell 2004*a* and a second strap connecting the left knee shell 2004*a* to the left lower leg portion 2006*a*. Taken together, the first and second strap are configured to enable an adjustment of the left leg protector 110*a* length according to the wearer's arm size. More particularly, the first strap is configured to adjust the length between the left upper thigh portion 2000*a* and the left knee shell 2004*a*, while the second strap is configured to adjust the length between the left knee shell 2004*a* and the left lower leg portion 2006*a*. When the lengths are shortened, the left upper thigh portion 2000*a*, the left knee shell 2004*a*, and the left lower leg portion 2006*a* may further be adapted to superimpose one another and to conform the corresponding contour thereof.

Taken together, it will be appreciated that the left leg protector 110*a* optimally positions and disposes soft protective materials like foam(s) and more rigid protective material(s) like hardened insert(s) and hardened shell(s) on the wearer's lower limb such as to provide protection of same while enabling freedom of movement and body temperature control, for example by sweat evacuation.

In one embodiment, the lower body assembly 104 is worn by first dressing the left and right leg protectors 110*a*, 110*b* to the wearer's left and right legs, then attaching and adjusting the various components thereof according to the wearer's size or preference. It will be appreciated that either the lower or upper body assembly 104, 102 may be dressed first, followed by the other assembly. It will be understood that the upper and lower body assemblies 102, 104 of the present disclosure is modular and that any of its component may therefore be used independently from one another.

The above description of preferred embodiments should not be interpreted in a limiting manner since other variations, modifications and refinements are possible within the spirit and scope of the present invention. The scope of the invention is defined by the appended claims and their equivalents.

Although the above description relates to a specific preferred embodiment as presently contemplated by the inventor, it will be understood that the invention in its broad aspect includes mechanical and functional equivalents of the elements described herein.

The invention claimed is:

1. A protective torso assembly for protecting a wearer, the protective torso assembly comprising:

a ventral padding panel adapted for at least partially covering a ventral face of an upper-body portion of the wearer, the ventral padding panel having left and right top ends, a bottom end, a left end, and a right end, the ventral padding panel including:

at least one layer of a resiliently compressible material having a distal face and a proximal face relative to the wearer when the padding panel is worn, the at least one layer including:

at least one movement-facilitating groove defined on at least one of the distal face and the proximal face of the layer, the movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute for regulating body temperature of the wearer when the padding panel is worn;

a dorsal padding panel adapted for at least partially covering a dorsal face of an upper-body portion of the wearer, the dorsal padding panel having left and right top ends, a bottom end, a left end, and a right end, the dorsal padding panel including:

at least one layer of a resiliently compressible material having a distal face and a proximal face relative to the wearer when the padding panel is worn, the at least one layer including:

at least one movement-facilitating groove defined on at least one of the distal face and the proximal face of the layer, the movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute for regulating body temperature of the wearer when the padding panel is worn, left and right shoulder elements, the left and right shoulder elements each comprising a ventral shoulder element portion and dorsal shoulder element portion, the left and right shoulder elements detachably attaching the left and right top ends of the ventral padding panel to the corresponding left and right top ends of the dorsal padding panel, the left and right shoulder elements defining with the ventral padding panel and the dorsal padding panel a neck opening for receiving a neck of the wearer therein; and left and right flank elements, the left and right flank elements each comprising a ventral flank element portion and a dorsal flank element portion, the left and right flank elements detachably attaching the left and right ends of the ventral padding panel to the corresponding left and right ends of the dorsal padding panel, the left and right flank elements and the left and right shoulder elements defining with the ventral padding panel and the dorsal padding panel a pair of left and right arm openings for receiving left and right arms of the wearer therein.

2. A protective torso assembly according to claim 1, wherein the at least one layer of the ventral padding panel comprises a distal layer and a proximal layer relative to the wearer when the protective torso assembly is worn, the distal layer and the proximal layer each comprising a proximal face and a distal face, at least one of the distal layer and the proximal layer including:

at least one movement-facilitating groove defined on at least one of the distal face and the proximal face of the at least one of the distal layer and the proximal layer;

a plurality of ventilation holes extending between the distal face and the proximal face of at least one of the distal layer and the proximal layer; and at least one ventilation groove defined on the proximal face of at least one of the distal layer and the proximal layer.

3. A protective torso assembly according to claim 2, wherein the at least one movement-facilitating groove is defined on the distal face of the distal layer of the ventral padding panel.

4. A protective torso assembly according to claim 2, wherein the plurality of ventilation holes extends between the distal face and the proximal face of each of the distal layer and the proximal layer of the ventral padding panel.

5. A protective torso assembly according to claim 2, wherein the at least one ventilation groove is defined on the proximal face of the proximal layer of the ventral padding panel.

6. A protective torso assembly according to claim 2, wherein the ventral padding panel comprises a first layer of a protective material, a second layer of a protective material, a third layer of a protective material, and a fourth layer of a protective material, the first layer of a protective material being layered to the distal face of the distal layer of the ventral padding, the second layer of a protective material being layered to the proximal face of the distal layer of the ventral padding panel, the third layer of a protective material being layered to the distal face of the proximal of the ventral padding panel, and the fourth layer of a protective material being layered to the proximal face of the proximal layer of the ventral padding panel.

7. A protective torso assembly according to claim 6, wherein a pocket is defined between the second layer of a protective material and the third layer of a protective material of the ventral padding, the pocket being adapted for receiving a ballistic shield therein.

8. A protective torso assembly according to claim 2, wherein the dorsal padding panel comprises a first layer of a protective material, a second layer of a protective material, a third layer of a protective material, and a fourth layer of a protective material, the first layer of a protective material being layered to the distal face of the distal layer of the dorsal padding, the second layer of a protective material being layered to the proximal face of the distal layer of the dorsal padding panel, the third layer of a protective material being layered to the distal face of the proximal of the dorsal padding panel, and the fourth layer of a protective material being layered to the proximal face of the proximal layer of the dorsal padding panel.

9. A protective torso assembly according to claim 8, wherein a pocket is defined between the second layer of a protective material and the third layer of a protective material of the dorsal padding, the pocket being adapted for receiving a ballistic shield therein.

10. A protective torso assembly according to claim 1, wherein the at least one layer of the dorsal padding panel comprises a distal layer and a proximal layer relative to the wearer when the protective torso assembly is worn, the distal layer and the proximal layer of the dorsal padding panel each comprising a proximal face and a distal face, at least one of the distal layer and the proximal layer including:

at least one movement-facilitating groove defined on at least one of the distal face and the proximal face of at least one of the distal layer and the proximal layer;

a plurality of ventilation holes extending between the distal face and the proximal face of at least one the distal layer and the proximal layer; and at least one ventilation groove defined on the proximal face of at least one of the distal layer and the proximal layer.

11. A protective torso assembly according to claim 10, wherein the at least one movement-facilitating groove is defined on the distal face of the distal layer of the dorsal padding panel.

12. A protective torso assembly according to claim 10, wherein the plurality of ventilation holes extends between the distal face and the proximal face of each of the distal layer and the proximal layer of the dorsal padding panel.

13. A protective torso assembly according to claim 10, wherein the at least one ventilation groove is defined on the proximal face of the proximal layer of the dorsal padding panel.

14. A protective torso assembly according to claim 1, wherein at least one layer of a protective material is layered to any one of the distal face and the proximal face of any one of the at least one layer of a resiliently compressible material.

15. A protective upper limb assembly for protecting a wearer, the protective upper limb assembly comprising at least one protective sleeve, the least one protective sleeve including:

a shoulder shell having a cavity adapted for receiving at least partially a shoulder of the wearer therein;

an upper arm portion adapted for surrounding at least partially an upper arm of the wearer, the upper arm portion having top and bottom ends and a proximal face relative to the wearer, the upper arm portion being connected, at the top end thereof, to at least one of the shoulder shell and a corresponding left and right arm openings of a protective torso assembly;

an elbow shell having a cavity adapted for receiving at least partially an elbow of the wearer therein, the elbow shell having top and bottom ends, the elbow shell being pivotally connected, at the top end thereof, to the upper arm portion, at the bottom end thereof;

a forearm portion adapted for surrounding at least partially a forearm of the wearer, the forearm portion including top and bottom ends and a proximal face relative to the wearer, the forearm portion being pivotally connected, at the top end thereof, to the elbow shell, at the bottom end thereof; and a means for detachably attaching the protective sleeve to a corresponding upper limb of the wearer, wherein the upper arm portion and the forearm portion each include a layer of a resiliently compressible material having a distal face and a proximal face relative to the wearer when the protective sleeve is worn, the layer of a resiliently compressible material being provided with a plurality of ventilation holes extending between the distal face and the proximal face, the layer of a resiliently compressible material further being provided on the proximal face thereof with at least one ventilation groove, the plurality of ventilation holes and the ventilation groove contributing to regulate for regulating body temperature of the wearer when the protective upper limb assembly is worn.

16. A protective lower body assembly for protecting a wearer, the protective lower body assembly comprising at least one leg protector, the at least one leg protector including:

an upper thigh portion adapted for surrounding at least partially an upper thigh of the wearer, the upper thigh portion having top and bottom ends and a proximal face relative to the wearer;

a lower thigh portion having top and bottom ends, the lower thigh portion being pivotally connected, at the top end thereof, to the upper thigh portion, at the bottom end thereof;

a knee shell having a cavity adapted for receiving at least partially a knee of the wearer therein, the knee shell including top and bottom ends, the knee shell being pivotally connected, at the top end thereof, to the upper thigh portion, at the bottom end thereof;

a lower leg portion adapted for surrounding at least partially a lower leg of the wearer, the lower leg portion having top and bottom ends and a proximal face relative to the wearer, the lower leg portion being pivotally connected, at the top end thereof, to the knee shell, at the bottom end thereof;

a foot shell having a cavity adapted for covering at least partially a foot of the wearer, the foot shell being pivotally connected to the lower leg portion, at the bottom end thereof; and a means for detachably attaching the leg protector to a corresponding leg of the wearer, wherein the upper thigh portion, the lower thigh portion, and the lower leg portion each include a layer of a resiliently compressible material having a distal face and a proximal face relative to the wearer when the leg protector is worn, the layer of a resiliently compressible material of the upper thigh portion and the lower leg portion being provided with a plurality of ventilation holes extending between the distal face and the proximal face, the layer of a resiliently compressible material of the upper thigh portion and the lower leg portion further being provided on the proximal face thereof with at least one ventilation groove, the plurality of ventilation holes and the ventilation groove contributing for regulating body temperature of the wearer when the protective upper limb assembly is worn.

17. A kit comprising at least one of:

a protective torso assembly for protecting a wearer, the protective torso assembly comprising:

a ventral padding panel adapted for at least partially covering the ventral face of an upper-body portion of the wearer, the ventral padding panel having left and right top ends, a bottom end, a left end, and a right end, the ventral padding panel including:

at least one layer of a resiliently compressible material having a distal face and a proximal face relative to the wearer when the padding panel is worn, the at least one layer including:

at least one movement-facilitating groove defined on at least one of the distal face and the proximal face of the layer, the movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute for regulating body temperature of the wearer when the padding panel is worn;

a dorsal padding panel adapted for at least partially covering the dorsal face of an upper-body portion of the wearer, the dorsal padding panel having left and right top ends, a bottom end, a left end, and a right end, the dorsal padding panel including:

at least one layer of a resiliently compressible material having a distal face and a proximal face relative to the wearer when the padding panel is worn, the at least one layer including:

at least one movement-facilitating groove defined on at least one of the distal face and the proximal face of the layer, the movement-facilitating groove being configured for facilitating freedom of movement to the wearer;

a plurality of ventilation holes extending between the distal face and the proximal face of the layer; and at least one ventilation groove defined on the proximal face of the layer, whereby the plurality of ventilation holes and the at least one ventilation groove contribute for regulating body temperature of the wearer when the padding panel is worn;

left and right shoulder elements, the left and right shoulder elements each comprising a ventral shoulder element portion and dorsal shoulder element portion, the left and right shoulder elements detachably attaching the left and right top ends of the ventral padding panel to the corresponding left and right top ends of the dorsal padding panel, the left and right shoulder elements defining with the ventral padding panel and the dorsal padding panel a neck opening for receiving a neck of the wearer therein; and left and right flank elements, the left and right flank elements each comprising a ventral flank element portion and a dorsal flank element portion, the left and right flank elements detachably attaching the left and right ends of the ventral padding panel to the corresponding left and right ends of the dorsal padding panel, the left and right flank elements and the left and right shoulder elements defining with the ventral padding panel and the dorsal padding panel a pair of left and right arm openings for receiving left and right arms of the wearer therein;

a protective upper limb assembly for protecting a wearer, the protective upper limb assembly comprising at least one protective sleeve, the least one protective sleeve including:

a shoulder shell having a cavity adapted for receiving at least partially a shoulder of the wearer therein;

an upper arm portion adapted for surrounding at least partially an upper arm of the wearer, the upper arm portion having top and bottom ends and a proximal face relative to the wearer, the upper arm portion being connected, at the top end thereof, to at least one of the shoulder shell and a corresponding left and right arm openings of a protective torso assembly;

an elbow shell having a cavity adapted for receiving at least partially an elbow of the wearer therein, the elbow shell having top and bottom ends, the elbow shell being pivotally connected, at the top end thereof, to the upper arm portion, at the bottom end thereof;

a forearm portion adapted for surrounding at least partially a forearm of the wearer, the forearm portion including top and bottom ends and a proximal face relative to the wearer, the forearm portion being pivotally connected, at the top end thereof, to the elbow shell, at the bottom end thereof; and a means for detachably attaching the protective sleeve to a corresponding upper limb of the wearer, wherein the upper arm portion and the forearm portion each include a layer of a resiliently compressible material having a distal face and a proximal face relative to the wearer when the protective sleeve is worn, the layer of a resiliently compressible material being provided with a plurality of ventilation holes extending between the distal face and the proximal face, the layer of a resiliently compressible material further being provided on the proximal face thereof with at least one ventilation groove, the plurality of ventilation holes and the ventilation groove contributing for regulating body temperature of the wearer when the protective upper limb assembly is worn; and a protective lower body assembly for protecting a wearer, the protective lower body assembly comprising at least one leg protector, the at least one leg protector including:

an upper thigh portion adapted for surrounding at least partially an upper thigh of the wearer, the upper thigh portion having top and bottom ends and a proximal face relative to the wearer;

a lower thigh portion having top and bottom ends, the lower thigh portion being pivotally connected, at the top end thereof, to the upper thigh portion, at the bottom end thereof;

a knee shell having a cavity adapted for receiving at least partially a knee of the wearer therein, the knee shell including top and bottom ends, the knee shell being pivotally connected, at the top end thereof, to the upper thigh portion, at the bottom end thereof;

a lower leg portion adapted for surrounding at least partially a lower leg of the wearer, the lower leg portion having top and bottom ends and a proximal face relative to the wearer, the lower leg portion being pivotally connected, at the top end thereof, to the knee shell, at the bottom end thereof;

a foot shell having a cavity adapted for covering at least partially a foot of the wearer, the foot shell being pivotally connected to the lower leg portion, at the bottom end thereof; and a means for detachably attaching the leg protector to a corresponding leg of the wearer, wherein the upper thigh portion, the lower thigh portion, and the lower leg portion each include a layer of a resiliently compressible material having a distal face and a proximal face relative to the wearer when the leg protector is worn, the layer of a resiliently compressible material of the upper thigh portion and the lower leg portion being provided with a plurality of ventilation holes extending between the distal face and the proximal face, the layer of a resiliently compressible material of the upper thigh portion and the lower leg portion further being provided on the proximal face thereof with at least one ventilation groove, the plurality of ventilation holes and the ventilation groove contributing for regulating body temperature of the wearer when the protective upper limb assembly is worn.

* * * * *